US010154739B2

(12) United States Patent
Turner et al.

(10) Patent No.: US 10,154,739 B2
(45) Date of Patent: Dec. 18, 2018

(54) UNIVERSAL MERCHANDISER AND METHODS RELATING TO SAME

(71) Applicant: DCI Marketing, Inc., Milwaukee, WI (US)

(72) Inventors: Christopher J. Turner, Pewaukee, WI (US); Craig A. Fluegge, Menomonee Falls, WI (US)

(73) Assignee: Retail Space Solutions LLC, Milwaukee, WI (US)

( * ) Notice: Subject to any disclaimer, the term of this patent is extended or adjusted under 35 U.S.C. 154(b) by 305 days.

(21) Appl. No.: 14/558,448

(22) Filed: Dec. 2, 2014

(65) Prior Publication Data

US 2015/0157142 A1 Jun. 11, 2015

Related U.S. Application Data

(63) Continuation-in-part of application No. 29/510,619, filed on Dec. 1, 2014, now Pat. No. Des. 801,734.
(Continued)

(51) Int. Cl.
*A47F 1/12* (2006.01)
*A47F 5/00* (2006.01)
*A47B 57/58* (2006.01)

(52) U.S. Cl.
CPC ..... *A47F 1/125* (2013.01); *A47B 57/585* (2013.01); *A47F 5/005* (2013.01)

(58) Field of Classification Search
CPC ..... A47F 1/125; A47F 5/005; A47B 57/585
See application file for complete search history.

(56) References Cited

U.S. PATENT DOCUMENTS 153,227 A 7/1874 Walkee
159,940 A 2/1875 Levebich
(Continued)

FOREIGN PATENT DOCUMENTS

BE 906083 A2 4/1987
BE 1013877 11/2002
(Continued)

OTHER PUBLICATIONS

Bryson, et al., M. Scott, U.S. Appl. No. 60/588,665, "Merchandising System," filed Jul. 16, 2004, 27 pp.
(Continued)

*Primary Examiner* — Michael Safavi
(74) *Attorney, Agent, or Firm* — Fitch, Even, Tabin & Flannery LLP

(57) ABSTRACT

A universal front-facing merchandiser is described having a front rail having a first mating structure and a plurality of integrated pusher and divider assemblies. Each divider assembly includes a second mating structure that corresponds to and mates with the first mating structure to couple the integrated pusher and divider assemblies to the front rail. The mating structures of each pusher and divider assembly and the front rail are movable between a first position where the integrated pusher and divider assembly is coupled to and laterally movable about the front rail and is not removable from the front rail without force being applied to the integrated pusher and divider assembly and a second position where the integrated pusher and divider assembly is secured to the front rail in a desired position in a manner that hinders lateral movement of the integrated pusher and divider assembly.

24 Claims, 40 Drawing Sheets

Related U.S. Application Data

(60) Provisional application No. 61/910,941, filed on Dec. 2, 2013.

(56) References Cited

U.S. PATENT DOCUMENTS

| | | | |
|---|---|---|---|
| 431,373 | A | 7/1890 | Mendenhall |
| 436,704 | A | 9/1890 | Green |
| 452,673 | A | 5/1891 | Hunter |
| 551,642 | A | 12/1895 | Kleine |
| 607,890 | A | 7/1898 | Smith |
| 607,891 | A | 7/1898 | Smith |
| 632,231 | A | 9/1899 | Blades |
| 808,067 | A | 12/1905 | Cyrus |
| 847,863 | A | 3/1907 | Watts |
| 927,988 | A | 7/1909 | Massey |
| 1,030,317 | A | 6/1912 | Middauge |
| 1,271,508 | A | 7/1918 | Hall |
| 1,282,532 | A | 10/1918 | Bochenek |
| 1,674,582 | A | 6/1928 | Wheeler |
| 1,703,987 | A | 3/1929 | Butler |
| 1,786,392 | A | 12/1930 | Kemp |
| 1,910,516 | A | 5/1933 | Besenberg |
| 1,964,597 | A | 6/1934 | Rapellin |
| 1,971,749 | A | 8/1934 | Hamilton |
| 2,013,284 | A | 9/1935 | Michaud |
| 2,076,941 | A | 4/1937 | Farr |
| 2,079,754 | A | 5/1937 | Waxgiser |
| 2,110,299 | A | 3/1938 | Hinkle |
| 2,129,122 | A | 9/1938 | Follett |
| 2,218,444 | A | 10/1940 | Vineyard |
| 2,284,849 | A | 6/1942 | Schreyer |
| 2,308,851 | A | 1/1943 | Anderson |
| 2,499,088 | A | 2/1950 | Brill |
| 2,516,122 | A | 7/1950 | Hughes |
| 2,538,908 | A | 1/1951 | Mckeehan |
| 2,555,102 | A | 5/1951 | Anderson |
| 2,652,154 | A | 9/1953 | Stevens |
| 2,678,045 | A | 5/1954 | Erhard |
| 2,730,825 | A | 1/1956 | Wilds |
| 2,738,881 | A | 3/1956 | Gino |
| 2,750,049 | A | 6/1956 | Hunter |
| 2,775,365 | A | 12/1956 | Mestman |
| 2,889,907 | A | 6/1959 | Sullivan |
| 2,893,596 | A | 7/1959 | Gabrielsen |
| 2,934,212 | A | 4/1960 | Jacobson |
| 3,083,067 | A | 3/1963 | Holtz |
| 3,089,675 | A | 5/1963 | Lozier |
| 3,110,402 | A | 11/1963 | Mogulescu |
| 3,121,494 | A | 2/1964 | Berk |
| 3,161,295 | A | 12/1964 | Chesley |
| 3,166,195 | A | 1/1965 | Taber |
| 3,182,945 | A | 5/1965 | Sedo |
| 3,248,079 | A | 4/1966 | Kennedy |
| 3,308,961 | A | 3/1967 | Chesley |
| 3,339,746 | A | 9/1967 | Mccabe |
| 3,405,716 | A | 10/1968 | Cafiero |
| 3,452,899 | A | 7/1969 | Libberton |
| 3,501,016 | A | 3/1970 | Eaton |
| 3,501,019 | A | 3/1970 | Armstrong |
| D219,058 | S | 10/1970 | Kaczur |
| 3,550,979 | A | 12/1970 | Protzmann |
| 3,587,867 | A | 6/1971 | Fenwick |
| 3,751,129 | A | 8/1973 | Dean |
| 3,776,388 | A | 12/1973 | Mattheis |
| 3,780,876 | A | 12/1973 | Elkins |
| 3,814,490 | A | 6/1974 | Dean |
| 3,815,519 | A | 6/1974 | Meyer |
| 3,832,957 | A | 9/1974 | Mendenhall |
| 3,848,745 | A | 11/1974 | Smith |
| 3,868,021 | A | 2/1975 | Heinrich |
| 3,893,739 | A | 7/1975 | Bernard |
| 3,949,880 | A | 4/1976 | Fortunato |
| 3,960,273 | A | 6/1976 | Weston |
| 3,987,384 | A | 10/1976 | Bohlke |
| 4,007,841 | A | 2/1977 | Seipel |
| 4,015,886 | A | 4/1977 | Wickenberg |
| 4,042,096 | A | 8/1977 | Smith |
| 4,084,703 | A | 4/1978 | Hossalla |
| 4,106,668 | A | 8/1978 | Gebhardt |
| 4,168,780 | A | 9/1979 | Parrott |
| 4,200,201 | A | 4/1980 | Collins |
| 4,205,763 | A | 6/1980 | Merl |
| 4,239,099 | A | 12/1980 | Brown, Jr. |
| 4,239,100 | A | 12/1980 | Corey |
| 4,269,326 | A | 5/1981 | Delbrouck |
| RE30,706 | E | 8/1981 | Bustos |
| 4,300,693 | A | 11/1981 | Spamer |
| 4,303,162 | A | 12/1981 | Suttles |
| 4,351,439 | A | 9/1982 | Taylor |
| 4,357,439 | A | 11/1982 | Blumel |
| 4,372,451 | A | 2/1983 | Rasmussen |
| 4,394,910 | A | 7/1983 | Miller |
| 4,397,606 | A | 8/1983 | Bruton |
| 4,405,052 | A | 9/1983 | Spiros |
| 4,416,380 | A | 11/1983 | Flum |
| 4,448,653 | A | 5/1984 | Wegmann |
| 4,453,641 | A | 6/1984 | Rasmussen |
| 4,454,948 | A | 6/1984 | Spamer |
| 4,454,949 | A | 6/1984 | Flum |
| 4,460,096 | A | 7/1984 | Ricci |
| 4,462,854 | A | 7/1984 | Wenstrom |
| D275,058 | S | 8/1984 | Flum |
| 4,463,854 | A | 8/1984 | MacKenzie |
| 4,470,943 | A | 9/1984 | Preis |
| 4,478,337 | A | 10/1984 | Flum |
| 4,482,066 | A | 11/1984 | Dykstra |
| 4,488,653 | A | 12/1984 | Belokin |
| 4,525,882 | A | 7/1985 | Stenberg |
| 4,531,311 | A | 7/1985 | Howard |
| 4,590,696 | A | 5/1986 | Squitieri |
| 4,593,823 | A | 6/1986 | Fershko |
| 4,610,413 | A | 9/1986 | Pedersen |
| 4,615,276 | A | 10/1986 | Garabedian |
| 4,629,072 | A | 12/1986 | Loew |
| 4,651,883 | A | 3/1987 | Gullett |
| 4,685,574 | A | 8/1987 | Young |
| 4,688,341 | A | 8/1987 | Castel |
| 4,706,821 | A | 11/1987 | Kohls |
| 4,712,694 | A | 12/1987 | Breslow |
| 4,724,968 | A | 2/1988 | Wombacher |
| 4,730,741 | A | 3/1988 | Jackle |
| 4,735,324 | A | 4/1988 | Wilcek |
| 4,742,936 | A | 5/1988 | Rein |
| 4,762,235 | A | 8/1988 | Howard |
| 4,762,236 | A | 8/1988 | Jackle |
| 4,765,493 | A | 8/1988 | Kinney |
| 4,771,898 | A | 9/1988 | Howard |
| 4,775,058 | A | 10/1988 | Yatsko |
| 4,801,025 | A | 1/1989 | Flum |
| 4,809,855 | A | 3/1989 | Bustos |
| 4,826,115 | A | 5/1989 | Novitski |
| 4,830,201 | A | 5/1989 | Breslow |
| 4,836,390 | A | 6/1989 | Polvere |
| 4,887,737 | A | 12/1989 | Adenau |
| 4,896,779 | A | 1/1990 | Jureckson |
| 4,899,893 | A | 2/1990 | Robertson |
| 4,901,869 | A | 2/1990 | Hawkinson |
| 4,907,707 | A | 3/1990 | Crum |
| 4,923,070 | A | 5/1990 | Jackle |
| 4,934,645 | A | 6/1990 | Breslow |
| 4,944,924 | A | 7/1990 | Mawhirt |
| 4,958,739 | A | 9/1990 | Spamer |
| RE33,515 | E | 1/1991 | Fershko |
| 4,997,094 | A | 3/1991 | Spamer |
| 5,012,936 | A | 5/1991 | Crum |
| 5,024,336 | A | 6/1991 | Spamer |
| 5,069,408 | A | 12/1991 | Bessinger |
| 5,085,154 | A | 2/1992 | Merl |
| 5,088,607 | A | 2/1992 | Risafi |
| 5,111,942 | A | 5/1992 | Bernardin |
| 5,123,546 | A | 6/1992 | Crum |
| 5,150,885 | A | 9/1992 | Leone |
| 5,159,753 | A | 11/1992 | Torrence |
| 5,161,704 | A | 11/1992 | Valiulis |

(56) References Cited

U.S. PATENT DOCUMENTS 5,185,948 A 2/1993 Markson
5,190,186 A 3/1993 Yablans
5,197,215 A 3/1993 Torsleff
5,197,610 A 3/1993 Bustos
5,203,463 A 4/1993 Gold
5,263,269 A 11/1993 Tjarnlund
5,265,738 A 11/1993 Yablans
5,265,740 A 11/1993 Hodsden
5,295,596 A 3/1994 Squitieri
5,322,668 A 6/1994 Tomasso
5,366,099 A 11/1994 Schmid
5,390,802 A 2/1995 Pappagallo
5,397,006 A 3/1995 Terrell
5,397,016 A 3/1995 Torrence
5,405,193 A 4/1995 Herrenbruck
5,413,229 A 5/1995 Zuberbuhler
5,427,255 A 6/1995 Nook
5,439,122 A 8/1995 Ramsay
5,450,968 A 9/1995 Bustos
5,450,969 A 9/1995 Johnson
5,469,976 A 11/1995 Burchell
5,505,315 A 4/1996 Carroll
5,570,811 A 11/1996 Wittern
5,582,376 A 12/1996 Thompson
5,597,150 A 1/1997 Stein
D378,888 S 4/1997 Bertilsson
5,634,564 A 6/1997 Spamer
5,638,963 A 6/1997 Finnelly
5,641,082 A 6/1997 Grainger
5,645,176 A 7/1997 Jay
5,655,670 A 8/1997 Stuart
5,657,702 A 8/1997 Rodolphe
5,671,851 A 9/1997 Johnson
5,673,801 A 10/1997 Markson
D386,363 S 11/1997 Dardashti
5,682,824 A 11/1997 Visk
5,685,664 A 11/1997 Parham
5,685,864 A 11/1997 Shanley
5,690,038 A 11/1997 Merit
5,695,076 A 12/1997 Jay
5,695,077 A 12/1997 Jay
5,707,034 A 1/1998 Cotterill
5,711,432 A 1/1998 Stein
5,720,230 A 2/1998 Mansfield
5,738,019 A 4/1998 Parker
5,749,478 A 5/1998 Ellis
5,749,616 A * 5/1998 Steever ..... A62C 27/00 211/184
5,839,588 A 11/1998 Hawkinson
D402,490 S 12/1998 Parham
5,848,709 A 12/1998 Gelphman
5,855,283 A 1/1999 Johnson
D405,632 S 2/1999 Parham
5,865,324 A 2/1999 Jay
5,873,473 A 2/1999 Pater
5,873,489 A 2/1999 Ide
5,887,732 A 3/1999 Zimmer
5,904,256 A 5/1999 Jay
5,944,201 A 8/1999 Babboni
5,970,887 A 10/1999 Hardy
5,971,173 A 10/1999 Valiulis
5,975,318 A 11/1999 Jay
5,992,652 A 11/1999 Springs
6,006,678 A 12/1999 Merit
6,021,908 A 2/2000 Mathews
6,026,984 A 2/2000 Perrin
6,029,833 A 2/2000 Yeh
6,041,720 A 3/2000 Hardy
6,044,982 A 4/2000 Stuart
6,062,399 A 5/2000 Henry
6,068,142 A 5/2000 Primiano
6,082,556 A 7/2000 Primiano
6,082,557 A 7/2000 Leahy
6,129,218 A 10/2000 Henry
6,131,748 A 10/2000 Kawasaki
6,142,316 A 11/2000 Harbour
6,142,317 A 11/2000 Merl
6,164,462 A 12/2000 Mumford
6,189,734 B1 2/2001 Apps
6,209,731 B1 4/2001 Spamer
6,227,385 B1 5/2001 Nickerson
6,237,784 B1 5/2001 Primiano
D445,615 S 7/2001 Burke
6,253,954 B1 7/2001 Yasaka
6,299,004 B1 10/2001 Thalenfeld
6,305,559 B1 10/2001 Hardy
6,308,839 B1 10/2001 Steinberg
6,311,852 B1 11/2001 Ireland
6,325,221 B2 12/2001 Parham
6,325,222 B1 12/2001 Avery
6,330,758 B1 12/2001 Feibelman
6,357,606 B1 3/2002 Henry
6,375,015 B1 4/2002 Wingate
6,382,431 B1 5/2002 Burke
6,389,991 B1 5/2002 Morrisson
6,394,470 B1 5/2002 Shirai
6,398,044 B1 6/2002 Robertson
6,401,942 B1 6/2002 Eckert
6,405,880 B1 6/2002 Webb
6,409,026 B2 6/2002 Watanabe
6,409,028 B2 6/2002 Nickerson
6,419,100 B1 7/2002 Menz
6,428,123 B1 8/2002 Lucht
6,435,359 B1 8/2002 Priminano
6,439,402 B2 8/2002 Robertson
6,464,089 B1 10/2002 Rankin, VI
6,471,053 B1 10/2002 Feibelman
6,474,484 B1 11/2002 Miller
6,481,133 B1 11/2002 DeSena
6,497,326 B1 12/2002 Osawa
6,505,747 B1 1/2003 Robertson
6,511,082 B2 1/2003 Shirai
6,523,702 B1 2/2003 Primiano
6,527,127 B2 3/2003 Dumontet
6,527,129 B2 3/2003 Osawa
6,533,131 B2 3/2003 Bada
D472,411 S 4/2003 Burke
6,554,143 B1 4/2003 Robertson
6,598,754 B2 7/2003 Weiler
6,604,638 B1 8/2003 Primiano
6,615,995 B2 9/2003 Primiano
6,622,874 B1 9/2003 Hawkinson
6,629,617 B2 10/2003 Osawa
6,637,604 B1 10/2003 Jay
6,648,151 B2 11/2003 Battaglia
6,659,293 B1 12/2003 Smith
6,666,533 B1 12/2003 Stavros
D485,699 S 1/2004 Mueller
6,679,033 B2 1/2004 Hart
6,679,389 B1 1/2004 Robertson
6,691,891 B2 2/2004 Maldonado
6,695,152 B1 2/2004 Fabrizio
6,702,127 B2 3/2004 Primiano
6,715,621 B2 4/2004 Boron
6,722,509 B1 4/2004 Robertson
6,726,039 B2 4/2004 Boron
RE38,517 E 5/2004 Pfeiffer
6,739,461 B1 5/2004 Robinson
6,745,905 B2 6/2004 Bernstein
6,756,975 B1 6/2004 Kishida
6,758,349 B1 7/2004 Kwap
6,766,911 B2 7/2004 Higgins
6,769,552 B1 8/2004 Thalenfeld
6,779,670 B2 8/2004 Primiano
6,786,341 B2 9/2004 Stinnett
6,796,445 B2 9/2004 Cyrluk
6,799,523 B1 10/2004 Cunha
6,820,754 B2 11/2004 Ondrasik
6,824,046 B2 11/2004 Brexel
6,843,382 B2 1/2005 Kanouchi
6,860,046 B1 3/2005 Squitieri
6,867,824 B2 3/2005 Eiraku
6,874,646 B2 4/2005 Jay
6,886,699 B2 5/2005 Johnson

(56) References Cited

U.S. PATENT DOCUMENTS 6,889,855 B2 5/2005 Nagel
D506,623 S 6/2005 Ohkubo
6,902,285 B2 6/2005 Eiraku
6,918,495 B1 7/2005 Hoy
6,918,736 B2 7/2005 Hart
6,919,933 B2 7/2005 Zhang
D508,350 S 8/2005 Higuchi
6,923,330 B1 8/2005 Nagel
6,929,133 B1 8/2005 Knapp
6,955,269 B2 10/2005 Menz
6,957,941 B2 10/2005 Hart
6,962,260 B2 11/2005 Jay
6,963,386 B2 11/2005 Poliakine
6,964,235 B2 11/2005 Hardy
6,964,344 B1 11/2005 Kim
6,976,598 B2 12/2005 Engel
6,981,597 B2 1/2006 Cash
7,004,334 B2 2/2006 Walsh
7,007,614 B2 3/2006 Gaunt
D519,309 S 4/2006 Terada
7,028,450 B2 4/2006 Hart
7,028,852 B2 4/2006 Johnson
D520,776 S 5/2006 Richter
7,040,494 B2 5/2006 Harper
D524,576 S 7/2006 Nomoto
7,080,969 B2 7/2006 Hart
7,086,541 B2 8/2006 Robertson
7,093,546 B2 8/2006 Hardy
7,104,026 B2 9/2006 Welborn
7,104,410 B2 9/2006 Primiano
7,108,143 B1 9/2006 Lin
D529,313 S 10/2006 Nomoto
D529,737 S 10/2006 Terada
D530,117 S 10/2006 Nomoto
7,124,898 B2 10/2006 Richter
7,140,499 B2 11/2006 Burke
7,140,705 B2 11/2006 Dressendorfer
7,150,365 B2 12/2006 Hardy
7,152,536 B2 12/2006 Hardy
7,168,579 B2 1/2007 Richter
7,182,209 B2 2/2007 Squitieri
7,195,123 B2 3/2007 Roslof
D541,082 S 4/2007 Nomoto
7,198,340 B1 4/2007 Ertz
7,216,770 B2 5/2007 Mueller
7,229,143 B2 6/2007 Gilman
7,293,663 B2 11/2007 Lavery
7,299,934 B2 11/2007 Hardy
7,306,301 B2 12/2007 Walburn
7,311,211 B2 12/2007 Chung
7,318,532 B1 1/2008 Lee
7,347,335 B2 3/2008 Rankin, VI
7,357,469 B2 4/2008 Ertz
7,389,886 B2 6/2008 Hardy
7,395,938 B2 7/2008 Merit
7,404,494 B2 7/2008 Hardy
7,419,062 B2 9/2008 Mason
7,424,957 B1 9/2008 Luberto
7,438,268 B2 10/2008 Kologe
7,451,881 B2 11/2008 Hardy
7,462,012 B2 12/2008 Hart
7,469,791 B2 12/2008 Phoy
7,497,341 B2 3/2009 Hardy
7,497,342 B2 3/2009 Hardy
7,506,769 B2 3/2009 Howerton
7,614,350 B2 11/2009 Tuttle
7,621,409 B2 11/2009 Hardy
7,626,913 B2 12/2009 Usami
7,628,282 B2 12/2009 Hardy
7,641,057 B2 1/2010 Mueller
7,661,545 B2 2/2010 Hardy
7,665,618 B2 2/2010 Jay
7,669,722 B2 3/2010 Hardy
7,681,743 B2 3/2010 Hanretty
7,681,744 B2 3/2010 Johnson
7,703,614 B2 4/2010 Schneider
D615,389 S 5/2010 Shinozaki
D615,390 S 5/2010 Shinozaki
7,784,623 B2 8/2010 Mueller
7,823,734 B2 11/2010 Hardy
7,828,158 B2 11/2010 Colelli
7,891,503 B2 2/2011 Hardy
7,913,861 B2 3/2011 Mueller
7,918,353 B1 4/2011 Luberto
7,922,010 B2 4/2011 Hardy
7,931,156 B2 4/2011 Hardy
7,934,609 B2 5/2011 Alves
7,971,735 B2 7/2011 Mueller
7,980,398 B2 7/2011 Kahl
7,992,726 B2 8/2011 Goehring
8,016,139 B2 9/2011 Hanners
8,025,162 B2 9/2011 Hardy
8,047,385 B2 11/2011 Hardy
8,056,734 B2 11/2011 Menz
8,096,427 B2 1/2012 Hardy
8,104,630 B2 1/2012 Schneider
8,113,360 B2 2/2012 Olson
8,113,601 B2 2/2012 Hardy
8,118,181 B2 2/2012 Shinozaki
D655,107 S 3/2012 Clark
8,127,944 B2 3/2012 Hardy
8,136,682 B2 3/2012 Hardy
8,162,154 B2 4/2012 Trulaske
8,167,149 B2 5/2012 Wamsley
8,172,094 B2 5/2012 Meyer
8,177,076 B2 5/2012 Rataiczak
8,210,363 B2 7/2012 Hardy
8,215,520 B2 7/2012 Miller
8,225,946 B2 7/2012 Yang
8,235,222 B2 8/2012 Hardy
8,235,227 B2 8/2012 Hardy
8,276,766 B2 10/2012 Rataiczak, III
8,312,999 B2 11/2012 Hardy
8,317,038 B2 11/2012 Luberto
8,322,544 B2 12/2012 Hardy
8,342,340 B2 1/2013 Rataiczak
8,353,425 B2 1/2013 Lockwood
8,360,253 B2 1/2013 Hardy
8,397,922 B2 3/2013 Kahl
8,413,823 B2 4/2013 Hardy
8,424,466 B2 4/2013 Botkin
8,453,850 B2 6/2013 Hardy
8,453,851 B2 6/2013 Ciesick
8,485,391 B2 7/2013 Vlastakis
8,496,126 B2 7/2013 Mueller
8,505,750 B2 8/2013 Shinozaki
8,505,751 B2 8/2013 Shinozaki
8,505,752 B2 8/2013 Shinozaki
8,561,817 B1 10/2013 Allen
8,579,123 B2 11/2013 Mueller
8,622,227 B2 1/2014 Bird
8,627,965 B2 1/2014 Hardy
8,646,650 B2 2/2014 Lockwood
8,662,319 B2 3/2014 Hardy
8,678,207 B2 3/2014 Shimazaki
8,695,816 B2 4/2014 Troyner
8,720,702 B2 5/2014 Nagel
8,739,984 B2 6/2014 Hardy
8,746,468 B2 6/2014 Poulokefalos
8,752,717 B2 6/2014 Bird
8,800,811 B2 8/2014 Sherretts
8,820,545 B2 9/2014 Kologe
8,863,963 B2 10/2014 Hardy
8,893,901 B2 11/2014 Nagel
8,893,903 B2 11/2014 Nilsson
8,910,802 B2 12/2014 Hardy
8,967,394 B2 3/2015 Hardy
8,978,903 B2 3/2015 Hardy
8,978,904 B2 3/2015 Hardy
8,998,005 B2 4/2015 Hardy
9,016,483 B2 4/2015 Howley
9,033,164 B2 5/2015 Troyner
9,038,833 B2 5/2015 Ciesick
9,038,854 B2 5/2015 Brugmann

(56) References Cited

U.S. PATENT DOCUMENTS 9,060,624 B2 6/2015 Hardy
9,070,261 B2 6/2015 Hardy
9,072,394 B2 7/2015 Hardy
9,084,482 B2 7/2015 Botkin
9,107,515 B2 8/2015 Hardy
9,119,488 B2 9/2015 Lockwood
9,138,075 B2 9/2015 Hardy
9,149,132 B2 10/2015 Hardy
9,167,913 B2 10/2015 Hardy
9,173,504 B2 11/2015 Hardy
9,198,527 B2 12/2015 Goehring
9,226,597 B2 1/2016 Hardy
9,289,078 B2 3/2016 Hardy
9,392,887 B2 7/2016 Nilsson
9,468,310 B2 10/2016 Hardy
9,486,088 B2 11/2016 Hardy
9,504,321 B2 11/2016 Hardy
9,510,677 B2 12/2016 Hardy
9,526,351 B2 12/2016 Hardy
9,549,622 B2 1/2017 Leahy
9,723,934 B2 8/2017 Hardy
9,730,528 B2 8/2017 Hardy
D801,734 S 11/2017 Turner
2001/0002658 A1 6/2001 Parham
2001/0010302 A1 8/2001 Nickerson
2001/0019032 A1 9/2001 Battaglia
2001/0020604 A1 9/2001 Battaglia
2001/0042706 A1 11/2001 Ryan
2001/0045403 A1 11/2001 Robertson
2002/0024273 A1 2/2002 Osawa
2002/0066706 A1 6/2002 Robertson
2002/0079660 A1 6/2002 Shirai
2002/0148794 A1 10/2002 Marihugh
2002/0166830 A1 11/2002 Boron
2002/0170866 A1 11/2002 Johnson
2002/0179553 A1 12/2002 Squitieri
2002/0179556 A1 12/2002 Osawa
2002/0182050 A1 12/2002 Hart
2002/0189201 A1 12/2002 Hart
2002/0189209 A1 12/2002 Hart
2003/0000956 A1 1/2003 Maldonado
2003/0000957 A1 1/2003 Brexel
2003/0007859 A1 1/2003 Hart
2003/0024889 A1 2/2003 Dumontet
2003/0029824 A1 2/2003 Weiler
2003/0057167 A1 3/2003 Johnson
2003/0080075 A1 5/2003 Primiano
2003/0085187 A1 5/2003 Johnson
2003/0132178 A1 7/2003 Jay
2003/0132182 A1 7/2003 Jay
2003/0136750 A1 7/2003 Fujii
2003/0168420 A1 9/2003 Primiano
2003/0226815 A1 12/2003 Gaunt
2004/0000528 A1 1/2004 Nagel
2004/0004046 A1 1/2004 Primiano
2004/0079715 A1 4/2004 Richter
2004/0084390 A1 5/2004 Bernstein
2004/0094493 A1 5/2004 Higgins
2004/0105556 A1 6/2004 Grove
2004/0118794 A1 6/2004 Hardy
2004/0178156 A1 9/2004 Knorring
2004/0182805 A1 9/2004 Harper
2004/0206054 A1 10/2004 Welborn
2004/0232092 A1 11/2004 Cash
2004/0245197 A1 12/2004 McElvaney
2005/0040123 A1 2/2005 Ali
2005/0072747 A1 4/2005 Roslof
2005/0076817 A1 4/2005 Boks
2005/0098515 A1 5/2005 Close
2005/0127014 A1 6/2005 Richter
2005/0133471 A1 6/2005 Squitieri
2005/0133474 A1 6/2005 Nomoto
2005/0139560 A1 6/2005 Whiteside
2005/0139561 A1 6/2005 Ohkubo
2005/0150847 A1 7/2005 Hawkinson
2005/0166806 A1 8/2005 Hardy
2005/0189310 A1 9/2005 Richter
2005/0199563 A1 9/2005 Richter
2005/0199564 A1 9/2005 Johnson
2005/0199565 A1 9/2005 Richter
2005/0224437 A1 10/2005 Lee
2005/0249577 A1 11/2005 Hart
2005/0263465 A1 12/2005 Chung
2005/0286700 A1 12/2005 Hardy
2006/0001337 A1 1/2006 Walburn
2006/0021957 A1 2/2006 Hardy
2006/0032827 A1 2/2006 Phoy
2006/0049122 A1 3/2006 Mueller
2006/0049125 A1 3/2006 Stowell
2006/0086680 A1 4/2006 Burke
2006/0104758 A1 5/2006 Hart
2006/0163272 A1 7/2006 Gamble
2006/0166830 A1 7/2006 Matsuzaki
2006/0186064 A1 8/2006 Merit
2006/0196840 A1 9/2006 Jay
2006/0213852 A1 9/2006 Kwon
2006/0226095 A1 10/2006 Hardy
2006/0260518 A1 11/2006 Josefsson
2006/0263192 A1 11/2006 Hart
2006/0273053 A1 12/2006 Roslof
2006/0283150 A1 12/2006 Hart
2006/0283151 A1 12/2006 Welborn
2007/0006885 A1 1/2007 Shultz
2007/0090068 A1 4/2007 Hardy
2007/0108142 A1 5/2007 Medcalf
2007/0170127 A1 7/2007 Johnson
2007/0175839 A1 8/2007 Schneider
2007/0175844 A1 8/2007 Schneider
2007/0187344 A1 8/2007 Mueller
2007/0256992 A1 11/2007 Olson
2007/0267367 A1 11/2007 Mueller
2008/0011696 A1 1/2008 Richter
2008/0129161 A1 6/2008 Menz
2008/0156751 A1 7/2008 Richter
2008/0156752 A1 7/2008 Bryson
2008/0164229 A1 7/2008 Richter
2008/0203040 A1 8/2008 Kologe
2008/0296241 A1* 12/2008 Alves ..... A47F 5/005
211/90.04
2008/0314852 A1 12/2008 Richter
2010/0017025 A1 1/2010 Lockwood
2010/0059469 A1 3/2010 Mason
2010/0078398 A1 4/2010 Hardy
2010/0116760 A1 5/2010 Fazzone
2010/0206829 A1 8/2010 Clements
2010/0276383 A1 11/2010 Hardy
2011/0139736 A1 6/2011 Hardy
2011/0174750 A1 7/2011 Poulokefalos
2012/0006773 A1 1/2012 Mueller
2012/0055892 A1 3/2012 Hardy
2012/0111813 A1 5/2012 Hardy
2012/0118840 A1 5/2012 Howley
2013/0015155 A1 1/2013 Brugmann
2013/0026122 A1 1/2013 Shimazaki
2013/0026176 A1 1/2013 Brugmann
2013/0062295 A1 3/2013 Bird
2013/0112640 A1 5/2013 Desmond
2013/0193095 A1 8/2013 Nagel
2013/0193096 A1 8/2013 Hardy
2013/0327730 A1 12/2013 Hardy
2014/0034592 A1 2/2014 Hardy
2014/0097149 A1 4/2014 Hardy
2014/0116972 A1 5/2014 Botkin
2014/0117818 A1 5/2014 Dipaolo
2014/0138330 A1 5/2014 Hardy
2014/0151313 A1 6/2014 Breslow
2014/0175024 A1 6/2014 Schoepf
2014/0175034 A1 6/2014 Hardy
2014/0175035 A1 6/2014 Hardy
2014/0190913 A1 7/2014 Hardy
2014/0217042 A1 8/2014 Hardy
2014/0226315 A1 8/2014 Nicieja
2014/0263134 A1 9/2014 Walker
2014/0284290 A1 9/2014 Hardy

(56) References Cited

U.S. PATENT DOCUMENTS

| | | | |
|---|---|---|---|
| 2014/0305892 | A1 | 10/2014 | Hardy |
| 2014/0326690 | A1 | 11/2014 | Hardy |
| 2014/0332480 | A1 | 11/2014 | Hardy |
| 2015/0053631 | A1 | 2/2015 | Hardy |
| 2015/0108075 | A1 | 4/2015 | Hardy |
| 2015/0157142 | A1 | 6/2015 | Turner |
| 2015/0164242 | A1 | 6/2015 | Hardy |
| 2015/0164245 | A1 | 6/2015 | Hardy |
| 2015/0223620 | A1 | 8/2015 | Nilsson |
| 2015/0359358 | A1 | 12/2015 | Miller, Jr. |
| 2015/0374120 | A1 | 12/2015 | Hardy |
| 2016/0000235 | A1 | 1/2016 | Hardy |
| 2017/0035218 | A1 | 2/2017 | Riley |
| 2017/0164762 | A1 | 6/2017 | Bryson |

FOREIGN PATENT DOCUMENTS

| | | | | | |
|---|---|---|---|---|---|
| CA | 2766171 | | | 1/2011 | |
| CA | 2719208 | | | 5/2011 | |
| CA | 2725928 | | | 6/2011 | |
| CA | 2848792 | A1 | | 10/2014 | |
| CH | 412251 | A | | 4/1966 | |
| DE | 697994 | | | 10/1940 | |
| DE | 969003 | | | 4/1958 | |
| DE | 1819158 | | | 10/1960 | |
| DE | 2011792 | A | | 3/1970 | |
| DE | 7311113 | | | 8/1973 | |
| DE | 2002720 | | | 10/1979 | |
| DE | 2232398 | | | 3/1981 | |
| DE | 2825724 | | | 5/1981 | |
| DE | 8308485 | | | 9/1983 | |
| DE | 8426651 | | | 2/1985 | |
| DE | 8520125 | U1 | | 1/1986 | |
| DE | 87173867 | U1 | | 4/1988 | |
| DE | 3707410 | A1 | | 9/1988 | |
| DE | 9300431 | | | 3/1993 | |
| DE | 29618870 | | | 1/1997 | |
| DE | 29902688 | | | 7/1999 | |
| DE | 29902688 | U1 | | 7/1999 | |
| DE | 202009013581 | U1 | | 3/2010 | |
| DE | 202016104354 | | | 8/2016 | |
| DE | 202016008093 | U1 | | 1/2017 | |
| EP | 0018003 | A2 | | 10/1980 | |
| EP | 0004921 | | | 11/1981 | |
| EP | 0176209 | | | 4/1986 | |
| EP | 0337340 | A3 | | 5/1990 | |
| EP | 0398500 | A1 | | 11/1990 | |
| EP | 0408400 | | | 1/1991 | |
| EP | 0454586 | A1 | | 10/1991 | |
| EP | 0224107 | | | 1/1992 | |
| EP | 0270016 | | | 2/1992 | |
| EP | 0267569 | B1 | | 9/1993 | |
| EP | 0568396 | | | 11/1993 | |
| EP | 0587059 | | | 3/1994 | |
| EP | 0956794 | A2 | | 11/1999 | |
| EP | 0986980 | | | 3/2000 | |
| EP | 0779047 | | | 4/2000 | |
| EP | 1174060 | | | 1/2002 | |
| EP | 1395152 | | | 2/2005 | |
| EP | 1256296 | | | 7/2005 | |
| EP | 1549182 | | | 8/2007 | |
| EP | 1857021 | | | 11/2007 | |
| EP | 1510156 | | | 5/2008 | |
| EP | 2859816 | A1 | | 4/2015 | |
| EP | 2957195 | A1 | | 12/2015 | |
| EP | 3017724 | A1 | | 5/2016 | |
| FR | 2385365 | | | 10/1978 | |
| FR | 2526338 | | | 11/1983 | |
| FR | 2617385 | | | 1/1989 | |
| FR | 2724098 | | | 3/1996 | |
| FR | 2735963 | | | 1/1997 | |
| GB | 740311 | | | 11/1955 | |
| GB | 881700 | | | 11/1961 | |
| GB | 1082150 | | | 9/1967 | |
| GB | 2027339 | | | 2/1989 | |
| GB | 2037553 | | | 7/1994 | |
| GB | 2281289 | | | 1/1995 | |
| GB | 2283407 | | | 5/1995 | |
| GB | 2290077 | | | 12/1995 | |
| GB | 2297241 | | | 7/1996 | |
| GB | 1088654 | | | 11/2000 | |
| GB | 2360514 | | | 9/2001 | |
| GB | 2386116 | | * | 9/2003 | ..... A47F 1/125 |
| GB | 2386116 | A | | 9/2003 | |
| GB | 2392667 | | | 3/2004 | |
| JP | 54168198 | | | 11/1979 | |
| JP | 59218113 | | | 12/1984 | |
| JP | 62060521 | | | 3/1987 | |
| JP | 6202945 | | | 8/1987 | |
| JP | 63029463 | | | 2/1988 | |
| JP | S63099810 | | | 5/1988 | |
| JP | 186856 | U | | 6/1989 | |
| JP | 02191412 | | | 7/1990 | |
| JP | 345766 | | | 4/1991 | |
| JP | H0369459 | | * | 7/1991 | ..... A47F 1/125 |
| JP | H0369459 | U | | 7/1991 | |
| JP | 423463 | | | 1/1992 | |
| JP | 05277023 | | | 10/1993 | |
| JP | H0638735 | | | 5/1994 | |
| JP | 677614 | | | 11/1994 | |
| JP | 3005457 | | | 12/1994 | |
| JP | 07000260 | | | 1/1995 | |
| JP | H07241227 | | * | 9/1995 | ..... A47F 1/125 |
| JP | H07241227 | A | | 9/1995 | |
| JP | 9238787 | | | 9/1997 | |
| JP | 6397114 | | | 4/1998 | |
| JP | 10263710 | | | 10/1998 | |
| JP | 1118889 | | | 1/1999 | |
| JP | 11006284 | | | 1/1999 | |
| JP | H11155701 | A | | 6/1999 | |
| JP | 11313737 | | | 11/1999 | |
| JP | 11342054 | | | 12/1999 | |
| JP | H11342054 | | | 12/1999 | |
| JP | H11346879 | | | 12/1999 | |
| JP | 2000004996 | | | 1/2000 | |
| JP | 2000004997 | | | 1/2000 | |
| JP | 2000004998 | | | 1/2000 | |
| JP | 2000106988 | | | 4/2000 | |
| JP | 2000125998 | | | 5/2000 | |
| JP | 2000157378 | | | 6/2000 | |
| JP | 2000217675 | | | 8/2000 | |
| JP | 2000287790 | | | 10/2000 | |
| JP | 2000287791 | | | 10/2000 | |
| JP | 2000287795 | | | 10/2000 | |
| JP | 2000316680 | | | 11/2000 | |
| JP | 2000350642 | | | 12/2000 | |
| JP | 2001037600 | | | 2/2001 | |
| JP | 2001078860 | | | 3/2001 | |
| JP | 2001104117 | | | 4/2001 | |
| JP | 2001197978 | | | 7/2001 | |
| JP | 2001240225 | | | 9/2001 | |
| JP | 2003210286 | | | 7/2003 | |
| JP | 3099639 | U | | 11/2003 | |
| JP | 2004121631 | | | 4/2004 | |
| JP | 3115289 | Y | | 9/2005 | |
| JP | 2005270416 | | | 10/2005 | |
| JP | 2005270419 | | | 10/2005 | |
| JP | 3115812 | U | | 11/2005 | |
| JP | 3932534 | B2 | | 6/2007 | |
| JP | 2007307244 | A | | 11/2007 | |
| JP | 4708539 | B2 | | 6/2011 | |
| NL | 106617 | C | | 11/1963 | |
| NL | 1018330 | | | 5/2002 | |
| SE | 394537 | B | | 6/1977 | |
| SE | 7409996 | | | 6/1977 | |
| SE | 76532 | | | 12/2002 | |
| SE | 77224 | | | 12/2003 | |
| SU | 1600615 | | | 10/1990 | |
| WO | 9115141 | | | 10/1991 | |
| WO | 9201614 | | | 2/1992 | |
| WO | 9806305 | | | 2/1998 | |
| WO | 9925220 | | | 5/1999 | |
| WO | 0071004 | | | 11/2000 | |
| WO | 02091885 | | | 11/2002 | |

(56) References Cited

FOREIGN PATENT DOCUMENTS

| | | |
|---|---|---|
| WO | 03005862 | 1/2003 |
| WO | 03013316 | 2/2003 |
| WO | 2004021843 | 3/2004 |
| WO | 2004064484 | 8/2004 |
| WO | 2004105556 | 12/2004 |
| WO | 2005037027 | 4/2005 |
| WO | 2005074564 | 8/2005 |
| WO | 2005074635 | 8/2005 |
| WO | 2006019947 | 2/2006 |
| WO | 2006027872 | 3/2006 |
| WO | 2006028246 | 3/2006 |
| WO | 2006094058 | 9/2006 |
| WO | 2007050527 | 5/2007 |
| WO | 2007073294 | 6/2007 |
| WO | 2007133086 | 11/2007 |
| WO | 2008115769 | 9/2008 |
| WO | 2008153561 | 12/2008 |
| WO | 2011002909 | 1/2011 |
| WO | 2011112539 | 9/2011 |
| WO | 2012030788 | 3/2012 |
| WO | 2013033545 | 3/2013 |
| WO | 2013033555 | 3/2013 |
| WO | 2014198839 | 12/2014 |
| WO | 2016124760 | 8/2016 |

OTHER PUBLICATIONS

Hardy, Stephen N., Abandoned U.S. Appl. No. 08/968,599, "Universal Shelf Mounting Bracket," filed Nov. 13, 1997, 17 pp.

Henry, et al., Eric, Abandoned U.S. Appl. No. 09/075,647, "Merchandise Display System," filed May 11, 1998, 41 pp.

Johnson et al., Allen E., U.S. Appl. No. 60/329,656, "Merchandising System," filed Oct. 15, 2001, 19 pp.

Johnson et al., Allen E., U.S. Appl. No. 60/335,924, "Merchandising System," filed Oct. 31, 2001, 32 pp.

Johnson, et al., Allen E., U.S. Appl. No. 60/286,892, "Divider System for Shelf or the Like," filed Apr. 26, 2001, 45 pp.

Johnson, et al., Allen E., U.S. Appl. No. 60/313,894, "Shelf Divider System," filed Aug. 21, 2001, 12 pp.

Kologe, Joseph F., Abandoned U.S. Appl. No. 11/741,317, "Display Bar Assembly for Merchandising Displays," filed Apr. 30, 2007, 26 pp.

Richter et al., Gary M., U.S. Appl. No. 60/489,676, "Merchandising System," filed Jul. 23, 2003, 17 pp.

*RTC Industries, Inc.* v. *Display Specialties, Inc.*, Case No. 04C3370, Complaint, May 12, 2004.

*RTC Industries, Inc.* v. *Display Specialties, Inc.*, Case No. 04C3370, Defendant Display Specialties, Inc.\s Answer, Affirmative Defenses, and Counterclaim to Complaint, Jun. 9, 2004.

*RTC Industries, Inc.* v. *Display Specialties, Inc.*, Case No. 04C3370, Reply to Counterclaim, Jul. 2, 2004.

*RTC Industries, Inc.* v. *Display Specialties, Inc.*, Civil Docket for Case No. 1:04-CV-03370.

*RTC Industries, Inc.* v. *Fasteners for Retail, Inc. et al.*, Case No. 05C6940, Answer of Defendant Fasteners for Retail, Inc., Jan. 18, 2006.

*RTC Industries, Inc.* v. *Fasteners for Retail, Inc. et al.*, Case No. 05C6940, Complaint, Dec. 8, 2005.

*RTC Industries, Inc.* v. *Fasteners for Retail, Inc. et al.*, Case No. 05C6940, Minute Order, Apr. 25, 2006.

*RTC Industries, Inc.* v. *Fasteners for Retail, Inc. et al.*, Case No. 05C6940, Stipulation of Dismissal (undated).

*RTC Industries, Inc.* v. *Fasteners for Retail, Inc. et al.*, Civil Docket for Case 1:05-CV-06940.

*RTC Industries, Inc.* v. *Fasteners for Retail, Inc.*, Case No. 03C3137, Amended Complaint, Aug. 6, 2003.

*RTC Industries, Inc.* v. *Fasteners for Retail, Inc.*, Case No. 03C3137, Defendants \ Answer to Plaintiff\s Amended Complaint and Counterclaim of Defendant FFR, Aug. 29, 2003.

*RTC Industries, Inc.* v. *Fasteners for Retail, Inc.*, Case No. 03C3137, Defendants\ Opposition to Plaintiff\s Motion to Modify and Temporarily Quash Five Subpoenas for Violation of Federal Rule of Civil Procedure 45, Dec. 10, 2003.

*RTC Industries, Inc.* v. *Fasteners for Retail, Inc.*, Case No. 03C3137, Minute Order, Dec. 12, 2003.

*RTC Industries, Inc.* v. *Fasteners for Retail, Inc.*, Case No. 03C3137, Notice of Motion and Memo in Support to Modify and Temporarily Quash Five Subpoenas for Violation of Federal Rule of Civil Procedure 45, Dec. 8, 2003.

*RTC Industries, Inc.* v. *Fasteners for Retail, Inc.*, Case No. 03C3137, Plaintiff RTC Industries, Inc.\s Complaint, May 12, 2003.

*RTC Industries, Inc.* v. *Fasteners for Retail, Inc.*, Case No. 03C3137, Reply, Sep. 17, 2003.

*RTC Industries, Inc.* v. *Fasteners for Retail, Inc.*, Case No. 03C3137, Responses to Plaintiff\s First Set of Interrogatories to Defendant Fasteners for Retail, Inc. (Nos. 1-15), Oct. 3, 2003.

*RTC Industries, Inc.* v. *Fasteners for Retail, Inc.*, Case No. 03C3137, RTC Industries\ Reply to Defendants\ Opposition to RTC\s Motion to Modify and Temporarily Quash Five Subpoenas for Violation of Federal Rule of Civil Procedure 45, Dec. 11, 2003.

*RTC Industries, Inc.* v. *Fasteners for Retail, Inc.*, Case No. 03C3137, Subpoena Issued to Rexam Beauty and Closures, Inc., Nov. 11, 2003.

*RTC Industries, Inc.* v. *Fasteners for Retail, Inc.*, Case No. 03C3137, Subpoena Issued to Rexam Cosmetic Packaging, Inc., Nov. 11, 2003.

*RTC Industries, Inc.* v. *Fasteners for Retail, Inc.*, Case No. 03C3137, Subpoena Issued to Vulcan Spring & Mfg. Co., Oct. 28, 2003.

*RTC Industries, Inc.* v. *Fasteners for Retail, Inc.*, Civil Docket for Case No. 1:03-CV-03137.

*RTC Industries, Inc.* v. *Henschel-Steinau, Inc.*, Case No. 10C7460, Complaint, Nov. 19, 2010.

*RTC Industries, Inc.* v. *HMG Worldwide Corp.*, Case No. 00C3300, Amended Complaint, Jan. 19, 2001.

*RTC Industries, Inc.* v. *HMG Worldwide Corp.*, Case No. 00C3300, Complaint, May 31, 2000.

*RTC Industries, Inc.* v. *HMG Worldwide Corp.*, Case No. 00C3300, HMG Worldwide Corporation\s Amended Answer and Counterclaims, Sep. 6, 2000.

*RTC Industries, Inc.* v. *HMG Worldwide Corp.*, Case No. 00C3300, Notice of Filing, HMG Worldwide Corporation\s Answer and Counterclaim, Jun. 26, 2000.

*RTC Industries, Inc.* v. *HMG Worldwide Corp.*, Case No. 00C3300, Notice of Motion and Defendant-Counterclaimant HMG Worldwide Corporation\s Motion for Leave to File Instanter Answer to Plaintiff\s Amended Complaint and HMG Worldwide Corporation\s Amended Answer and Counterclaims, Feb. 21, 2001.

*RTC Industries, Inc.* v. *HMG Worldwide Corp.*, Case No. 00C3300, RTC\s Reply to HMG Worldwide Corporation\s Amended Counterclaims, Oct. 10, 2000.

*RTC Industries, Inc.* v. *HMG Worldwide Corp.*, Case No. 00C3300, RTC\s Reply to HMG Worldwide Corporation\s Amended Counterclaims, Mar. 7, 2001.

*RTC Industries, Inc.* v. *HMG Worldwide Corp.*, Civil Docket for Case No. 1:00-CV-03300.

*RTC Industries, Inc.* v. *Semasys, Inc. and Uni-Sun, Inc.*, Case No. 04C4081, Complaint.

*RTC Industries, Inc.* v. *Semasys, Inc. and Uni-Sun, Inc.*, Case No. 04C4081, Original Answer, Affirmative Defenses and Counterclaims of Semasys, Inc. and Uni-Sun, Inc., Aug. 3, 2004.

*RTC Industries, Inc.* v. *Semasys, Inc. and Uni-Sun, Inc.*, Case No. 04C4081, Reply to Counterclaim, Aug. 23, 2004.

*RTC Industries, Inc.* v. *Semasys, Inc. and Uni-Sun, Inc.*, Civil Docket for Case 1:04-CV-04081.

*RTC Industries, Inc.* v. *William Merit & Associates, Inc.*, Case No. 04C1254, Complaint, Feb. 18, 2004.

*RTC Industries, Inc.* v. *William Merit & Associates, Inc.*, Case No. 04C1254, Declaration of William Merit in Support of Defendant\s Motion for Partial Summary Judgment That Claims 1-8 of U.S. Pat. No. 4,830,201 Are Not Infringed, Apr. 29, 2004.

*RTC Industries, Inc.* v. *William Merit & Associates, Inc.*, Case No. 04C1254, Defendant\s Notice of Motion and Motion for Leave to

(56) References Cited

OTHER PUBLICATIONS

File Memorandum in Support of Motion for Partial Summary Judgment in Excess of Page Limit, Apr. 29, 2004.
*RTC Industries, Inc.* v. *William Merit & Associates, Inc.*, Case No. 04C1254, Defendant\s Notice of Motion for Partial Summary Judgment of Non-Infringement That Claims 1-8 of U.S. Pat. No. 4,830,201 Are Not Infringed, Apr. 29, 2004.
*RTC Industries, Inc.* v. *William Merit & Associates, Inc.*, Case No. 04C1254, Evidentiary Objections to RTC Industries, Inc.\s Memorandum in Opposition to William Merit & Associates\ Motion for Partial Summary Judgment, Jul. 2, 2004.
*RTC Industries, Inc.* v. *William Merit & Associates, Inc.*, Case No. 04C1254, Exhibits and Declarations in Support of William Merit & Associates Inc.\s Reply to RTC Industries, Inc.\s Memorandum in Opposition to William Merit & Associates\ Motion for Partial Summary Judgment, Jul. 2, 2004.
*RTC Industries, Inc.* v. *William Merit & Associates, Inc.*, Case No. 04C1254, Index of Exhibits, Jun. 18, 2004.
*RTC Industries, Inc.* v. *William Merit & Associates, Inc.*, Case No. 04C1254, Memorandum Opinion, Jul. 15, 2004.
*RTC Industries, Inc.* v. *William Merit & Associates, Inc.*, Case No. 04C1254, Notice of Filing of Additional Exhibit (The Chesley Patent) to RTC Industries, Inc.\s Memorandum in Opposition to William Merit & Associates\ Motion for Partial Summary Judgment, Jun. 22, 2004.
*RTC Industries, Inc.* v. *William Merit & Associates, Inc.*, Case No. 04C1254, RTC Industries, Inc.\s Memorandum in Opposition to William Merit & Associates\ Motion for Partial Summary Judgment, Jun. 18, 2004.
*RTC Industries, Inc.* v. *William Merit & Associates, Inc.*, Case No. 04C1254, RTC Industries, Inc.\s Response to William Merit & Associates Statement Under Local Rule 56.1 of Material Facts to Which There Is No Genuine Issue and Statement of Additional Facts That Require the Denial of Summary Judgment, Jun. 18, 2004.
*RTC Industries, Inc.* v. *William Merit & Associates, Inc.*, Case No. 04C1254, RTC Industries, Inc.\s Responses to Defendant William Merit & Associates, Inc.\s First Set of Requests for Admission to Plaintiff RTC Industries, Inc., Jun. 1, 2004.
*RTC Industries, Inc.* v. *William Merit & Associates, Inc.*, Case No. 04C1254, RTC Industries, Inc.\s Sur-Reply to William Merit\s Motion for Partial Summary Judgment, Jul. 6, 2004.
*RTC Industries, Inc.* v. *William Merit & Associates, Inc.*, Case No. 04C1254, RTC\s Response to Defendant\s Evidentiary Objections to RTC Industries, Inc.\s Memorandum in Opposition to William Merit & Associates\ Motion for Partial Summary Judgment, Jul. 6, 2004.
*RTC Industries, Inc.* v. *William Merit & Associates, Inc.*, Case No. 04C1254, William Merit & Associates Inc.\s Reply to RTC Industries, Inc.\s Memorandum in Opposition to William Merit & Associates\ Motion for Partial Summary Judgment, Jul. 2, 2004.
*RTC Industries, Inc.* v. *William Merit & Associates, Inc.*, Case No. 04C1254, William Merit & Associates, Inc.\s Answer, Apr. 14, 2004.
*RTC Industries, Inc.* v. *William Merit & Associates, Inc.*, Case No. 04C1254, William Merit & Associates, Inc.\s Statement Under Local Rule 56.1 of Material Facts to Which There is No Genuine Issue, Apr. 29, 2004.
*RTC Industries, Inc.* v. *William Merit & Associates, Inc.*, Case No. 04C1254, William Merit & Associates\ Reply to RTC Industries, Inc.\s Response to William Merit & Associates\ Statement Under Local Rule 56.1 of Material Facts to Which There is No Genuine Issue and Statement of Additional Facts That Require the Denial of Summary Judgment, Jul. 2, 2004.
*RTC Industries, Inc.* v. *William Merit & Associates, Inc.*, Civil Docket for Case No. 1:04-CV-01254.
Rushing, Tom, Abandoned U.S. Appl. No. 08/017,280, "Display Apparatus," filed Feb. 12, 1993, 37 pp.
U.S. Patent and Trademark Office, Final Office Action Issued in U.S. Appl. No. 13/625,333, dated Dec. 19, 2013, 21 pp.
U.S. Patent and Trademark Office, Non-Final Office Action Issued in U.S. Appl. No. 14/189,350, dated Jul. 16, 2014, 14 pp.
*Vidpro International, Inc.* v. *RTC Industries, Inc.*, Case No. 95CV1055-G, Original Complaint, Jun. 2, 1995.
*Vidpro International, Inc.* v. *RTC Industries, Inc.*, Civil Docket for Case No. 3:95-CV-01055-G.
European Patent Office, Supplementary European Search Report Issued in International Application No. EP 14 86 8440 (Corresponding to PCT/US2014/068194), dated Oct. 5, 2017, 12 pp.
Patent Cooperation Treaty, International Searching Authority, Notification of Transmittal of the International Search Report and the Written Opinion of the International Searching Authority, or the Declaration, Issued in International Application No. PCT/US2014/068194, dated Apr. 29, 2015, 12 pp.
Republic of Colombia Superintendence of Industry and Commerce, Colombian Examiner's Opinion Issued in Colombian Counterpart Patent Application No. 16-175.141, 10 pp.
European Patent Office, Supplementary European Search Report Issued in International Application No. EP 14 86 8440 (Corresponding to PCT/US2014/068194), dated Jun. 26, 2017, 13 pp.

* cited by examiner

UNIVERSAL MERCHANDISER AND METHODS RELATING TO SAME

CROSS-REFERENCE TO RELATED APPLICATIONS

This application is a continuation-in-part of U.S. Design application Ser. No. 29/510,619, filed Dec. 1, 2014, which claims the benefit of U.S. Provisional Application No. 61/910,941, filed Dec. 2, 2013, which are hereby incorporated herein by reference in their entirety.

TECHNICAL FIELD

This invention relates generally to merchandise display structures, and more specifically to customizable display structures capable of universally fitting and automatically facing desired products and methods relating to same.

BACKGROUND

Shelving systems have been used for decades to organize shelves and the presentation of products on shelves. For example, U.S. Pat. No. 2,516,122 issued to Hughes on Jul. 25, 1950, U.S. Pat. No. 2,688,409 issued to Echlin on Sep. 7, 1954, U.S. Pat. No. 2,884,139 issued to Dunham on Apr. 28, 1959, U.S. Pat. No. 3,285,429 issued to Propst on Nov. 15, 1966, U.S. Pat. No. 3,339,746 issued to McCabe on Sep. 5, 1967, U.S. Pat. No. 3,780,876 issued to Elkins on Dec. 25, 1973, U.S. Pat. No. 3,868,021 issued to Heinrich on Feb. 25, 1975, and U.S. Pat. No. 4,615,276 issued to Garabedian on Oct. 7, 1986 all disclose shelving systems that use dividers that are laterally moveable about front and/or rear rails associated with the shelves to neatly present items on the shelves in an organized manner and in such a way as to maximize the use of available shelving space.

In addition to the problems of neatly displaying items on shelving and organizing items in a way to maximize the use of available shelving space, retailers were also faced with the problem of keeping product at the front of shelves to maintain neat appearance, give off the impression of a well-stocked store and to ensure older product is sold before newer product. Many gravity feed systems were devised to solve this problem, such as U.S. Pat. No. 2,769,551 issued to Just on Nov. 6, 1956. Additional push and/or pull systems were then devised to accommodate shelving systems or product where gravity feed systems were not an option or at least did not work as well as desired. U.S. Pat. No. 3,008,583 issued to Lindell on Nov. 14, 1961, U.S. Pat. No. 3,161,295 issued to Chesley on Dec. 15, 1964, Japanese Patent No. JPS56-33414 issued Nov. 27, 1979 and Japanese Patent No. JPS63-61007 issued Dec. 8, 1984 disclose examples of such systems which automatically advance stored product toward the front of the shelving unit as items are removed from the shelf. These automatic advancement merchandisers are typically referred to as "front-facing", "auto-facing" or "self-facing" merchandisers and are desired because they greatly reduce the amount of time retailers or suppliers to retailers have to spend straightening or organizing their shelves to achieve the objectives discussed above (e.g., neatly presenting product in an organized manner, maximizing use of available shelving space, keeping product at the front of shelves to give the impression of a well-stocked store, to ensure older product is sold before newer product, etc.).

One problem associated with such front-facing merchandisers, however, is that they require advance knowledge of the product size before positioning the system on a shelf in order to maximize the use of available shelving space or the retailer has to be willing to give-up some shelf space by using a merchandiser that is not sized for the specific product or good being displayed. For example, in the 1950s, 1960s and 1970s, many of the products displayed via such merchandising systems were cigarette boxes and cartons of cigarette boxes which did not all come in the same size or shape. Thus, if a generic merchandiser was used that would fit all products, there would certainly be wasted space due to some packages being smaller than others. In order to solve this problem, systems were devised that would accommodate for products of varying size, and allow the merchandiser or merchandising system to be adjusted to varying product sizes so as to accommodate product of different size and shape and maximize the available shelving space (also known as maximizing "pack-out" or "packout"). U.S. Pat. No. 3,308,961 issued to Chesley on Mar. 14, 1967, Swiss Patent No. CH412251 issued to Gemperle/ETH Zurich on Apr. 1, 1968 and U.S. Pat. No. 3,452,899 issued to Libberton on Jul. 1, 1969 all disclose merchandisers that adjust to fit the specific size of the product being displayed and, thereby allowing retailers to maximize use of available shelving space or pack-out.

Over the years, a variety of different front-facing merchandisers that account for product size have been provided. Some comprise self-contained systems that simply rest on top of shelving like U.S. Pat. No. 4,730,741 issued to Jackle on Mar. 15, 1988, U.S. Pat. No. 5,110,192 issued to Lauterbach on May 5, 1992, U.S. Pat. No. 5,673,801 issued to Markson on Oct. 7, 1997 and Japanese Patent Application Publication No. JPH11-155701 published to Kawajun on Jun. 15, 1999. Other front-facing merchandisers utilize the front and/or rear rail systems discussed above such as British Patent No. GB2027339 issued to Corjon on Feb. 20, 1980, French Published Patent Application No. FR2667229 published to Corjon on Apr. 3, 1992, U.S. Pat. No. 5,390,802 issued to Pappagallo on Feb. 21, 1995, International Patent Application No. WO95/13003 published to PPE Ltd. on May 18, 1995, European Patent Application Publication No. EP0956794 published to HMG Worldwide on Nov. 17, 1999, Japanese Published Patent Application No. JPH11-342054 published to Kawajun on Dec. 14, 1999, Japanese Published Patent Application No. JPH11-346879 published to Kawajun on Dec. 21, 1999, Japanese Published Patent Application No. JP2000-004996 published to Kawajun on Jan. 11, 2000. Many of the latter references further improve the merchandisers by reducing the number of merchandiser components and making more of the system parts out of plastic, such as by integrating the pusher track and divider and making the combined divider and track structure, the corresponding pushers, and front and rear rails out of plastic. These merchandisers not only allow for quick and easy adjustment to the specific size of the product being displayed in order to maximize usage of available shelving space, but also allow for easy adjustment to accommodate changes in displayed product size, the addition of new product and/or the reorganization of a shelf or product category on the shelf (typically referred to as "cut-ins" and "resets") without requiring removal of product inventory.

In addition, several systems have been designed with features to improve the performance of such front-facing merchandisers. For example, systems have been designed with pusher locks for locking the pusher in a rear stocking or re-stocking position such as U.S. Pat. No. 3,161,295 issued to Chesley on Dec. 15, 1964, U.S. Pat. No. 4,730,741 issued to Jackle on Mar. 15, 1988, U.S. Pat. No. 5,634,564 issued to Spamer on Jun. 3, 1997, U.S. Pat. No. 5,673,801 issued to Markson on Oct. 7, 1997 and British Patent GB2392667 issued to Gamble on Mar. 10, 2004. In some systems, pushers have been designed with dampers to slow the progression of the pusher as product is removed from the merchandiser so that the pusher does not exert too much force against the displayed product (which could damage the product and/or force it out of the merchandiser unintentionally). Such systems are disclosed in Japanese Published Patent Application No. JPH06-38735 published to Sunco Spring on May 24, 1994 and British Published Patent Application No. GB2392667 published to Gamble on Mar. 10, 2004. Other improvements include systems having pushers that can be adjusted in width (e.g., such as by having pivoting members to widen the reach of a pusher) or adjusted in height (e.g., such as by attaching a pusher attachment that extends the upper bounds of the pusher). Such systems are disclosed in U.S. Pat. No. 5,390,802 issued to Pappagallo on Feb. 21, 1995, U.S. Pat. No. 5,634,564 issued to Spamer on Jun. 3, 1997, Japanese Published Patent Application No. JPH11-342054 published to Kawajun on Dec. 14, 1999 and U.S. Pat. No. 6,142,317 issued to Merl on Nov. 7, 2000. Some systems also provide for adjusting the height of the system to accommodate taller types of product or stacked product such as U.S. Pat. No. 4,901,869 issued to Hawkinson on Feb. 20, 1990 and U.S. Pat. No. 6,598,754 issued to Weller on Jul. 29, 2003.

Even with all of these improvements, there are still other areas in which merchandisers can be improved, such as by further reducing the number of merchandiser components and further simplifying and/or perfecting the operation of the merchandiser including some of the very areas of operation discussed above. Accordingly, it has been determined that a need exists for an improved front-facing merchandiser and components for same which overcome the aforementioned limitations and which further provide capabilities, features and functions not available in current merchandisers and for improved methods relating to same.

BRIEF DESCRIPTION OF THE DRAWINGS

The above needs are at least partially met through provision of the universal merchandiser described in the following detailed description, particularly when studied in conjunction with the drawings, wherein:

FIGS. 25A-B are partially exploded and perspective views of an alternate mounting bar and support bar configuration in accordance with aspects of the invention in which FIG. 25A illustrates an alternate cammed fastener exploded from the support bracket and FIG. 25B illustrates the cammed fastener inserted into the support bracket and pivoted or turned in order to secure the support arm to the mounting bar without risking puncture of the mounting bar or other damage to same;

Figure 1A:
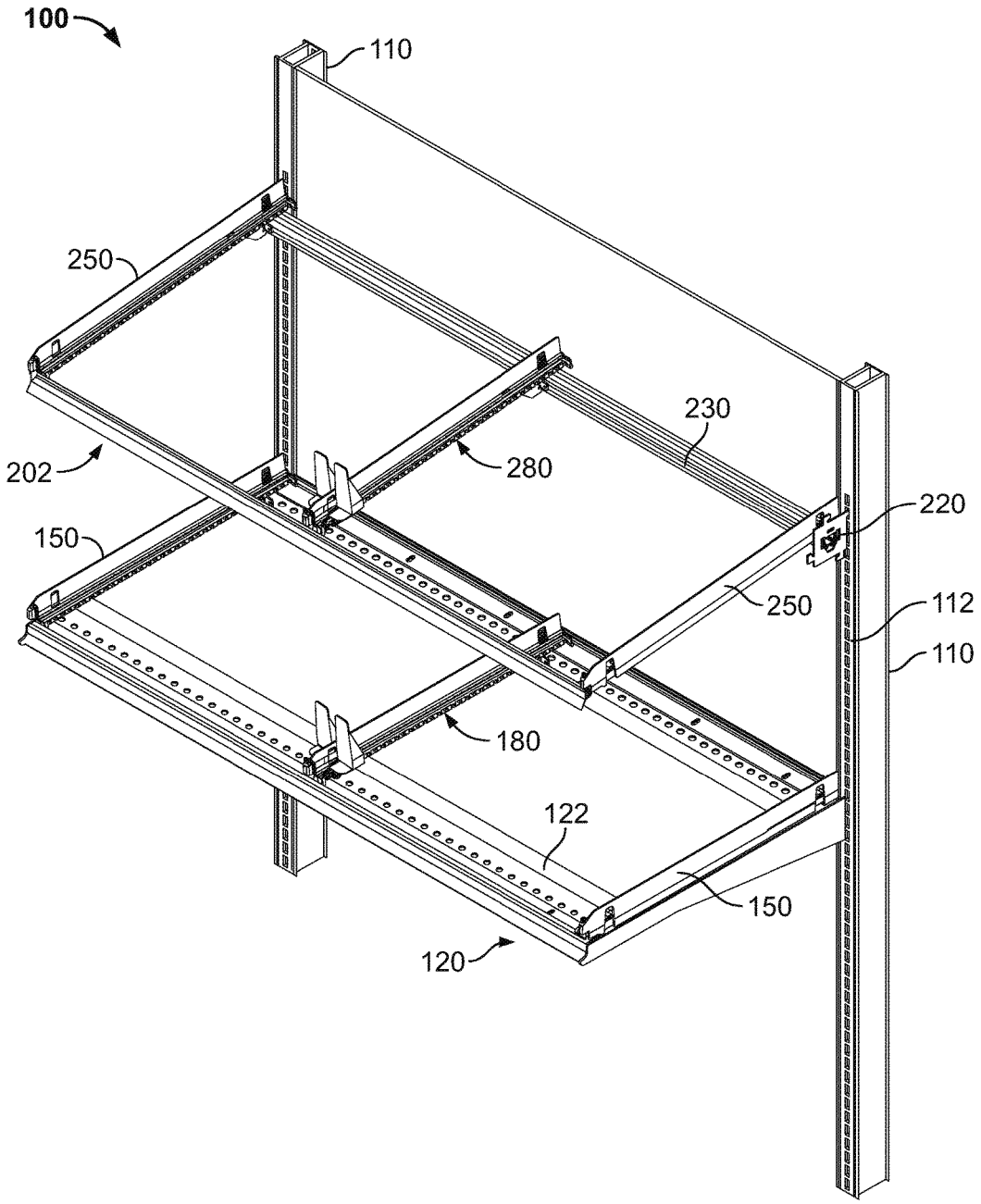
FIGS. 1A-C are perspective, left side elevation and front elevation views, respectively, of a universal merchandiser as configured in accordance with various embodiments of the invention, with the universal merchandiser being illustrated with both a fixed shelf unit and a bar support unit or suspended bar version.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a product display is herein presented. The product display includes a pair of upstanding vertical supports, at least one product support structure having a plurality of protrusions extending laterally therefrom that is connected to the upstanding vertical supports, a friction-reducing component that couples to the protrusions of the product support structure, and a stopping mechanism coupled to a distal end of the product support structure.

In some embodiments, the product support structure further includes a biasing member coupled to the friction-reducing component configured to urge the product to an end of the product support structure. In one form, the biasing member is a pusher or slider assembly having a face, bottom surface, and an attachment portion, and is configured to allow the friction-reducing component to nest within the slider attachment portion.

In some embodiments, the friction reducing component comprises a plurality of cylindrical rollers having an inner through bore and are coupled to the protrusions of the product support structure on a single side of the roller. In other embodiments, the friction reducing component comprises an elongated flat slide bar or belt member having a plurality of holes configured to mate with the plurality of protrusions extending from the product support structure. In still other forms, a combination of rollers and slide bar or belt members may be used (e.g., having a roller portion and bar portion, alternating from roller to bar to roller or vice versa, etc.).

In some embodiments, the product display further includes an information display device pivotally mated to the product support structure so that it may be rotated to display a first set of information on a front side, and a second set of information on a rear side. For example, the information display device may be a pivotal or rotatable price channel that allows for a product price to be displayed in a first position and a SKU number or bar code to be accessed or displayed in a second position.

In some embodiments, the product support structure mates with a horizontal shelf and is configured to be placed at any distance between the pair of upstanding vertical supports. For example, in a preferred form, the upstanding vertical supports are laterally movable about a plurality of positions. In other forms, the support structures are suspended from a bar without a shelf present.

In some embodiments, the product support structure extends from the upstanding vertical support at an angle less than about 90 degrees. For example, in some forms, the support structure is angled so that gravitational forces assist the product in moving towards a protruding or distal end of the product support structure. In other forms, a rotatable bracket is used to allow the product support structures to be positioned at a plurality of angles with respect to the bar and/or the vertical support structure or gondola to which they are mounted.

In some examples, a product display apparatus is provided that includes a product divider assembly having a front portion, a rear portion, and a divider, a pusher operatively coupled to the product divider assembly to assist in moving displayed products from the rear portion of the product divider assembly to the front portion thereof, and an integral forward structure and pusher locking release mechanism coupled to the front portion of the product divider assembly. The pusher is configured to be engageable with the rear portion of the product divider assembly such that the pusher is retained at the rear portion thereof. The integral forward structure and pusher locking release mechanism is configured to be actuated by effecting a force on a portion thereof to disengage the pusher from the rear portion of the product divider assembly.

In some forms, the integral forward structure and pusher locking mechanism may comprise a front rail which is configured to couple to and support at least a portion of the front portion of the product divider assembly. In other forms, the integral forward structure and pusher locking release mechanism may include an information channel (e.g., a price channel) which displays information relating to the displayed product. This information channel is configured to at least partially support at least a portion of the front portion of the product divider assembly. It is understood that in some of these forms, the product display apparatus may include an integral forward structure and pusher locking release mechanism includes both a front rail and an information channel.

In alternate approaches, a product display apparatus may include a product divider assembly having front and rear portions and a divider to divide a number of displayed products into rows, a pusher having an axis and being operatively coupled to the product divider assembly, and a damper attachment having an axis and being configured to be coupled to the pusher to dampen movement of the pusher. This damper attachment is coupled to a rear portion of the pusher such that the damper attachment axis is collinear with the pusher axis. So configured, the amount of torque generated by the pusher during movement from the rear portion of the product divider assembly to the front portion of the product divider assembly is limited. In some forms, this damper attachment may be removable from the pusher using any number of conventionally known methods. In other forms, the damper attachment may be an integral component of the pusher.

In some embodiments, a product display apparatus may include a product divider assembly having front and rear portions, a divider, and an integrally formed track assembly, a pusher being operatively coupled to the integrally formed track assembly, and at least one of a damper attachment coupled to a rear portion of the pusher and a pusher locking release mechanism configured to be actuated by effecting a force on a portion of the product divider assembly to disengage the pusher from the rear portion of the product divider assembly. This pusher locking release mechanism may be coupled to the front portion of the divider assembly. It will be understood that in some forms, the damper attachment and the pusher locking release mechanism may be provided.

In still other examples, a product display apparatus is provided having a product divider assembly, at least one attachment coupled to the product divider assembly and defining a recess, and a pusher operatively coupled to the product divider assembly. This pusher is configured to be at least partially operably disposed in the recess defined by the at least one attachment.

In some approaches, a dual engagement product display apparatus includes a rail having a length extending between a portion of a product display and a product divider assembly being operably coupled to the rail to divide a plurality of displayed products into rows. The product divider assembly is configured to be movable between a first position in which the product divider is coupled to the rail while still allowing for lateral movement along the length of the rail and a second position where the assembly is frictionally coupled to the rail to hinder lateral movement along the length of the rail. The rail may be a front rail being coupled to the front portion of the product divider assembly and/or a rear rail being coupled to the rear portion of the product divider assembly.

The product divider assembly may include a clearance for allowing a stabilizing device to be disengaged such that the product display apparatus may be laterally movable when the product display is in the first position. This clearance may allow the product divider assembly to be engaged with the stabilizing device such that lateral movement of the product display apparatus is hindered when in the second position. In alternate approaches, the product divider assembly may include an angled opening to allow the product divider assembly to be moved between a first position where the product divider assembly does not engage a stabilizing device so as to allow lateral movement of the product divider assembly and a second position where the angled opening engages the stabilizing device to limit lateral movement of the product divider assembly.

In some embodiments, a product display apparatus may include a product divider assembly having a damper rack, a pusher being operatively coupled to the product divider assembly, and a compound gear having a first gear portion and a second gear portion. The first gear portion includes gear teeth configured to engage the damper rack, and the second gear portion is configured to engage a locking device for locking the pusher at the rear portion of the product divider assembly. In some forms, this locking device is a pawl which engages the second gear portion of the compound gear.

In still other embodiments, a dual engagement product display apparatus may include a stabilizer having a length extending between a at least a portion of a product display and a product diver assembly. Upon moving one of the stabilizer or the product divider assembly in a first direction, a clearance between the stabilizer and the product divider assembly is created that allows for lateral movement of the product divider assembly with respect to the stabilizer. Upon moving one of the stabilizer or the product divider assembly in a second direction, lateral movement of the product divider assembly with respect to the stabilizer is hindered.

In some of these embodiments, the stabilizer comprises a combed or toothed structure disposed near the rear portion of the product divider assembly. It is understood that the stabilizer may alternatively be disposed near the front portion of the product divider assembly.

In addition to the above approaches, a method of displaying a product is provided. A product divider assembly is provided and a pusher having an axis is operably coupled to the divider assembly. A damper having an axis is then coupled to the pusher such that movement of the pusher from the rear to the front portion of the product divider assembly is dampened. This damper attachment is coupled to a rear portion of the pusher such that the axis of the damper attachment is in line with the axis of the pusher so as to limit the amount of torque generated by the pusher during movement of the pusher.

Figure 1C:
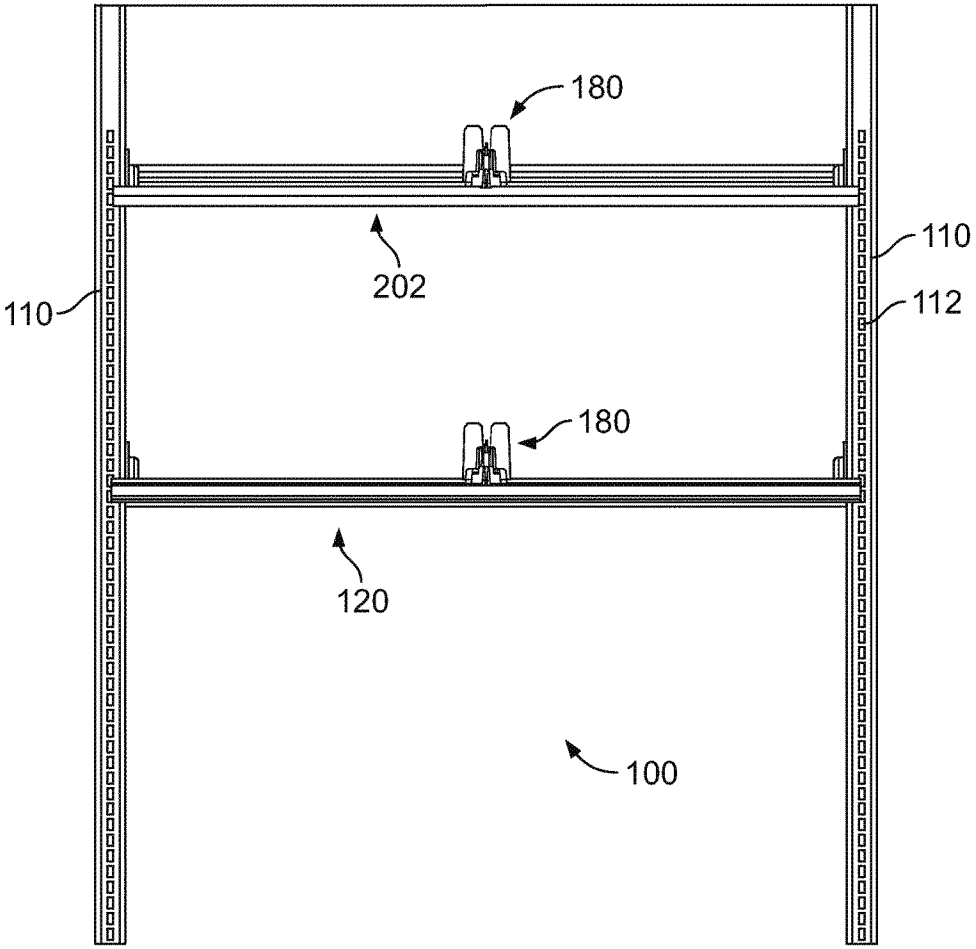
Figure 1B:
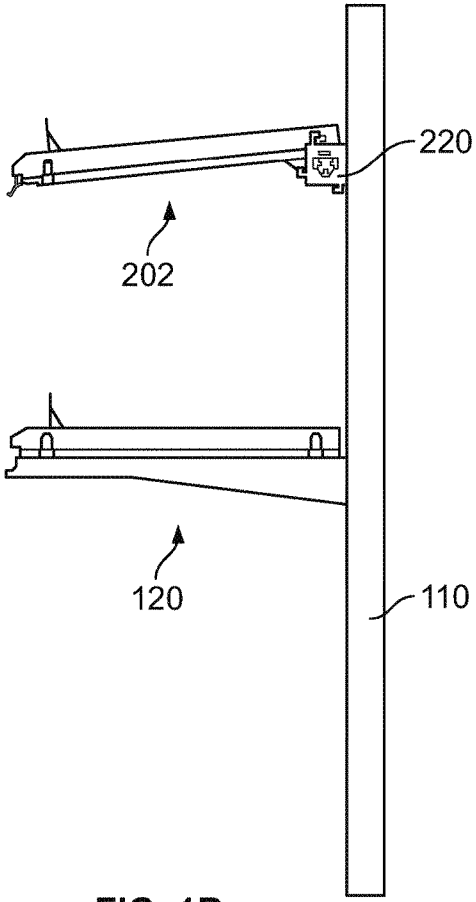

These and other benefits may become clearer upon making a thorough review and study of the following detailed description. Referring now to the drawings, and in particular to FIGS. 1A-C, an illustrative example of an upright merchandiser 100 that is compatible with many of these teachings can include a vertical support structure 110, fixed shelf display 120, shelf 122, bar display 202, end brackets 150, 250, rotatable bracket 220, bar 230, and interstitial supports, such as arm support members or dividers 180, 280. Together the arm support members 180, 280 and corresponding end brackets 150, 250 serve as product support members. More of these structures may be added to provide multiple rows or columns of product as desired in a particular display. In some embodiments, the fixed shelf 122, end brackets 150, and arm support member 180 mount to the vertical support structures 110 and extend outwardly therefrom to form the shelf display 120. In other embodiments, the vertical support structures 110, end brackets 250, rotatable bracket 220, bar 230, and arm support member 280 are mated together to form the bar display 202.

The vertical support structures 110 are of the conventional nature and include elongated slots 112 for mounting a number of display devices. The elongated slots 112 are spaced 1 inch (1") apart along the vertical support structures 110, allowing a merchandiser to choose a variety of display mount heights. These vertical support structures 110 are well known to those having skill in the art, and for the sake of brevity and the preservation of focus, will not be discussed further.

Figure 2:
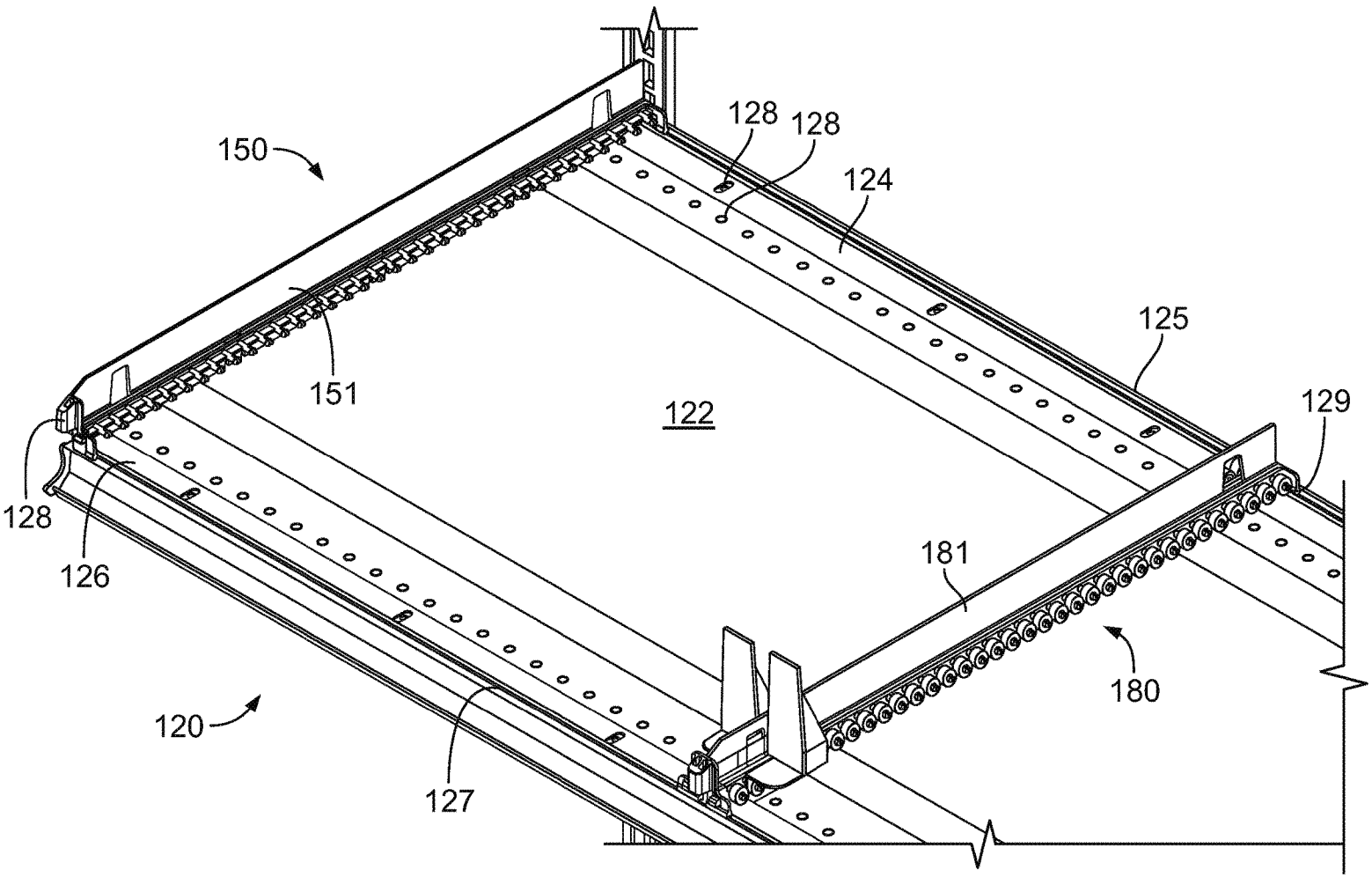
FIG. 2 comprises a perspective view of a portion of the fixed shelf unit of FIGS. 1A-C illustrating an end bracket and an interstitial bracket.
Figure 3A:
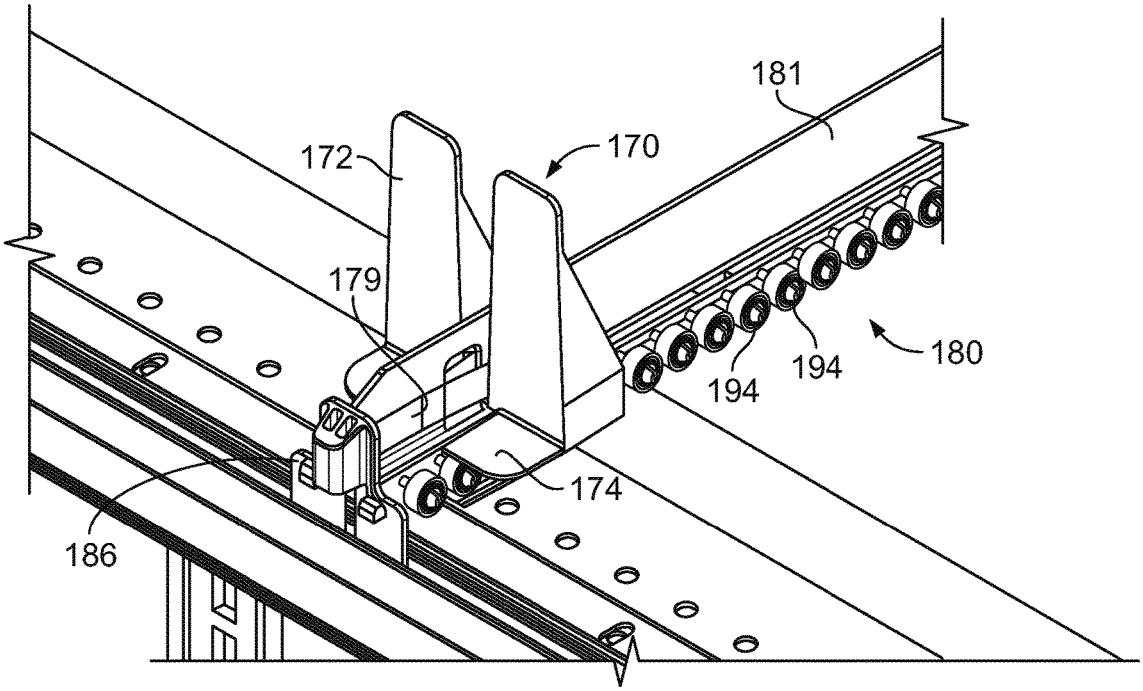
FIGS. 3A-B are enlarged perspective views of the front and rear, respectively, of the fully assembled interstitial bracket of FIG. 2.
Figure 3B:
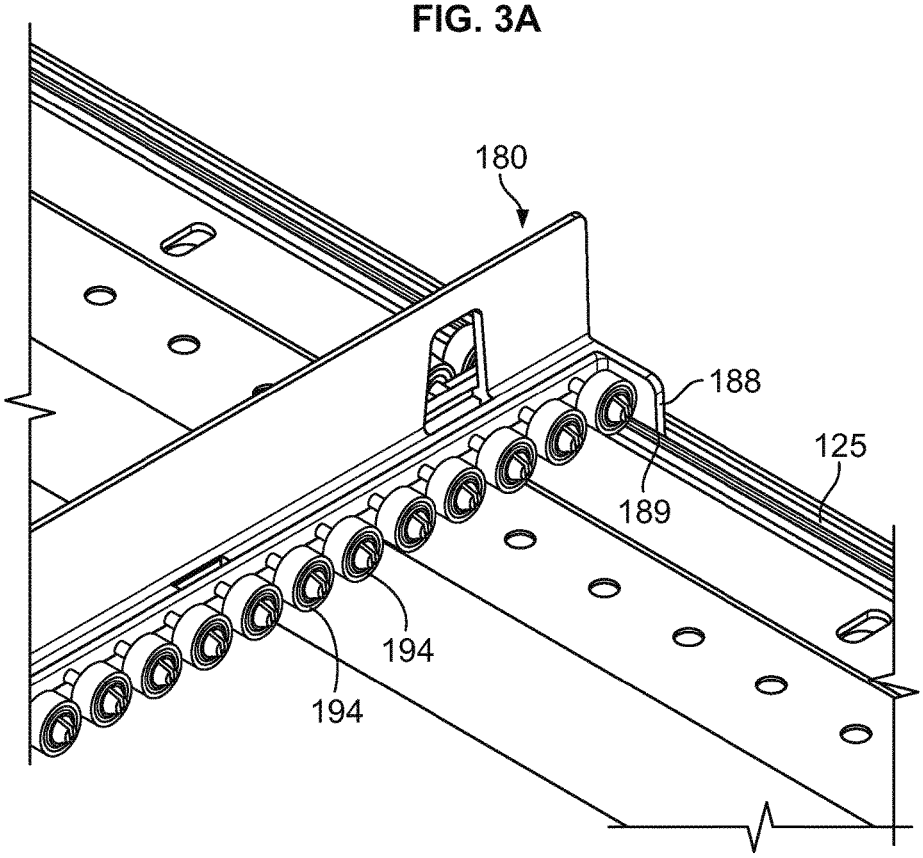

Referring now to FIGS. 2-3B, an example of a fixed shelf display 120 is provided. In some embodiments, the fixed shelf display 120 includes a shelf 122, a first shelf mount, such as rear shelf mount 124, a second shelf mount, such as front shelf mount 126, arm support member 180 having a support structure arm 181 extending upwardly, front mounting portion 186 and rear mounting portion 188, and end brackets 150 having front mounting portion 156 and rear mounting portion 158. In some embodiments, all of components of the end brackets 150 and arm support member 180 are constructed of extruded or injection molded polymers or similar materials to reduce costs as compared to conventional metal parts. It is understood that other methods of producing parts made of polymers or similar materials may be envisioned, for example thermoforming, blow molding, or the like. Additionally, in some embodiments, the components of the end brackets 150 and arm support member 180 are constructed of a combination of plastics and metals (e.g., plastic body with metal bushings or bearings, etc.).

In some embodiments, the shelf 122 mounts to the vertical support structures 110 through conventional methods. For example, both lateral ends of the shelf 122 may include elongated hooked-shaped tabbed members (not shown) which are configured to insert into the elongated slots 112 to securely mount the shelf display 120.

In some embodiments, the rear and front shelf mounts 124, 126 are configured to mate to the upper surface of the shelf 122. The shelf mounts 124, 126 may be configured to be secured to the shelf by a snap or friction fit. Alternatively, the shelf mounts 124, 126 may be secured to the shelf using screws, nuts and bolts, or other conventional fastening methods.

The shelf mounts 124, 126 include an elongated C-shaped channel 125, 127 that extends along the longitudinal length of the shelf mount which allows the corresponding front and rear mounting attachments 186, 188 of the arm 180 to mate or connect thereto. In the form illustrated, mounting attachments 186, 188 and channels 125, 127 are configured with a mating arrangement such as a tongue and groove arrangement, a dovetail or mortise and tenon arrangement, etc.). Specifically, in the form illustrated, the channel 125, 127 is C-shaped in cross-section and captures a rounded insert member of mounting attachments 186, 188. In some embodiments, the front mounting attachment 186 may be an integral part of the support structure arm 181 of the arm support member 180. In other embodiments, the front mounting attachment 186 may be coupled to the support structure arm 181 through various conventional connecting methods including snap or press fitting. Similarly, in some embodiments, the rear mounting portion 188 may be an integral part of the support structure arm 181, and in other embodiments, the rear mounting portion 188 may be coupled to the support structure arm 181 through various conventional connecting methods.

In some embodiments, the front and rear mounting portions 186, 188 include elongated circular tabbed portions 187, 189 which are either snap-fitted into the elongated channels 125, 127 or slid in through opening either in the upper surfaces or sides of the channels 125, 127, thus allowing the arm support member 180 to slide laterally across the shelf 122. This configuration allows the retailer to select any number of positions for the support arm 180, thus enabling the shelf display 120 to easily display products having a wide variety of widths by sliding the support arm 180 to a desired lateral position. Additional support arms 180 may be added as needed to support the desired number of products or columns/rows of product.

Figure 4A:
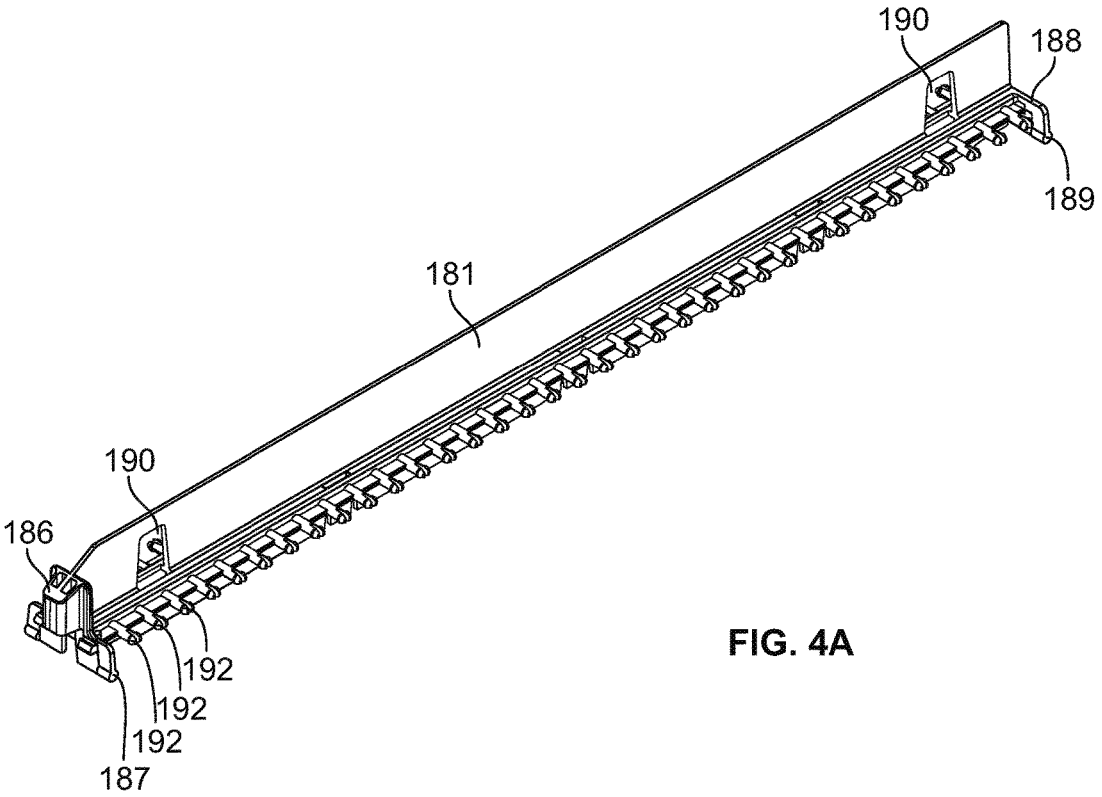
FIGS. 4A-F are upper perspective, front elevation, rear elevation, left side elevation, top plan and lower perspective views, respectively, of the body of the interstitial bracket of FIG. 2.
Figure 4B:
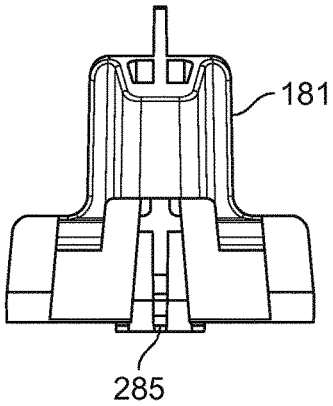
Figure 4C:
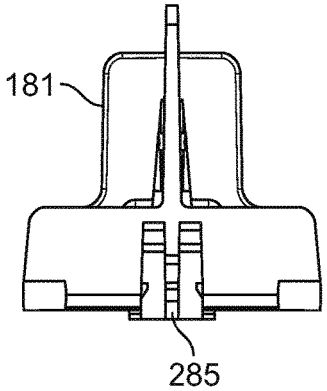
Figure 4D:
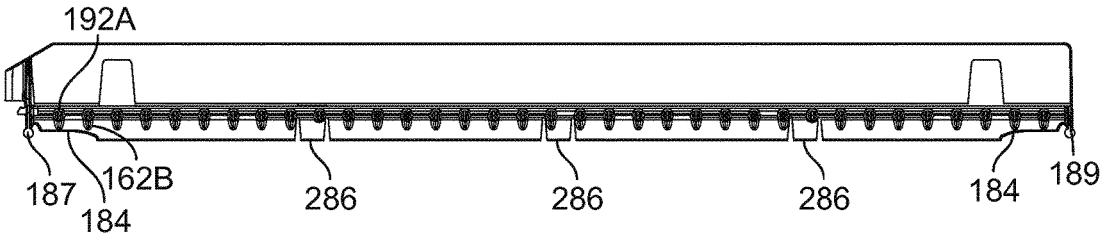
Figure 4E:
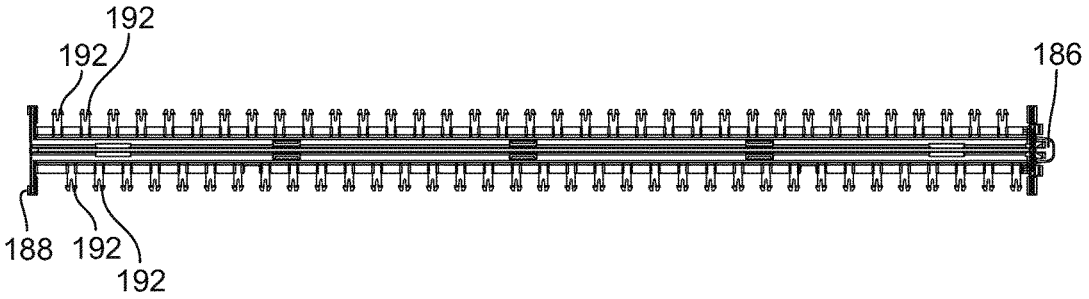
Figure 4F:
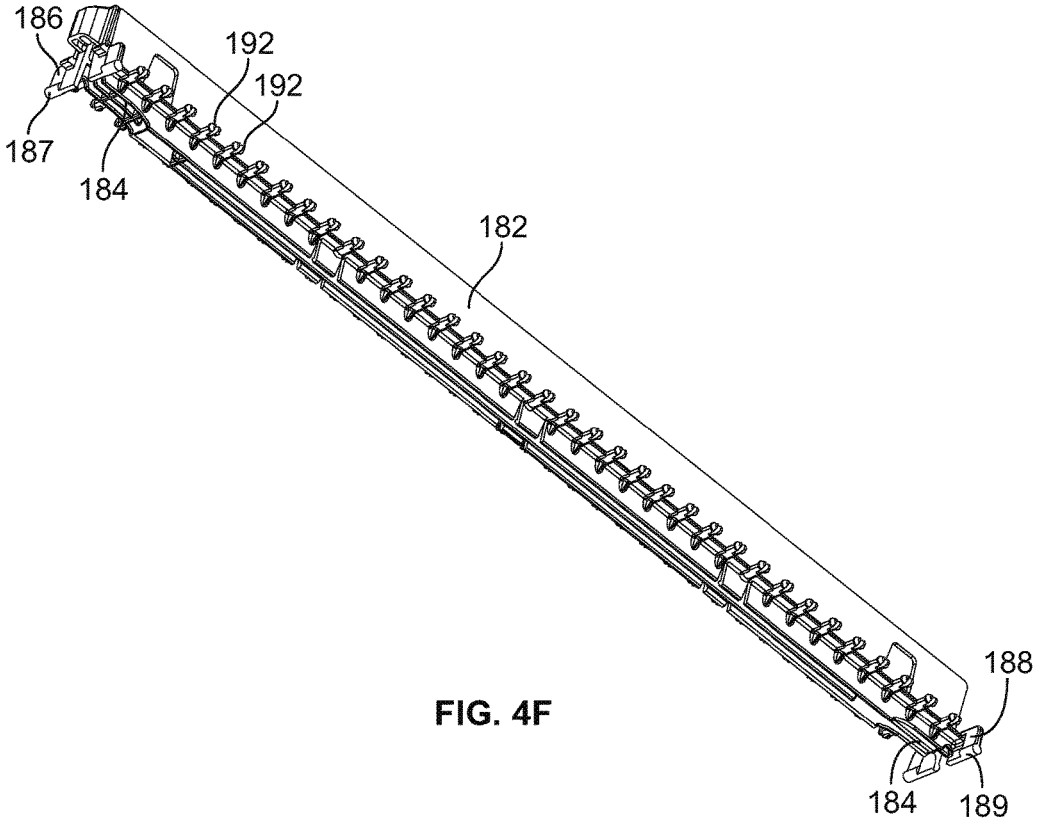

As illustrated in FIGS. 4A-F and as best seen in FIGS. 4D & 4F, the support structure arm 181 includes raised portions 184 to provide adequate clearance of the shelf mounts 124, 126 while retaining a flat, stable surface against the shelf 122. This allows the support structure 180 to sit firmly and squarely on the shelf 122. In a preferred form, the clearance provided for raised portions 184 is just enough to allow the support structure to be positioned laterally about mounts 124, 126 with ease but allow the bottom surface of the raised portion 184 to rest against the upper surface of mounts 124, 126 to further support structure 180 firmly and squarely on shelf 122.

Figure 7:
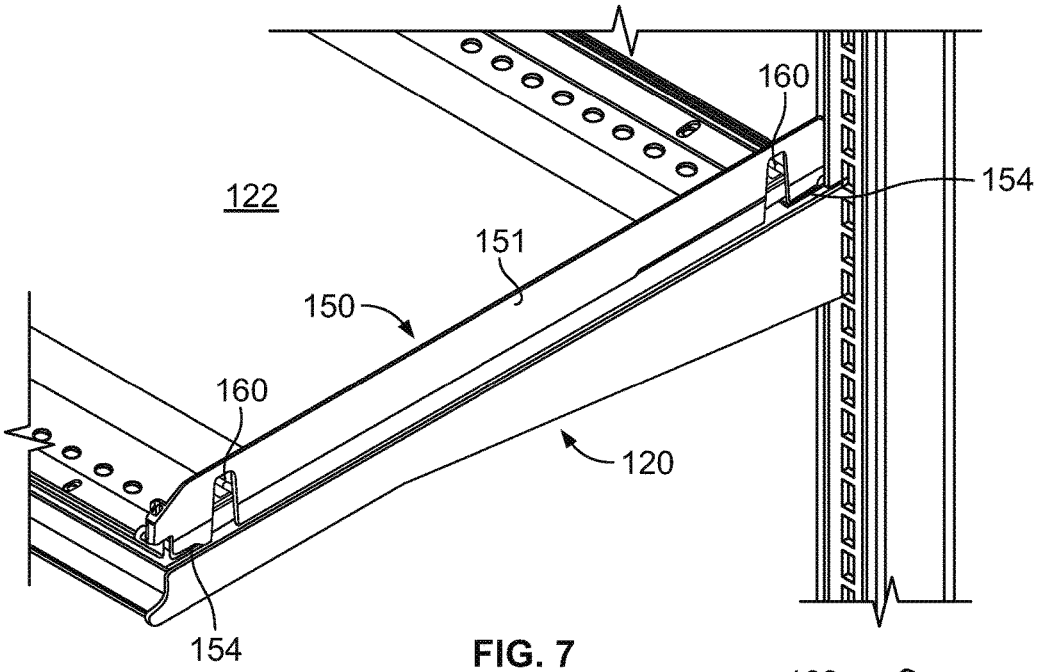
FIG. 7 comprises a perspective view of the left side end bracket of FIGS. 1A-C in accordance with aspects of the invention illustrated without the friction reducing structure attached to the body of the bracket.
Figure 8A:
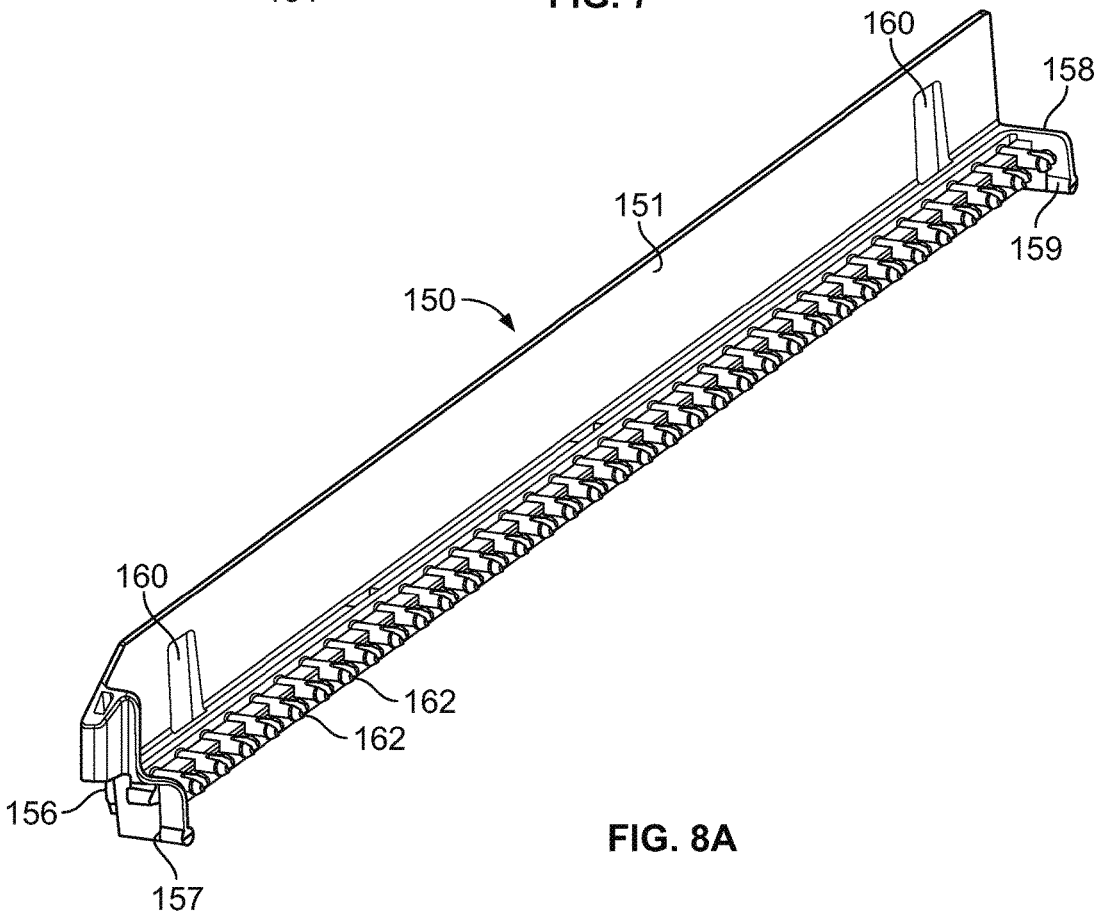
FIGS. 8A-B are upper and lower perspective views, respectively, of the right side end bracket of FIGS. 1A-C and 2 illustrated without the friction reducing structure attached to the body of the bracket.
Figure 8B:
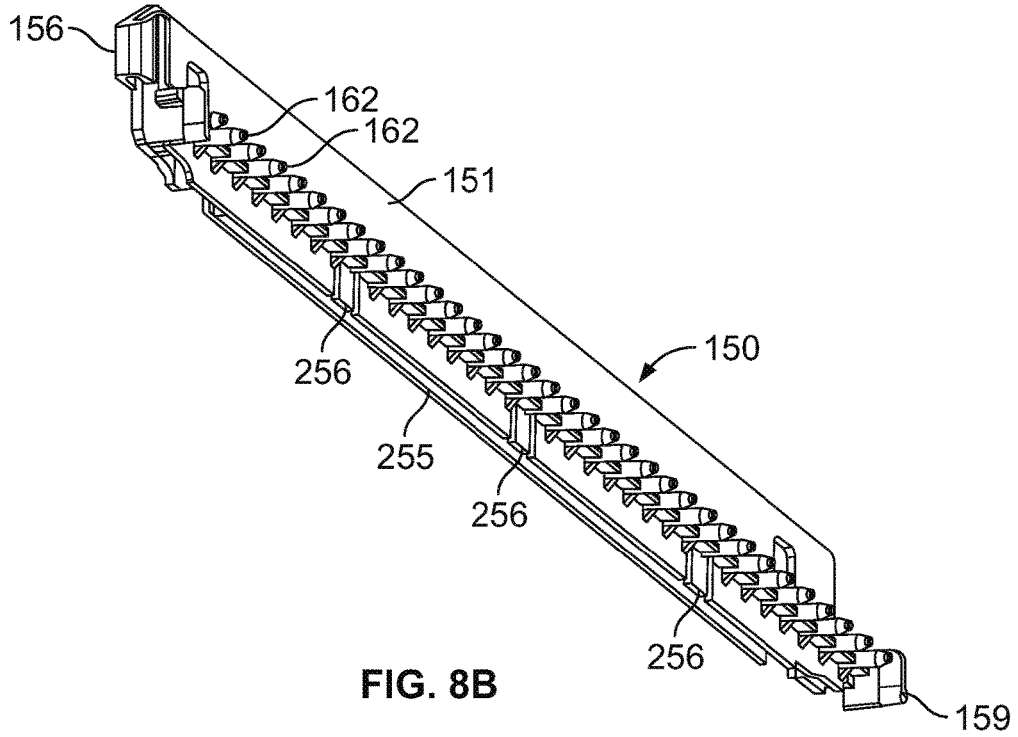

In some embodiments, and as seen additionally in FIGS. 7, 8A-B, the shelf display 120 also includes end brackets 150 at opposing lateral edges of the shelf 120 or at whatever end position is desired for the display if not at the lateral edge of the shelf 122. In some embodiments, end brackets 150 are configured in a similar manner as the arm support member 180 and include end bracket arm 151 which extends upwardly, front and rear mounting portions 156, 158 which may be an integral part of the end bracket arm 151 or may be coupled to the end bracket arm 151 through various conventional connecting methods. The same is true for support member 180.

The front and rear mounting portions 156, 158 further include mounting member portions, such as elongated circular tabbed portions 157, 159, which are inserted into the elongated channels 125, 127, thus allowing the end brackets to slide laterally across the shelf 122. As best seen in FIG. 7, the end bracket includes raised portions 154 to provide adequate clearance of the shelf mounts 124, 126 while retaining a flat, stable surface against the shelf 122. In a preferred form, lateral movement of the end bracket 150 is restricted in at least one direction at the vertical supports 110 due to the end bracket 150 extending in a rearward distance further than the forward projection of the vertical support structures 110. Such a configuration eliminates the possibility of laterally sliding an end bracket 150 off of the shelf 122. In alternate forms, however, spacing may be provided so that the end brackets 150 and support structures 180 may be slid into engagement with channels 125, 127 as desired. In either of these embodiments, movement of the end brackets 150 away from the outer edges of the shelf 122 (e.g., toward the center of the shelf) may be provided for if desired.

In some embodiments, and as seen in FIGS. 3A, 3B, 4A, & 4D-4F, the arm support member 180 includes a plurality of mounting projections 192 that span at least a portion of the longitudinal length of the support structure arm 181. In a preferred form and as illustrated, the projections 192 span the longitudinal length of the support structure 180. The mounting projections 192 are integrally formed with the support structure arm 181 and thus are constructed of extruded or molded plastic or other similar materials. The mounting projections 192 are generally cylindrically shaped posts having a recess or cutout, such as a tab, on their distal end, and are configured to allow a friction reducing component to be snap fit or press fit thereon. In alternate forms, however, it should be understood that the friction reducing component may be connected via other types of fasteners, such as by bolt, screw, pin, rivet, etc. Preferably such connections will allow the friction reduction component to retain clearance with respect to the projections 192 and to remain moveable with respect to the projections if so desired. In one embodiment, the friction reducing component is a plurality of rollers 194 having both cylindrical inner and outer surfaces, thus providing for rotation about the mounting projections 192. Due to the snap-fit connection between the mounting projections 192 and the rollers 194, lateral movement of the rollers 194 along the mounting projections 192 is largely if not completely restricted. The rollers 194 may be made from the same material as the support structure 180 and end brackets 150. Alternatively, the rollers 194 may be made of a special material specifically intended to further reduce friction between the product being displayed and the display (e.g., support structure 180, end brackets 150). In a preferred form, the rollers are made of polyethylene like the support structure 180 and end brackets 150, but further include silicon to help reduce friction between the products being displayed and the display.

In some embodiments, as seen in FIGS. 8A & 8B, the end brackets 150 include mounting projections 162 that span at least a portion of the longitudinal length of the arm end bracket 150 and, preferably, the entire longitudinal length. These mounting projections 162 are configured in an identical manner to the mounting projections 192 of the support member 180, thus they allow rollers 194 (not shown) to be attached thereto.

Because each roller 194 requires only a single projection 162 to attach to, both size and costs are significantly reduced. Supporting the rollers 194 on a single side of the end bracket 150 or arm support member 180 further reduces the amount of material necessary to provide a rolling surface as compared to conventional rollers having "axles" extending from opposing sides.

As best seen in FIG. 4E, on opposing sides of the arm support member 180, the mounting projections 192 are placed in offset positions. More specifically, the mounting projections 192 on one side of the support structure arm 181 are placed within the empty area between the mounting projections 192 on the other side of the support structure arm 181, or in a half-pitch configuration. This offset configuration provides for a smoother product transition along rollers as it slides, thus reducing the potential of the product tipping during movement. More particularly, this configuration ensures that the leading edge of the product being supported by rollers 194 will always be on a roller on one side or the other thereby reducing the risk that the product will pitch, tip or lean forward as move from the rear of the shelf to the front of the shelf which could otherwise cause product hang-ups, misalignment or problems with getting the product to front face in the display. Similarly, the rollers facing each other from one side of the supper member 180 and the end bracket 150 would also maintain this offset for the same reason. This offset is particularly helpful when dealing with smaller product and/or product with high centers of gravity and keeps these items traveling smoothly and without vibration or bounce when moving from the rear of the shelf to the front of the shelf.

In some embodiments, in operation, a support member 180 slides laterally along the shelf 122 until the support structure arm 181 is spaced at a distance from the end bracket arm 151 that is slightly greater than the product to be displayed, thus creating a product housing region 195. In other embodiments, multiple support members 180 are placed on the shelf 122 and are appropriately spaced so as to allow a product to be placed between support structure arms 181, creating a similar product housing region 195. The support structure arms 181 and end bracket arm 151 sufficiently extend vertically to serve as a partition or divider to restrict a product from lateral movement or from tipping in the lateral direction of the shelf To display the product, it is placed on the rollers 194 connected to either the mounting projections 162 of the end bracket 150 or the mounting projections 192 of the support arm 180. The product 105 may then be faced at the front of the shelf, where the front mounting attachments 156, 186 of the end bracket 150 and arm support member 180 extend laterally inwards and upwards, such as stops projecting into the product housing region 195 to restrict the product 105 from moving beyond the length of the shelf 122.

In some embodiments, and as seen in FIGS. 10A-12, the friction reducing component comprises a flat slide bar or belt piece 197 which replaces the rollers 194 to provide a product sliding surface. In a preferred form, it is made of polyethylene and silicon (e.g., silicon infused polyethylene) to further reduce friction between the product being displayed and the slide 197. Thus, this display may be configured with support structures 180, 150 made of a first material (e.g., polyethylene) and friction reducing components made of a second material different from the first (e.g., silicon infused polyethylene). The flat slide bar or belt piece 197 is constructed of plastic and formed using any of the methods previously mentioned. The flat slide bar or belt piece 197 defines openings or holes 198 which allow it to be snap-fit onto the mounting projections 162 of the end bracket 150 or the mounting projections 192 of the support arm 180 in a manner as indicated above. In other embodiments, the mounting projections 162, 192 are spaced further apart such that they only engage every other hole 198 or some other desired interval. In operation, the product 105 is placed on the flat slide bar or belt piece 197 to provide an uninterrupted or uniform sliding surface as described above.

In some embodiments, the friction reducing components further include a pusher or slider assembly 170 which assists in automatically facing the product 105. Turning now to FIGS. 3A, 5A-C, 6A-6C, 10A-B, a pusher or slider assembly 170 is provided constructed of polymers or similar materials using any of the previously-mentioned methods and is mated to the end bracket arm 151 or support structure arm 181. In the form illustrated, the pusher or slider assembly 170 includes a slider face 172, slider bottom surface 174, slider attachment portion 176, a receptacle or coil spring area 176, and coil spring 179. The slider attachment portion 176 preferably defines an open, C-shaped channel integrally formed into the bottom of the pusher or slider assembly 170 provided to slidably mate the pusher or slider assembly 170 to the end bracket 150 or the support structure 180. The recess or coil spring area 178 is an empty area defined by opposing rear sides of the coil spring assembly in which the coil spring may be inserted.

Figure 5A:
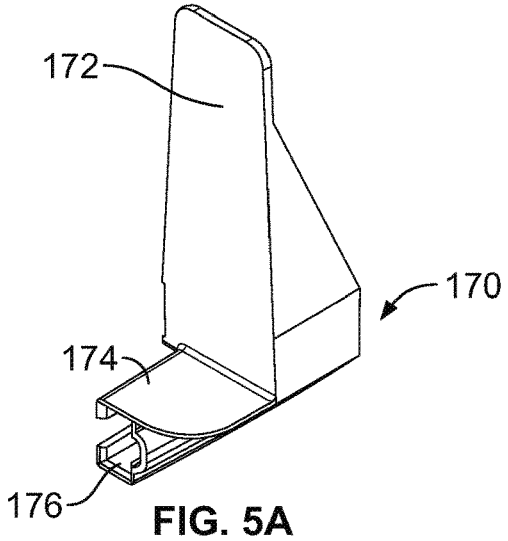
FIGS. 5A-C are upper perspective, front elevation and lower perspective views, respectively, of a right side slider or pusher structure in accordance with aspects of the invention.
Figure 6A:
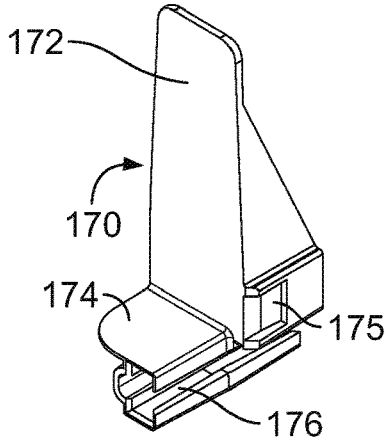
FIGS. 6A-C are upper perspective, front elevation and lower perspective views, respectively, of a left side slider or pusher structure in accordance with aspects of the invention.
Figure 5B:
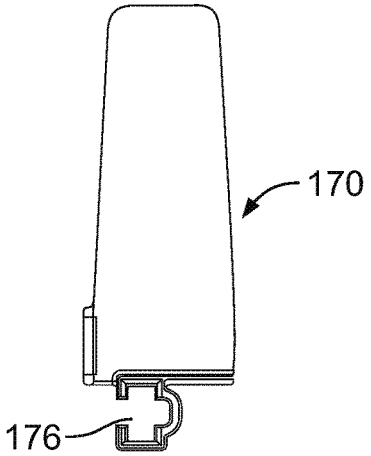
Figure 6B:
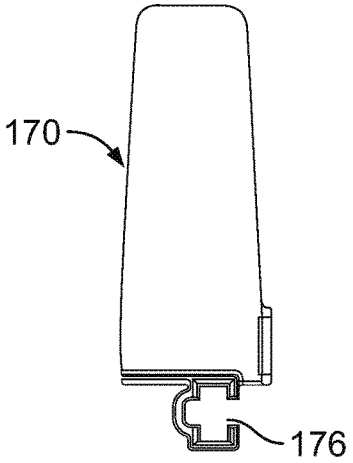
Figure 5C:
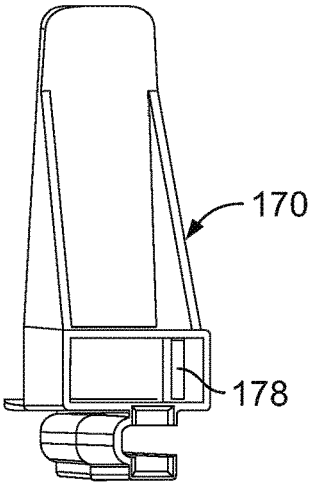
Figure 6C:
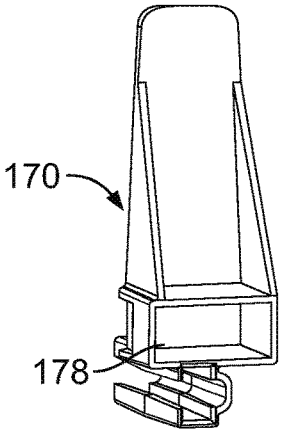
Figure 10A:
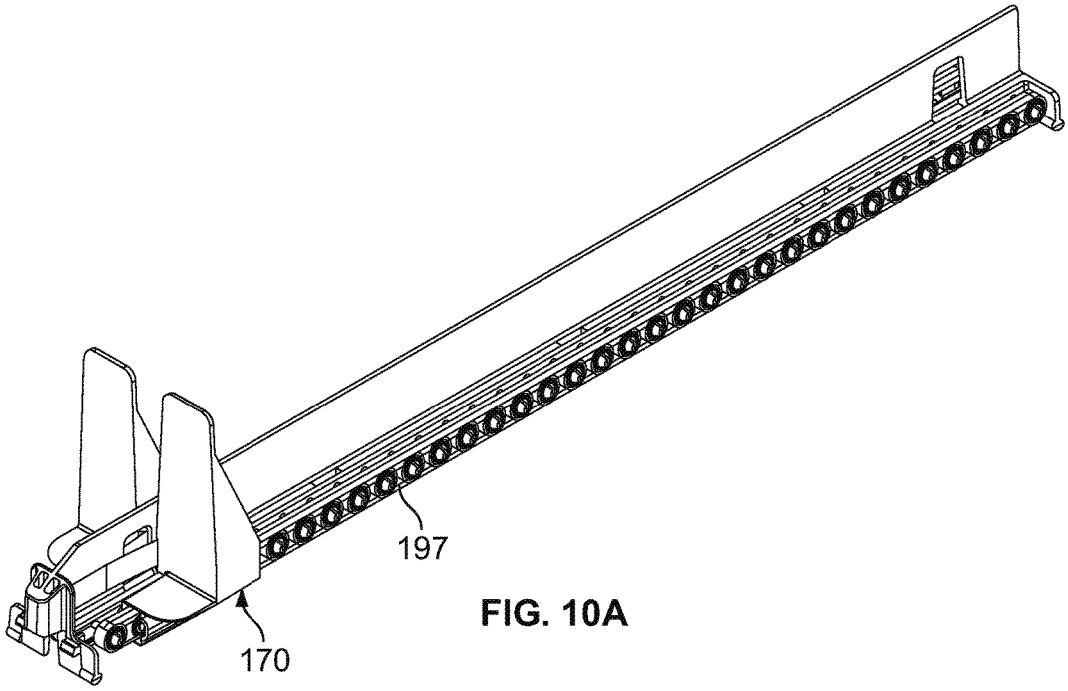
FIGS. 10A-B are perspective views of an alternate friction reducing structure in accordance with the invention, with FIG. 10B being an enlarged partial perspective view of the front of the interstitial bracket illustrated in FIG. 10A.
Figure 10B:
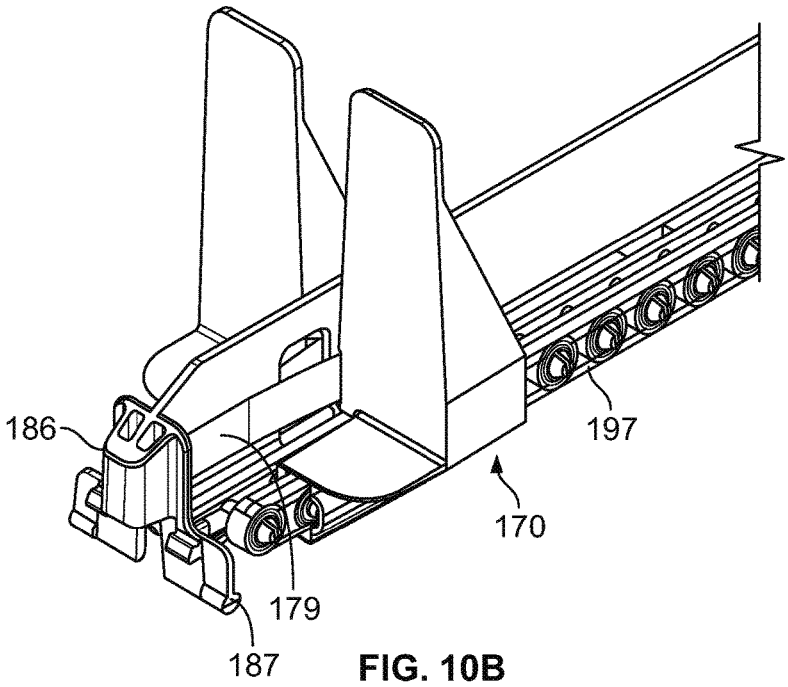
Figure 11:
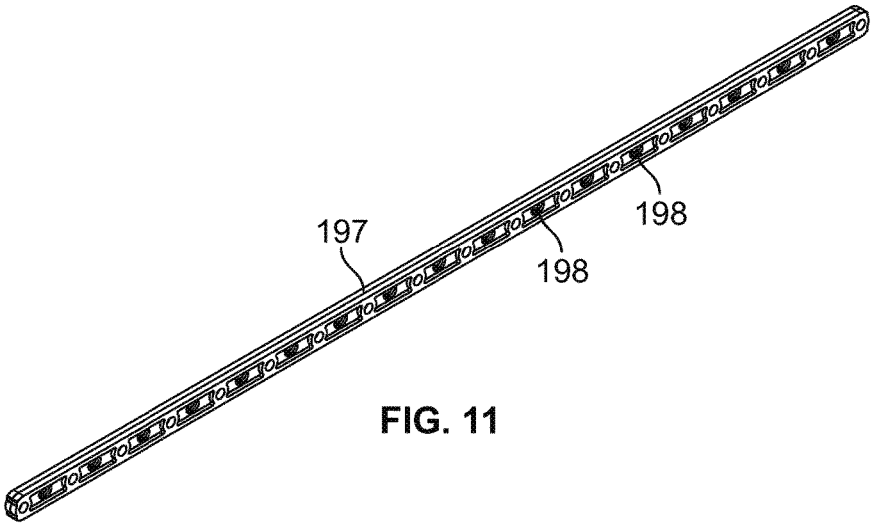
FIG. 11 comprises a perspective view of the alternate friction reducing structure of FIGS. 10A-B illustrating the flat bar or belt like shape of same.

It will be appreciated that the pusher or slider assembly 170 in FIGS. 5A-5C are configured to be attached to the left side of a support structure 180 or the left or inner side of the right end bracket 150 (which is the end bracket on the left as you look at the shelf from an aisle), and the pusher or slider assembly 170 in FIGS. 6A-6C are configured to be attached to the right side of a support structure 180 or the right or inner side of the end bracket 150 (which is the end bracket on the right as you look from at the shelf from the aisle). Regardless of which pusher or slider assembly 170 is used, the attachment and operation is the same. As seen in FIGS. 3A and 10A, pusher or slider assemblies 170 may be placed on slides located on the inner sides (or inward facing sides) or opposing sides of the end bracket arm 151 or support structure arm 181 as well as rollers, and may operate independently from each other regardless of what friction reducing component is used.

To mate the pusher or slider assembly 170 with the end bracket 150 or the support structure 180, the rollers 194 or flat slide bar or belt piece 197 must be inserted onto the mounting projections 162, 192 of the end bracket 150 or support structure 180. In the form illustrated, some rollers 194 would be installed on projections 162, 192 and the pusher or slider assembly 170 would be slid onto those rollers 194 and the remaining rollers would be installed to capture the pusher or slider assembly 170 on the support structure 180 and end bracket 150. Alternatively, in embodiments using a slider bar, the pusher or slider assembly 170 would be slid onto the slider bar 170 and then the slider bar would be connected to the projections 162, 192 in order to capture the pusher or slider assembly 170 on the support structure 180 and end bracket 150. It should be appreciated, however, that in alternate embodiments the slider attachment portion 176 may be inserted onto either end of the end bracket arm 151 or support structure arm 181, with the open portion of the slider attachment portion 176 facing the elongated arm 151 or 181. The open area of the C-shaped slider attachment portion 176 is thus filled by the rollers 194 or the flat slide bar or belt piece 197 which capture the pusher or slide assembly 170 onto the support member 180 and end bracket 150.

In other embodiments, the pusher or slider assembly 170 may be made of a resilient, but flexible material that allows for the pusher or slider assembly 170 to deform and be press or snap fit onto the friction reducing component. For example, to mate the pusher or slider assembly 170 with the end bracket 150 or the support structure 180 in one form, the bottom portion of the slider attachment portion 176 is pulled downwards to provide sufficient clearance of the rollers 194 or flat slide bar or belt piece 197. When the tabbed portion of the slider attachment portion 176 comes into contact with the inner lower surface of the rollers 194 or the flat slide bar or belt piece 197, the pusher or slider assembly 170 can be rotated upwards to snap the slider attachment portion 176 over the top of the rollers 194 or flat slide bar or belt piece 197.

As best seen in FIGS. 3A, 5C, 6C, and 10B, the pusher or slider assembly further includes the coil spring 179 to provide an assistive force in facing the product. The coil spring 179 is attached to the end of the end bracket arm 151 or support structure arm 181, and the spooled portion is placed in the coil spring area 178 to allow the coil spring 179 to wind up in its relaxed configuration. In some embodiments, the end bracket arm 151 or support structure arm 181 include a tabbed slot at its distal end to allow the coil spring to be snap fit therein. In other embodiments, the end of the coil spring is simply secured to a side of the arm 151, 181 through conventional methods such as screwing, bolting, riveting, gluing, taping, etc. As best seen in FIG. 6A, the pusher or slider assembly 170 includes a coil spring slot 175 configured to allow the coil spring to pass through to assist in operation. In other forms, at least the support structure 180 may be configured with a common coil that recoils both pusher or slider assemblies 170 mounted to support structure 180. For example, the distal ends of a coil may wind up to a relaxed position located about the middle of the metal coil spring. The middle may be mounted on the distal end of the support structure 180 and the distal ends disposed within the receptacles defined by the pusher or slide assemblies 170 on each side of the support structure.

In some embodiments, the coil spring area 178 includes a cylindrically tabbed protrusion (not shown) on the bottom surface the coil spring rests on to rotatably mate with an inner bore of the coil spring 179. In some embodiments, this is a snap-fit connection which allows the coil spring 179 to quickly and easily be mated to the pusher or slider assembly 170. Coil springs are generally known in the art, with U.S. Pat. No. 6,409,028 providing a detailed example of the use of a coil springs in a product display apparatus, which is incorporated herein by reference in its entirety.

Figure 9:
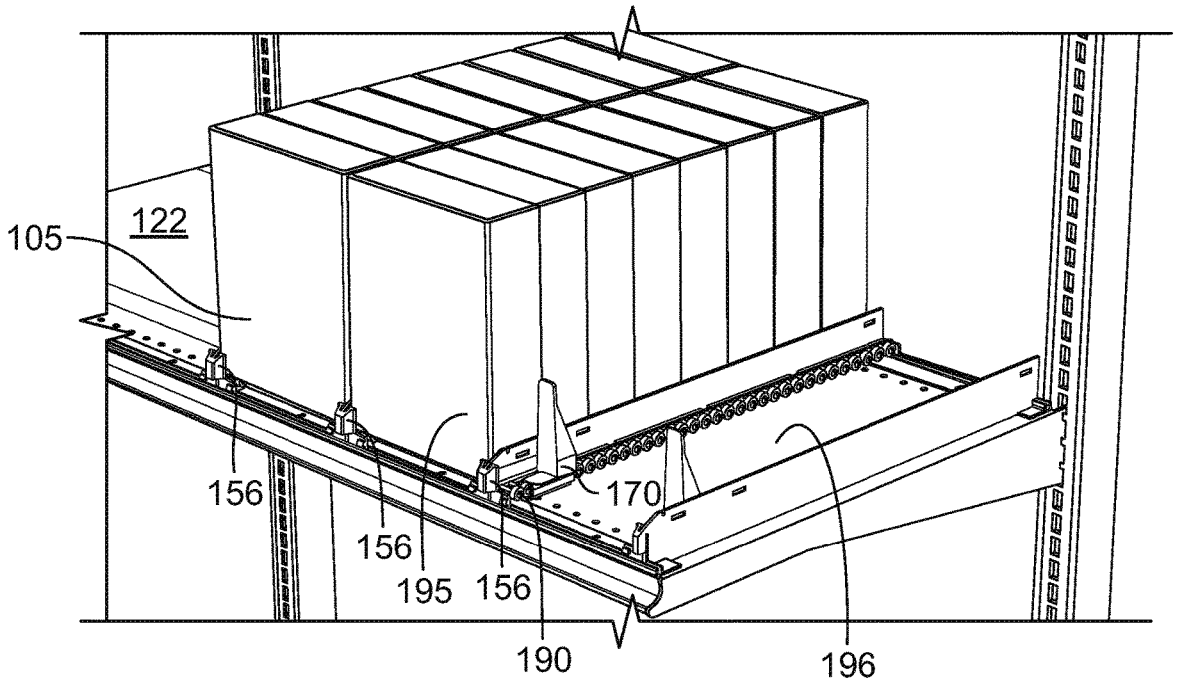
FIG. 9 is a perspective view of the fixed shelf unit of FIGS. 1A-C illustrating the fully assembled brackets with roller type friction reducing structures and having product such as cereal boxes displayed in the universal merchandiser.
Figure 13:
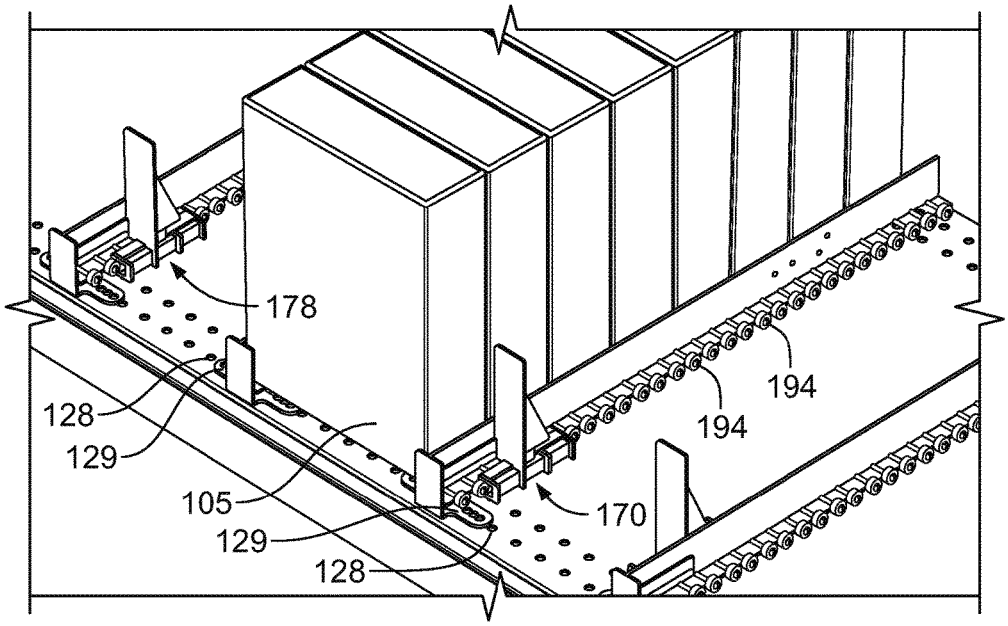
FIG. 13 comprises a perspective view of an alternate fixed shelf unit in accordance with the invention, in which the brackets are mounted to the shelf in a manner that allows for a limited range of lateral movement of each bracket rather than the much wider range of lateral movement provided in the embodiment of FIGS. 1A-C.
Figure 14:
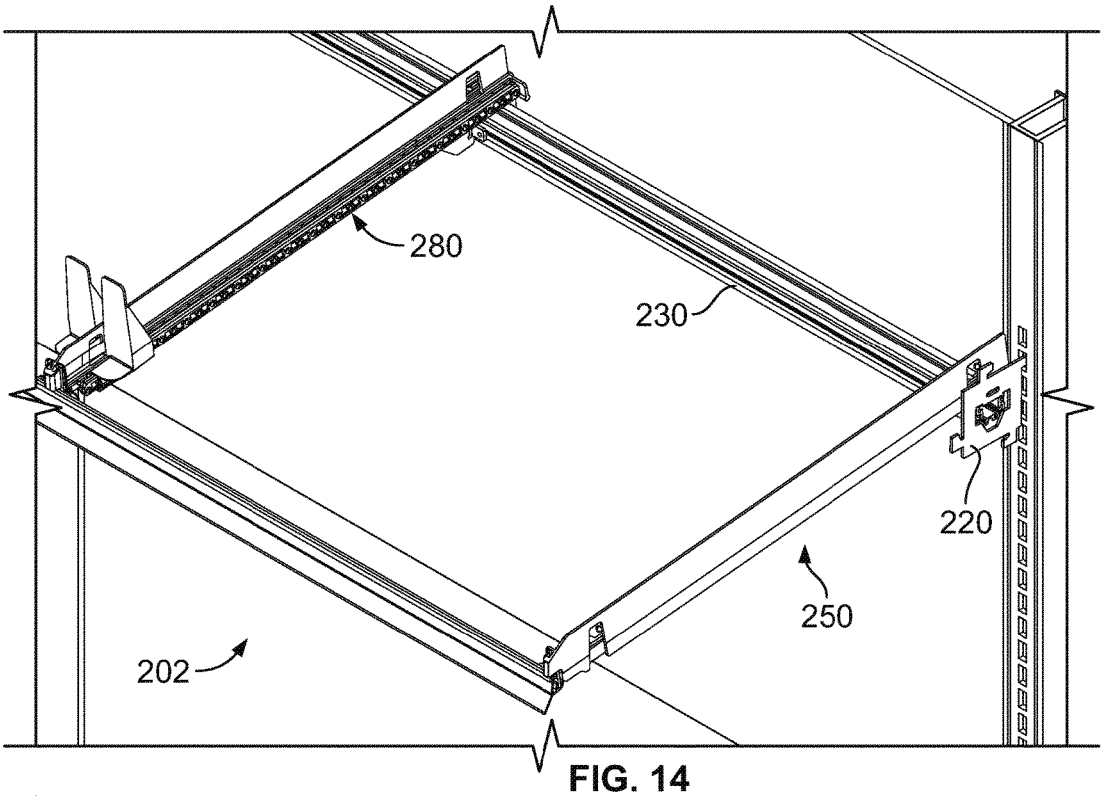
FIG. 14 is a perspective view of a portion of the suspended bar version or bar support unit of the universal merchandiser of FIGS. 1A-C.

Once the pusher or slider assembly 170 is slidably mated to the end bracket 150 or support structure 180, movement along the length of the arm 151, 181 may be accomplished. As seen in FIGS. 9 and 13, when multiple products 105 are to be displayed, the product 105 closest to the proximal end of the end brackets 150 or support structure 180 is placed on against the pusher or slider assembly 170 such that the back surface of the product 105 rests against the slider face 172 and the bottom surface of the product 105 rests on the slider bottom surface 104. As more products 105 are placed in the product housing regions 195, 196, the coil spring 179 continues to uncoil, thus biasing the pusher or slider assembly 170 to move towards the distal end of the end brackets 150 or support structure 180. When a product 105 is removed from the product housing regions 195, 196, the coil spring 179 causes the pusher or slider assembly 170 to move towards the distal end of the product housing region 195, 196 until the product 105 comes into contact with the front mounting attachments 156, 186 of the end bracket 150 and support structure 180 that extend inwards into the product housing region 195, 196 to restrict the product 105 from moving beyond the length of the shelf 122.

In this configuration, combined with the roller 194 or flat slide bar or belt piece 197 mentioned above, an improved upright display 100 is provided. This display 100 is less expensive to manufacture than conventional displays due to the slider 170 directly attaching to the friction reducing component (e.g., rollers 194 or flat slide bar or belt piece 197) as opposed to a separate track member provided in or coupled to the end brackets 150 or support structure 180, yet the pusher or slider 170 remains captured and guided by the friction reducing components so that it travels smoothly there along in a reproducible manner and without risk that the pusher or slider 170 will get misaligned. Further, the display 100 is beneficial to consumers because it allows product 105 to be automatically faced (whether by gravity in the non-pusher version or by the pusher in the pusher version), thus increasing its appeal to the eye to the consumer. Further, if the consumer decides to re-merchandise the product 105, the reduced spring force of the coil spring due to the presence of the friction reducing components results in the increased ability to push products back into the display structure without risking damaging the product packaging. When combined with the rollers 194, the coil spring 179 of the pusher or slider assembly 170 requires approximately $1/5^{th}$ of the spring force of conventional coil springs, thus greatly reducing the amount of stress on product packaging and therefore reducing the risk of damaging the packaging. In addition, the configuration set forth herein with respect to the pusher version of the display allows for products to be pushed by their outer edges and corners where the products are better equipped to handle such forces rather than in the center of the product.

In another embodiment, the end brackets 150 or support member 180 have both a plurality of rollers 194 and a flat slide bar or belt piece 197 coupled thereto. For example, the end brackets 150 or support member 180 may be configured to have rollers 194 coupled to the protrusions 162 for approximately half the length of the end bracket 150 or support member 180, and further configured to have a flat slide bar or belt piece 197 coupled to the remaining protrusions 162. It will be appreciated that any number of rollers 194 and flat slide bar or belt pieces 197 may be utilized. For example, the end bracket 150 or support member 180 may have a flat slide bar or belt piece 197 at its distal end, followed by a plurality of rollers 194, followed by another flat slide bar or belt piece 197 configured at its proximal end. Alternatively, the end bracket 150 or support member 180 may have a plurality of rollers mated to the protrusions 162 at its distal end, followed by a flat slide bar or belt piece 197 mated to the protrusions 162, followed by a plurality of rollers 194 mated to the protrusions 162 at its proximal end. It is appreciated that any number of configurations of rollers 194 and flat slide bar or belt pieces 197 may be coupled to the end bracket 150 or support member 180. It will be appreciate that the pusher or slider assembly 170 may be used in this embodiment as described above.

In another embodiment, the end bracket 150 or support arm 180 include a conveyor assembly. In this embodiment, the outermost protrusions 162 are coupled to rollers 194 in the above-discussed manner. A belt is then placed over the rollers 194 to create a conveyor belt assembly. In this embodiment, the product 105 rests on the belt, and frictional forces between the bottom surface of the product 105 and the belt limit sliding motion between the surfaces. When the product is moved to the distal end of the end bracket 150 or support arm 180 due to the use of a pusher or slider assembly 170 or simply by manual operation, the rollers 194 rotate in the same direction, thus causing the belt to advance along the length of the end bracket 150 or support arm 180. It will be appreciated that any number of rollers 194 may be mated to the protrusions 162, and the belt will then be placed over the rollers to create the conveyor belt assembly.

In some embodiments, some or all of rollers 194, pusher or slider assembly 170, or flat slide bar or belt piece 197 are constructed of additional materials using a molding, extrusion, or another similar technique. For example, the friction reducing members may be molded with a silicon infused polymer which reduces the coefficient of friction between the product 195 and the display to improve movement of the product along the display. In a preferred form, the display is setup so that a majority of the components can be made from inexpensive plastic injection molded processes, but that the friction reducing components (e.g., rollers 194 and slide 197) can be made of a more expensive material or process to provide further friction reducing capabilities.

Figure 12:
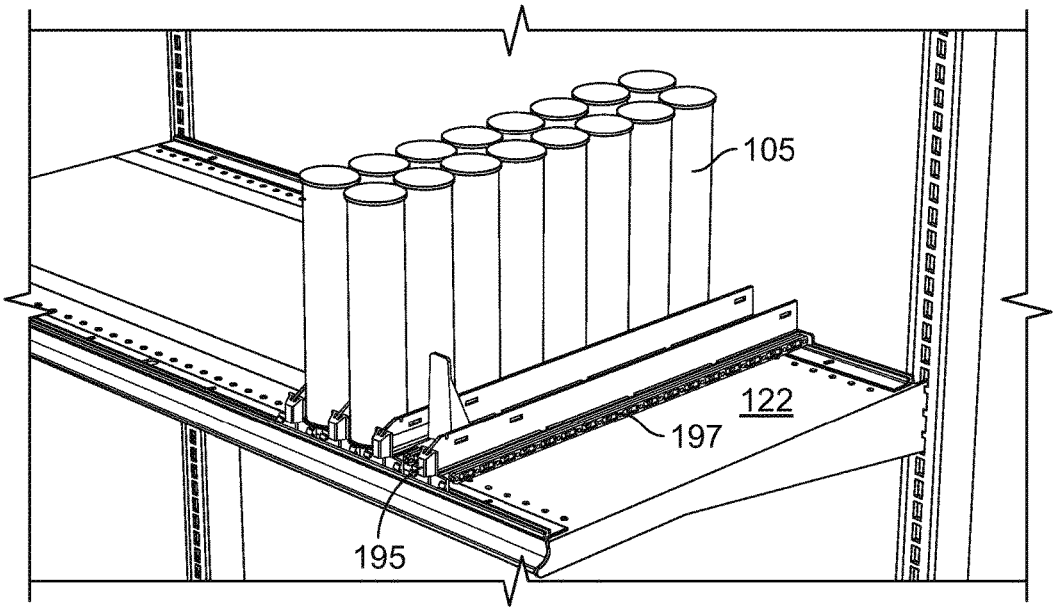
FIG. 12 comprises a perspective view of the fixed shelf unit of FIGS. 1A-C using the alternate friction reducing structure of FIGS. 10A-11 to move smaller product with higher centers of gravity, such as potato chip containers, which may be easier moved with a friction reducing structure having a continuous surface rather than rollers.

The upright merchandiser 100 is additionally beneficial to retailers due to the ease of providing support for products having varying widths. Upon configuring the width of the product housing regions 195, 196 to accommodate a product, either one or two slider assemblies 170 may be attached to the end bracket 150 or support structure 180 to provide assistance in facing the product. For example, as seen in FIG. 12, if a smaller product such as a pill bottle or can of potato chips is to be merchandised, only one pusher or slider assembly 170 will be attached to one of the two opposing end brackets 150 or support structure 180. Conversely, FIG. 13 shows a configuration involving a larger product. If a retailer desires to merchandise a product having larger dimensions, a pusher or slider assembly 170 will be mounted to both sides of the product housing regions 195,196, and the slider assemblies 170 will provide a facing force on the product where the packaging is geometrically strongest, i.e., opposing outer edges of the product.

Combined with the roller 194 or flat belt piece 197 mentioned above, the pusher or slider assembly 170 provides for automatic facing of the desired product, reducing the amount of time retailers would normally need to spend front facing products on said display. The price channel 165 quickly allows the retailer to view the price of a particular product as well as to view additional information such as a barcode to scan for the purpose of maintaining accurate records of product stock.

Referring now to FIG. 13, an alternative embodiment shows a fixed shelf display as described above, but removes the rear shelf mount 124 and front shelf mount 126, thus removing the ability to slide the end brackets 150 and support structures 180 laterally along the length of the shelf 122. In this embodiment, the shelf includes spaced holes 128 which allow the end brackets 150 and support structures 180 to be mated thereto. The arms 151, 181 include a reconfigured slotted projection 129 that has a horizontal mating surface on the distal end and proximal end (not shown) configured to align with the holes 128 of the shelf 122. A screw, fastener, key lock, or any other securing device may then be used to secure the end brackets 150 and support structures 180 to the shelf 122. In this embodiment, while course adjustment of the lateral position of the end brackets 150 and support structure 180 is not possible, retailers may still adjust the spacing at different intervals depending on the spacing of the holes 128 to make fine adjustments to the product display which may be all that is needed or desired for particular applications. In a preferred form, a simple deformable fastener pin is used to secure the product support structures 180, 150 into position which can be installed and removed and re-installed without the need for any tools.

Figure 21A:
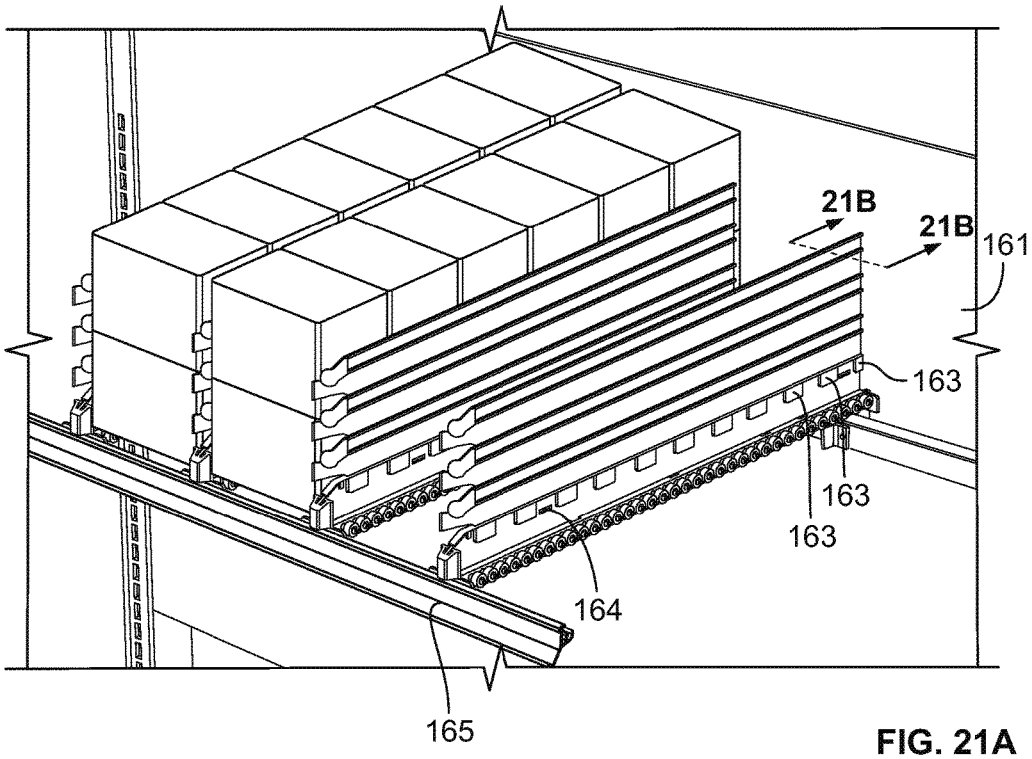
FIGS. 21A-B are front and rear perspective views, respectively, of an alternate bar support unit in accordance with the invention in which optional risers are shown connected to the universal merchandiser to accommodate dispensing of stacked products, with FIG. 21B being a rear perspective of a cross-section of FIG. 21A taken along line 21B-21B in FIG. 21A.
Figure 21B:
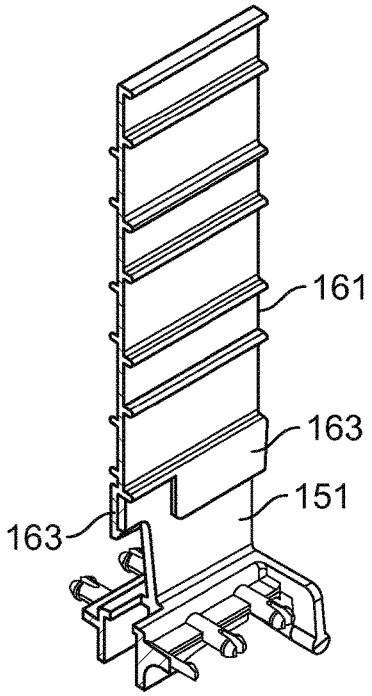

It is envisioned that in an alternative embodiment, any of the above configurations may be modified to allow for vertically stacking of products 105 within the product containing regions 195, 196. As seen in FIGS. 4A, 7, 8A, 9, 21A, and 21B, end bracket arms 151 and support structure arms 181 include any number of openings 160, 190 which allows an additional partitioning arms 161 to be mated thereto. These additional partitioning arms 161 are capable of mating to both the end bracket arms 151 and support structure arms 181 to create a vertical partition, thus providing further guidance for the product housing region 195, 196. In some embodiments, and as seen in FIGS. 4A, 7, and 8A, the opening is generally trapezoidal in shape. In other embodiments, and as seen in FIGS. 9 and 21A, the opening is an elongated slot. In either of these configurations, as best seen in FIGS. 21A & 21B, the additional partitioning arms 161 further include alternating offset tabs 163 to mate with the arm 151, 181 directly below it.

To secure the additional partitioning arms 161, the additional partitioning arms 161 are press fit onto the lower arms 151, 181 such that approximately half of the alternating offset tabs 163 are on one side of the lower arm 151, 181 and the other half of the alternating offset tabs 163 are on the other side of the lower arm 151, 181. If additional securing force is desired between the additional partitioning arms and the lower arms 151, 181, a tab 163 having a protrusion clips into the opening 160, 190 to mate the two arms and thereby restrict movement. Such a configuration is illustrated in FIG. 21B. It is understood that the arms 151, 181 may have any number of openings 160, 190, thus the additional partitioning arms 161 would include the corresponding number of tabs having a protrusion to clip into these openings.

As seen in FIG. 21A, the additional partitioning arms 161 also include flexible finger members which extend inwardly at their distal end to restrict product from sliding beyond the length of the shelf 122. Although those fingers are shown on the front or distal edge of the partitions 161 only, it should be understood that in alternate embodiments such fingers could be produced on the rear or proximate end of the partition 161 as well to prevent products from being pushed too far back into a display. Such a configuration may be desirable in situations where the display does not have a back wall or when available product height clearances reduce as you move toward the rear of the display (meaning that care must be taken not to push product too far back into the display or it may get wedged into the display causing problems with gravity feeding and/or pusher or slider assembly operation).

Referring now generally to FIGS. 1A, 1B, 14, and 16A, an example of a bar display 202 is provided to allow for the display of products 205. The bar display 202 includes the previously-discussed vertical uprights 110, blade 210, rotatable bracket 220, bar 230, end brackets 250, and support structure 280. Many components of the bar display 202 are identical to those of the fixed shelf display 120, and thus additional description of these components will not be discussed in significant further detail.

Turning to FIGS. 14, 16A, and 17A-17D, a rotatable bracket 220 is provided which couples the bar display 202 to the vertical supports 110. The rotatable bracket 220 is generally square shaped and includes first, second, third, and fourth hook-shaped tabbed protrusions 221, 222, 223, 224, respectively, and a generally central opening 226. The rotatable bracket 220 further includes a tongue 228 having a hole 229 extending generally perpendicularly from the opening 226. As stated with regards to the fixed shelf display 120, any one of the first 221, second 222, third 223, or fourth 224 tabbed protrusions insert into the elongated slots 112 of the vertical support structures 110 to securely connect the bar display 202 to the upright display 100. As discussed below, depending on the desired configuration of the bar display 202, a specific tabbed protrusion is inserted into the elongated slot 112.

As seen in FIGS. 18A-D, 19A, 19B, the bar 230 is generally rhomboid-shaped and hollow and includes a C-shaped channel 231, 233, 235, 237 on each side as well as an opening 232, 234, 236, 238 on the flattened bottom surface of each corresponding C-shaped channel. The rhomboid shape allows for the bar to be rotated amongst any of the four positions illustrated in FIGS. 18A-18D (which show a cross sectional view of the bar 230 and thus the rotatable bracket secured to the far end of the bar 230). In some embodiments, the rotatable bracket 220 may be mounted to the bar 230 in four ways corresponding to the four surfaces of the rhomboid-shaped bar 230. The tongue 228 of the rotatable bracket 220 is inserted into the bar 230 such that the upper surface of the tongue 228 rests against the inner flattened bottom surface of one of the C-shaped channels 231, 233, 235, 237. Depending on the desired configuration, the first 232, second 234, third 236 or fourth 238 openings align with the tongue hole 229 of the rotatable bracket 220 to allow for securing the rotatable bracket 220 to the bar 230. As seen in FIGS. 18A-18D, the securing device may be a countersunk screw to provide for movement along the channel, but alternative devices such as a snap fitting configuration may also be incorporated. It is understood that a rotatable bracket 220 is secured to both ends of the bar 230. By observing the orientation of the tongue 228 relative to a corresponding side of the bar 230, a user can ensure that the rotatable bracket 220 is configured in an identical orientation at opposing ends of the bar 230.

Figure 15A:
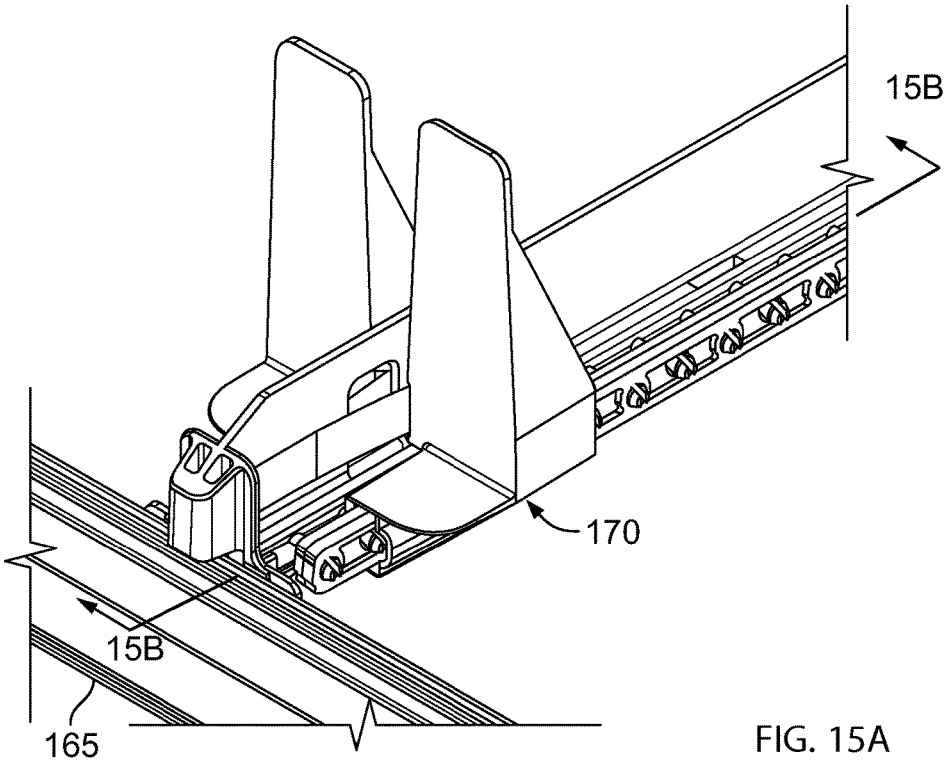
FIGS. 15A-B are perspective and cross-sectional views, respectively, of the front of the interstitial bar support unit of FIG. 14, with the cross-section of FIG. 15B taken along line 15B-15B in FIG. 15A.
Figure 15B:
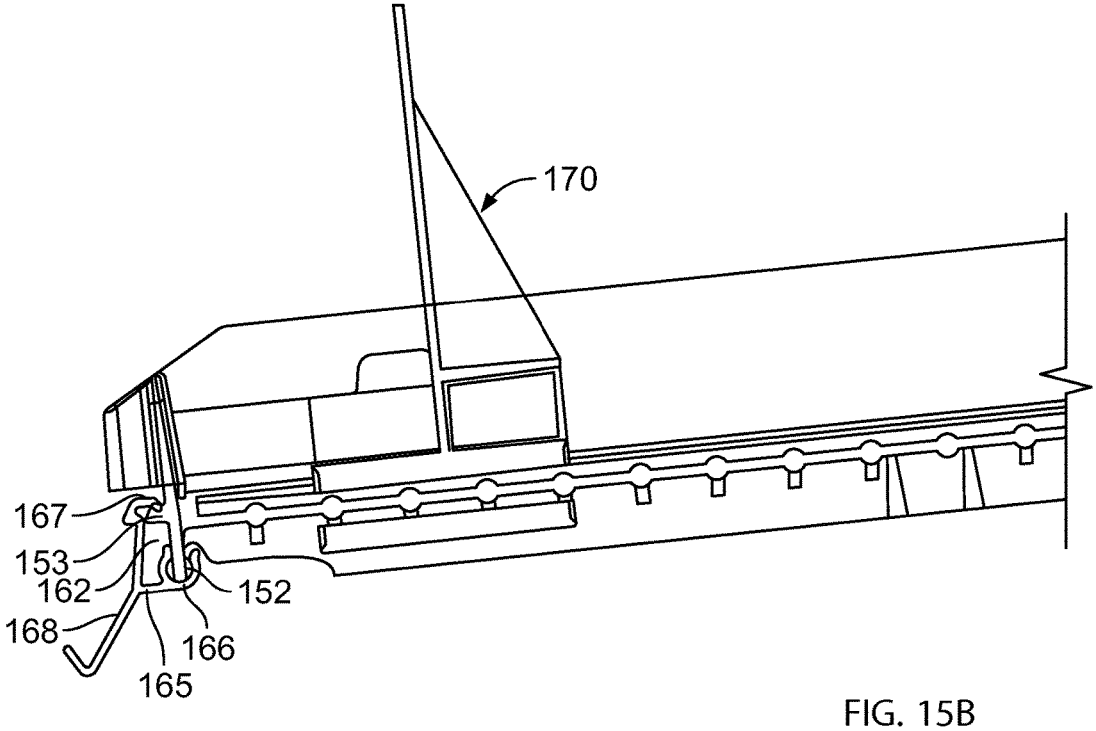
Figure 15C:
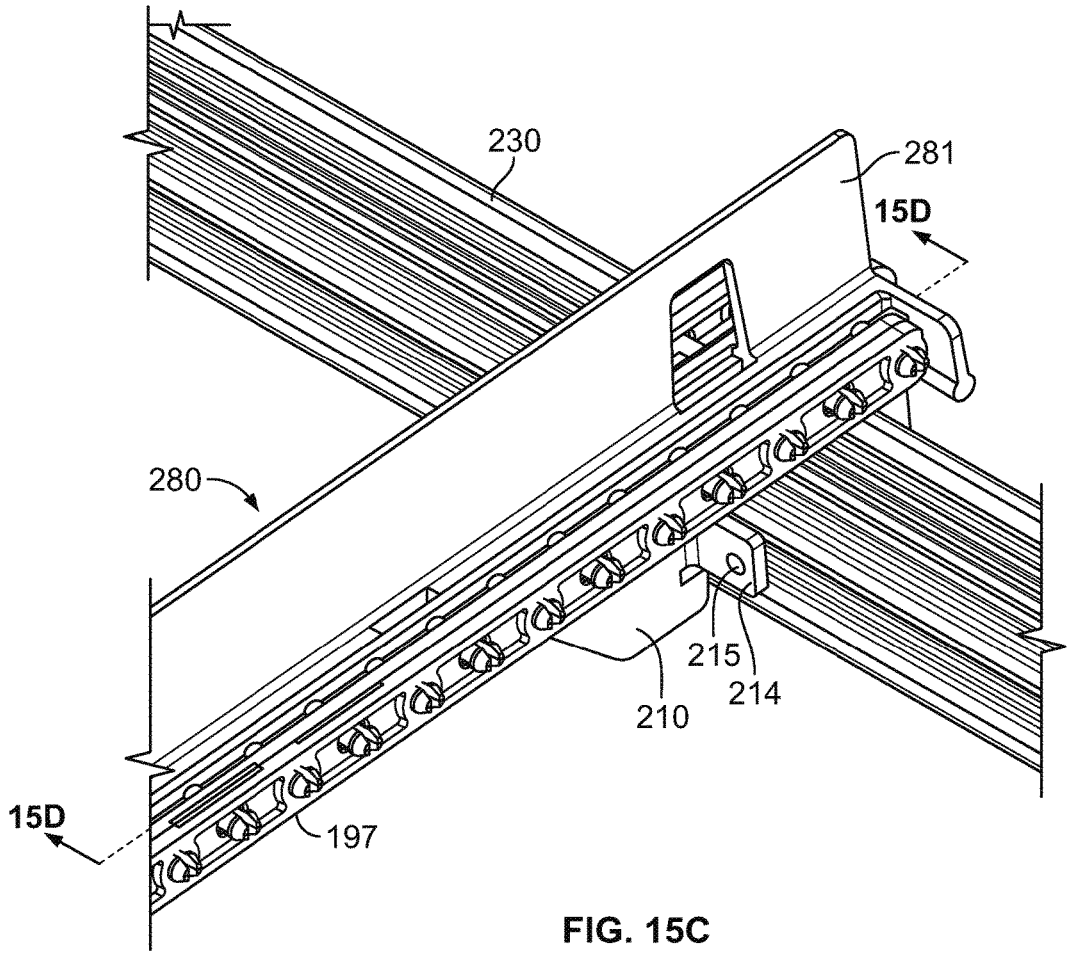
FIGS. 15C-D are perspective and cross-sectional views, respectively, of the rear of the interstitial bar support unit of FIG. 14, with the cross-section of FIG. 15D being taken along line 15D-15D in FIG. 15C.
Figure 15D:
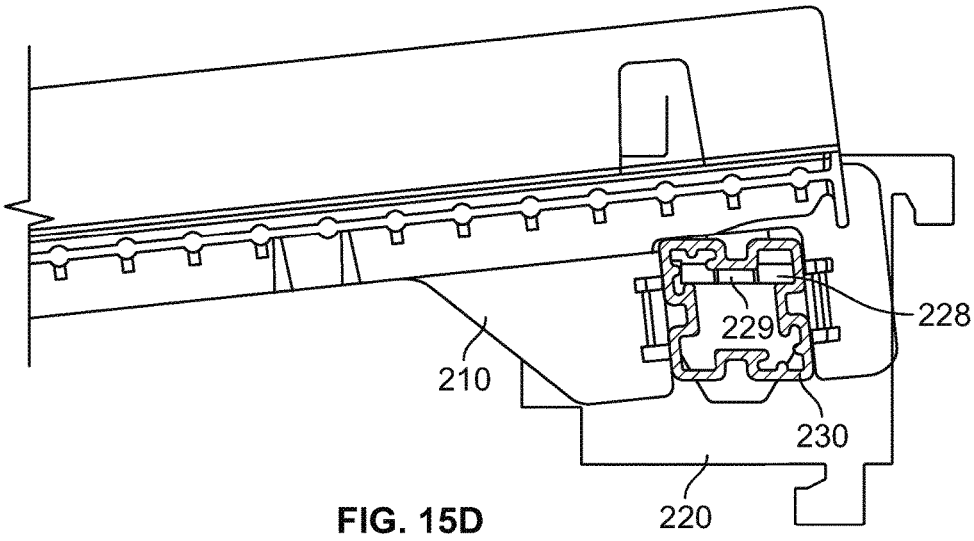
Figure 15E:
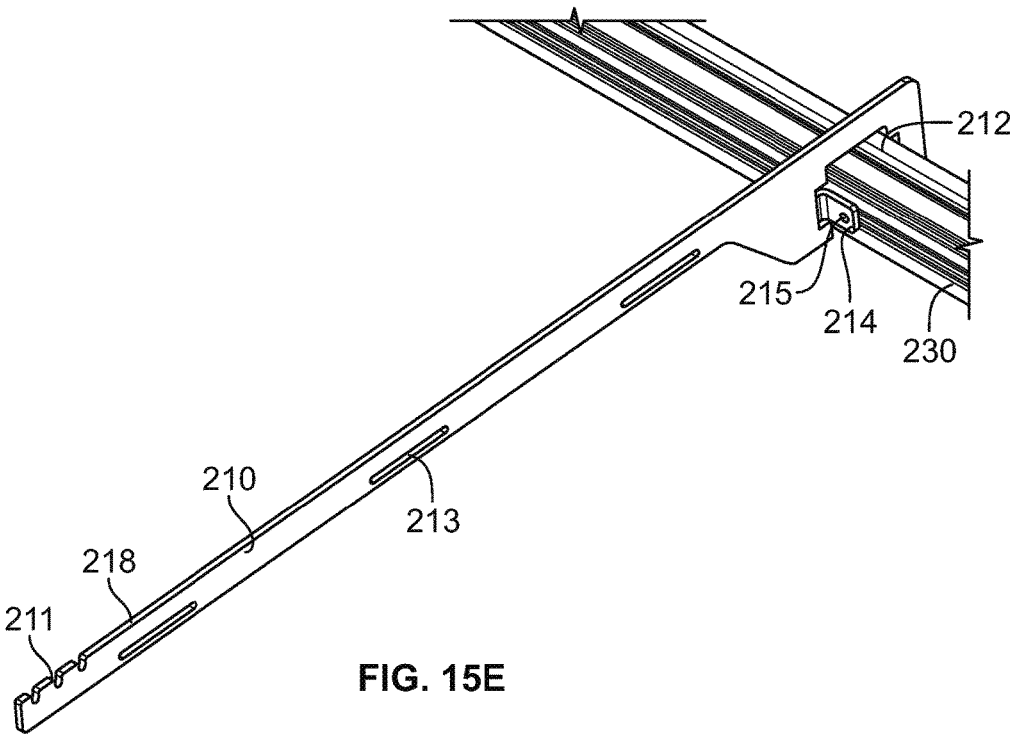
FIG. 15E comprises a perspective view of the support bracket used for the bar support unit of FIG. 15A according to one aspect of the invention.
Figure 16A:
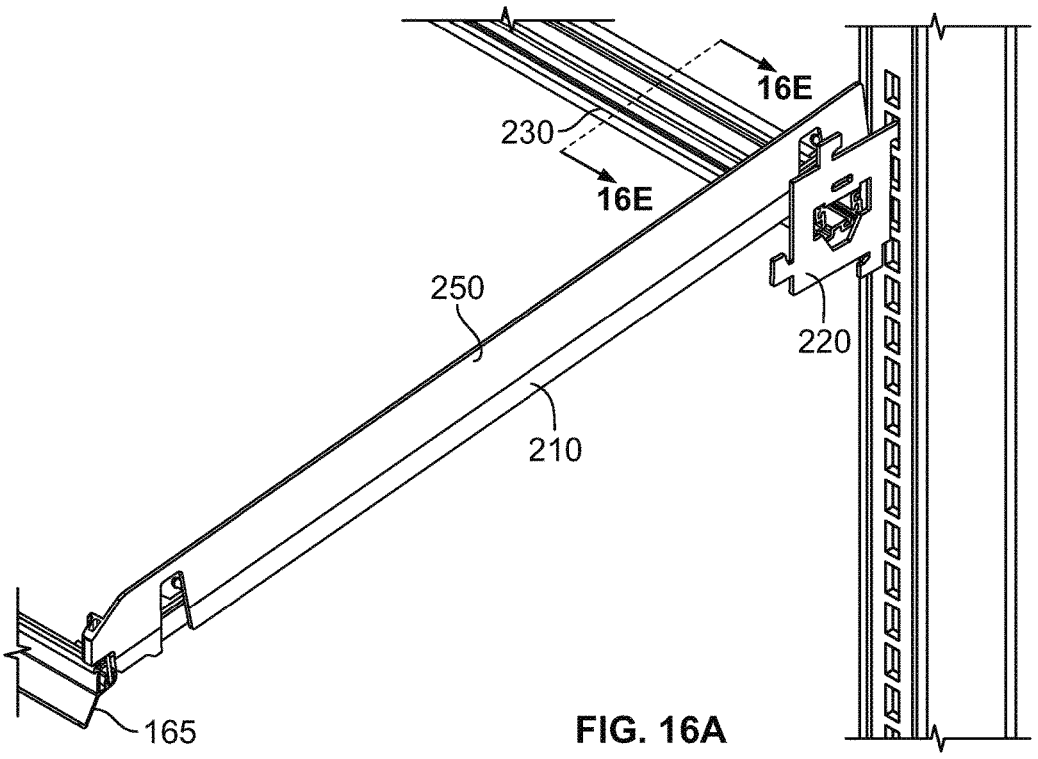
FIG. 16A is an enlarged perspective view of the front of the end bracket of FIG. 14.
Figure 16B:
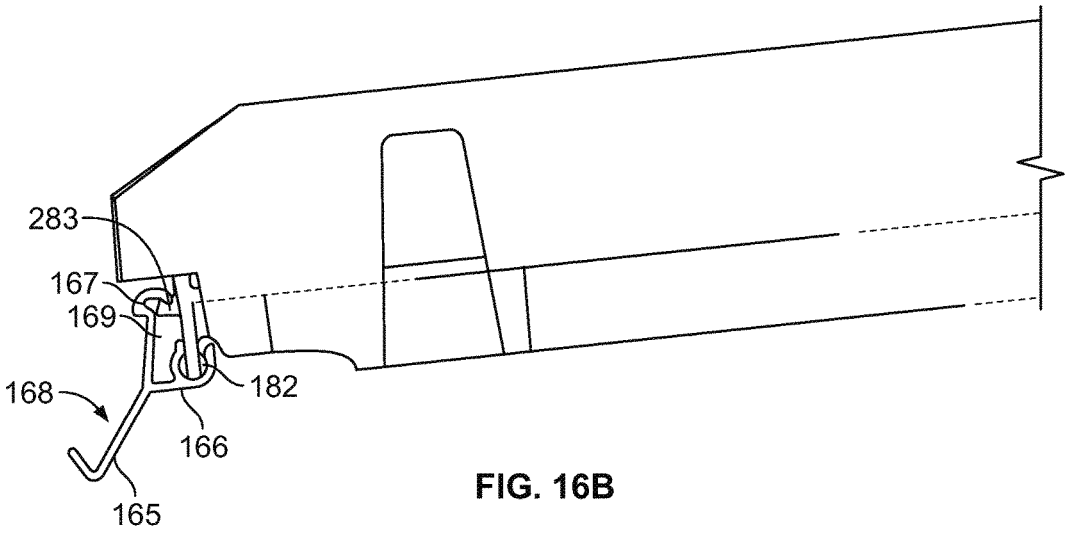
FIGS. 16B-C are left side elevation and cross-sectional views, respectively, of the front of the end bracket of FIG. 14, with the cross-section taken through the center of the bracket and bracket support illustrated in FIG. 16A.
Figure 16C:
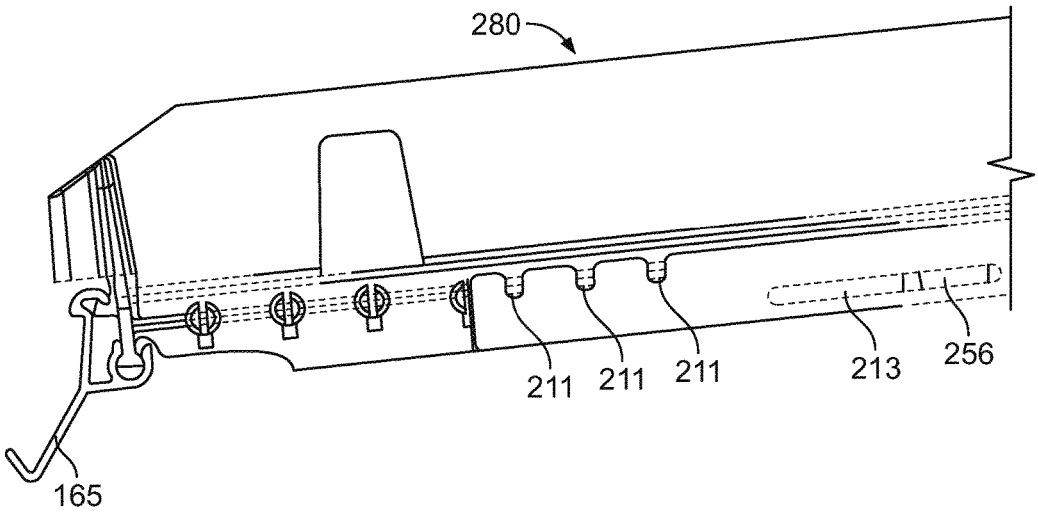
Figure 16D:
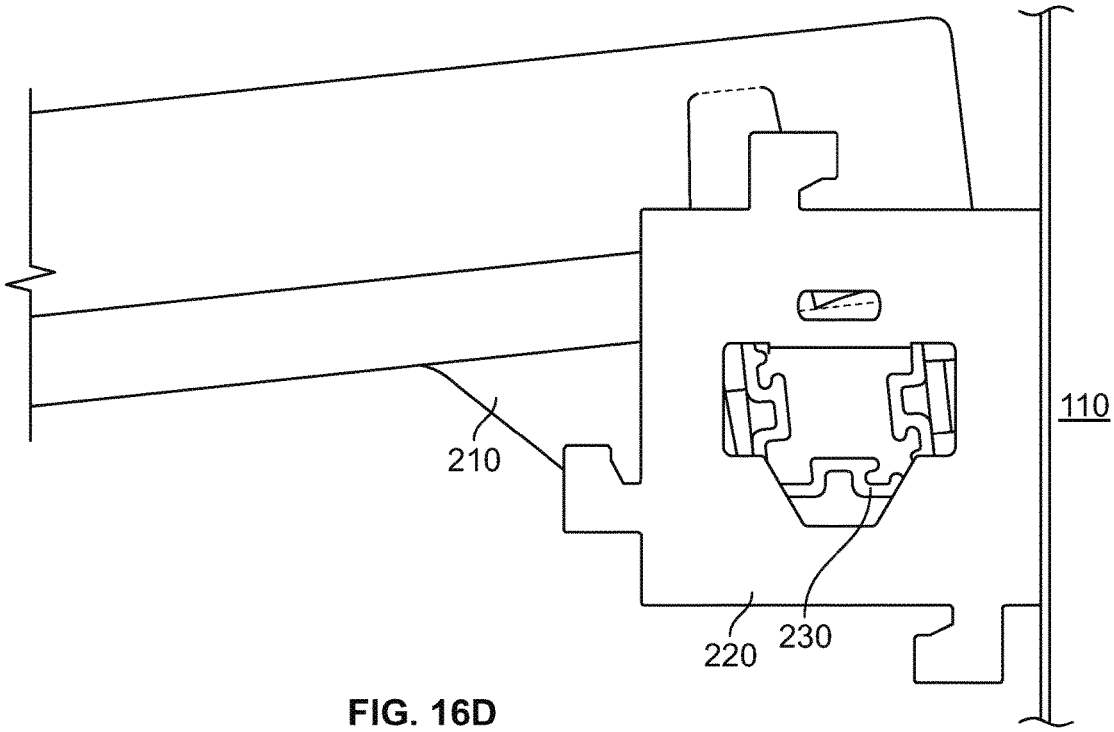
FIGS. 16D-E are side elevation and cross-sectional views, respectively, of the rear of the end bracket of FIG. 14, with the cross-section taken through the center of the bracket and bracket support illustrated in FIG. 16C.
Figure 16E:
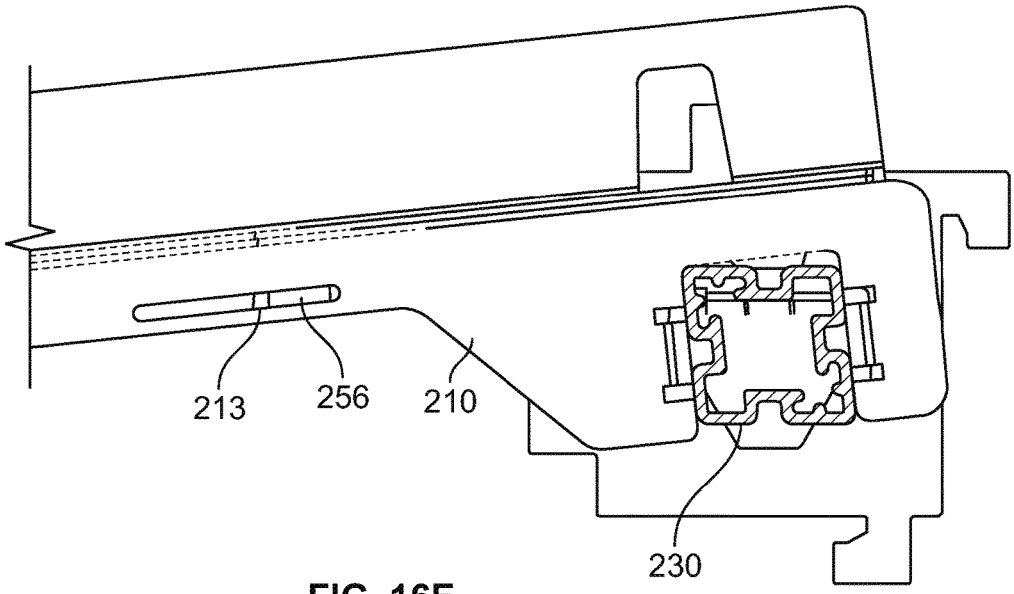
Figure 17A:
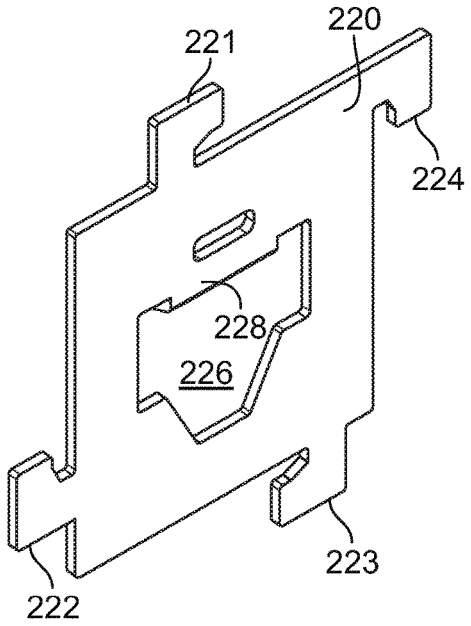
FIGS. 17A-D are left side perspective, right side perspective, front elevation and left side elevation views, respectively, of the mounting bracket illustrated in use with the bar support unit of FIG. 14.
Figure 17B:
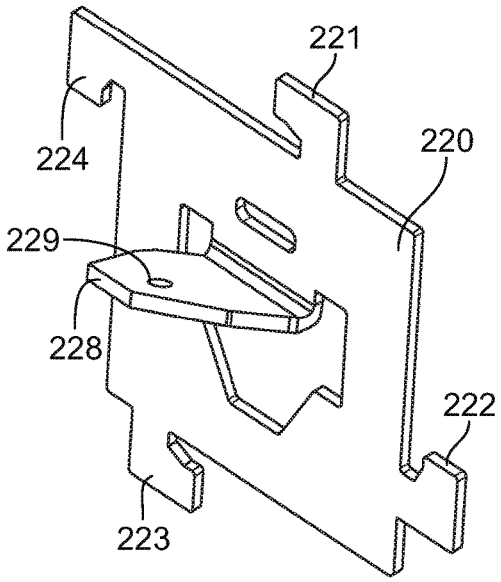
Figure 17C:
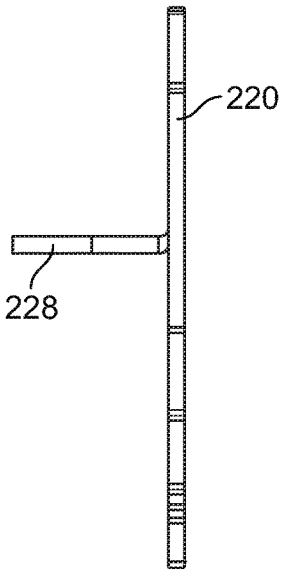
Figure 17D:
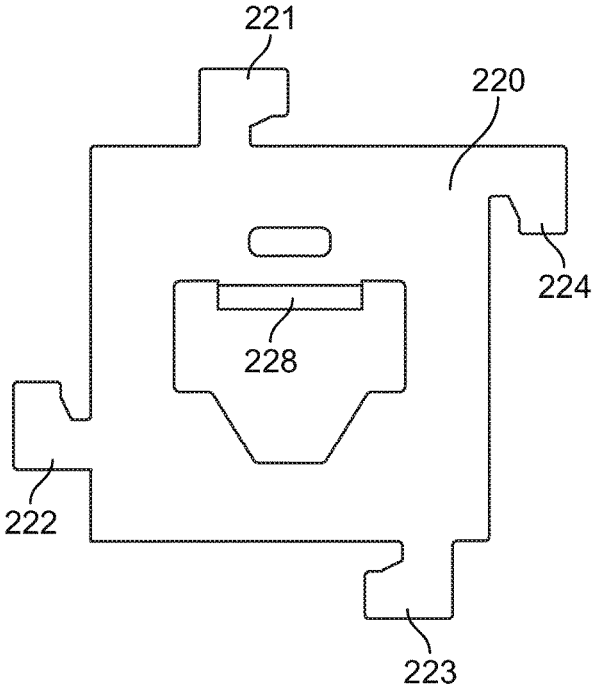

Referring now to FIGS. 15C-E, the mating of the blade 210 to the bar 230 is further described. In a preferred form, the blade 210 is an elongated member formed of metal or similar material using conventional methods (e.g., stamping, pressing, forging, etc.). In other embodiments, the blade 210 is constructed of polymer using any of the previously-mentioned conventional methods. The blade 210 includes notches 211 and groove 213. The blade 210 further includes a C-shaped opening 212 having a width configured to be slightly greater than the distance from one side of the bar 230 to the opposing side of the bar 230. At opposing ends of the C-shaped opening 212, a first and second tongue 214, 216, respectively, having openings 215, 217, respectively, extend perpendicularly from the blade 210.

To slidably mate the blade 210 to the bar 230, the C-shaped opening 212 is placed over the bar 230. A fastener, such as a screw is then inserted through the opening 215 of the first tongue 214 of blade 210 and into a C-shaped channel 231, 233, 235, 237 of bar 230. The screw is then rotated into engagement with the bar 230 to secure the blade 210 into position on the bar 230. Though not required, if so desired for additional stability, the second tongue 216 may be slidably mated to the opposing channel using similar methods. In alternative embodiments, the tongue 214 may slidably mate to any of the four channels 231, 233, 235, 237 in a mating arrangement such as a tongue and groove, dovetail or mortise and tenon configuration, etc.

Figure 25A:
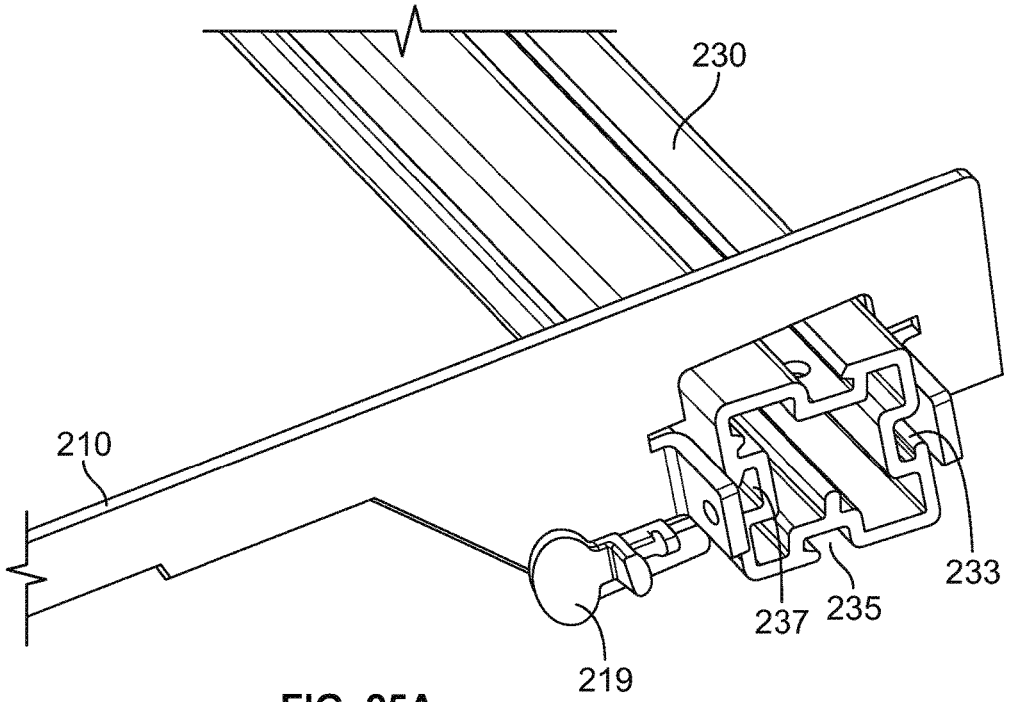
Figure 25B:
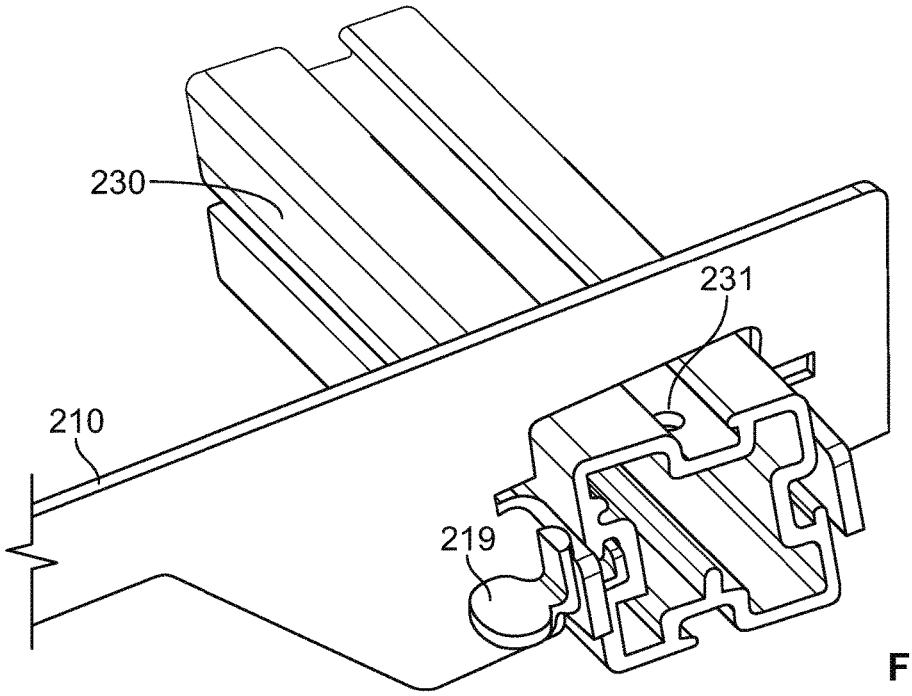

In other embodiments, the blade 210 may be slidably mated to the bar 230 by use of other types of fasteners. For example, in FIGS. 25A-B, a cammed fastener is used to secure the blade 210 to bar 230. More particularly, cam fastener 219 is inserted through opening 215 of first tongue 214 and into C-shaped channel 231, 233, 235 or 237. The cammed fastener 219 is then turned (e.g., twisted a quarter turn) to cam the fastener into engagement with the C-shaped channel of bar 230 to secure the blade 210 into position on the bar 230. A benefit of this embodiment over a regular fastener like those discussed above is that it reduces the risk of damage being done to bar 23 due to over tightening of the fastener (such as over tightening the screw such that it punctures the channel wall of bar 130 which can easily happen if aluminum is used for bar 130). Alternatively, the twisting cam lock can be slid into the C-shaped channel 231, 233, 235, or 237 at either end of the bar 230 prior to securing the rotatable bracket 220 to the bar 230. In other forms, the blade may be slidably secured to the bar 230 after the rotatable bracket 220 is secured to the bar 230. While in the "untwisted" configuration, the blade 210 is free to slide laterally along the bar 230 or be completely removed therefrom if the user so desires.

While it is envisioned that the blade 210 is configured to slide across the entire lateral length of the bar 230 within one of the C-shaped channels 231, 233, 235, 237, it is also envisioned that in some embodiments, the blade 210 is secured to the bar 230 to restrict substantially any lateral movement of the blade 210. For example, a C-shaped channel 231 of the bar 230 may include additional openings which tongue 214 may mate to through a screw or locking pin or other similar apparatuses.

Referring now to FIGS. 4B, 4C, 8B, 15E, 16B, securing the blade 210 to the end brackets 250 and support structures 280 will now be described. In some embodiments, the end brackets 250 and support structures 280 include similar components as in the fixed shelf display 120 discussed above, thus a detailed description of these components will not be further described. In the bar display 202 embodiment, the underside of the end bracket arm 251 and support structure arm 281 include a lower channel 255, 285 extending the longitudinal length of the arm 251, 281 that the elongated edge 218 of the blade 210 inserts into. In some embodiments, this mating between the blade 210 and the arms 251, 281 is a friction fit connection which provides for easy installation and removal.

In other embodiments and as shown in FIGS. 4D, 8B, 15D, 15E, and 16B, the arms 151, 181 include tabs 256, 286 which snap into the grooves 213 of the blade 210. The arms 151, 181 also include at least one clasp or hook that are snap fit into one of the notches 211 of the blade 210. Such a configuration allows the bar display 202 to be configured with varying outward extensions. By inserting the clasp or hook into the different notches 211, the bar display 202 may be configured to extend outwardly at either twenty-one, twenty-one and one half and twenty two inches (21", 21.5" and 22"). Such a configuration allows the retailer to tailor the product extension of upright merchandiser 100 to suit their specific shelf display size and therefor their own individual needs. Conventional shelves typically have a depth of 21", 21.5" or 22".

In some embodiments, the bar support structure 202 includes a pusher or slider assembly 270 used to assist in the automatic facing of products. The configuration and attachment of the pusher or slider assembly 270 is identical to the previously-discussed shelf support structure 120 embodiment. Thus, items ending with the same two-digit suffix (for example, -70, -72, and -74) correspond to the same two-digit suffix as above.

As previously alluded to, because the rotatable bracket 220 has four tabbed protrusions or tangs 221, 222, 223, 224, four different configurations of the bar display 202 are provided. It is understood that in the four configurations, the blade 210 mates to the arms 151, 181 in the same manner as detailed above. Additionally, it is understood that the end brackets 250 and support structures 280 include the same components such as rollers 294 in some embodiments and flat slide bar or belt pieces 297 in other embodiments. Thus, remaining aspects of the bar display 202 are configured in a similar fashion to those of the fixed shelf display 120 embodiment.

Figure 18A:
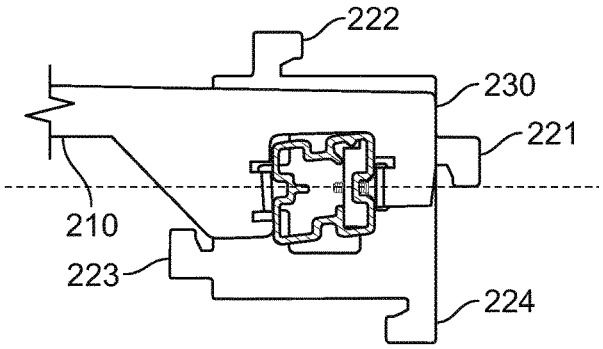
FIGS. 18A-D comprise side elevation views of the mounting bar and bracket of the bar support unit of FIG. 14 with FIG. 18A illustrating the mounting bar and bracket in position to hold the bar support member at an initial horizontal position, FIG. 18B illustrating the mounting bar and bracket in position to hold the bar support member at an angled position, FIG. 18C illustrating the mounting bar and bracket in position to hold the bar support member at a raised horizontal position and FIG. 18D illustrating the mounting bar and bracket in position to hold the bar support member at a raised angled position (noting that the order of these orientations may be reversed so that the mounting bar and bracket start at an initial position that is higher and can be rotated to provide horizontal and angled positions that are lower if desired)

In a first configuration and as seen in FIG. 18A, the bar display is in a first horizontal configuration. In this first configuration, the first tabbed protrusion 221 of the rotatable bracket 220 is inserted into the elongated slots 112. The blade 210, and thus the arms 251, 281 and end brackets 250 and support structures 280 extend horizontally at a first vertical height to display products 205.

Figure 18B:
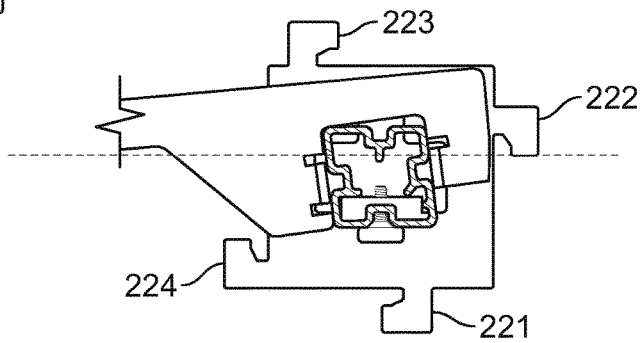

In a second configuration and as seen in FIG. 18B, the rotatable bracket 220 is rotated 90 degrees clockwise relative to the bar 230 and mated thereto using previously discussed methods. In this configuration, the second tabbed protrusion 222 of the rotatable bracket 220 is inserted into the elongated slots 112. The blade 210, and thus the arms 251, 281 and end brackets 250 and support structure 280 extend at a downward angle from horizontal at the first vertical height to display products 205.

In this second configuration, gravitational forces combine with the rollers 294, flat slide bar or belt pieces 297, and pusher or slider assembly 270 to assist in the automatic facing of products 205 discussed previously. In some embodiments, the blade 210, arms 251, 281, and end brackets 250 and support structure 280 extend at a six degree downward angle. In other embodiments, the downward angle is configured to be a value between six and 15 degrees.

Figure 18C:
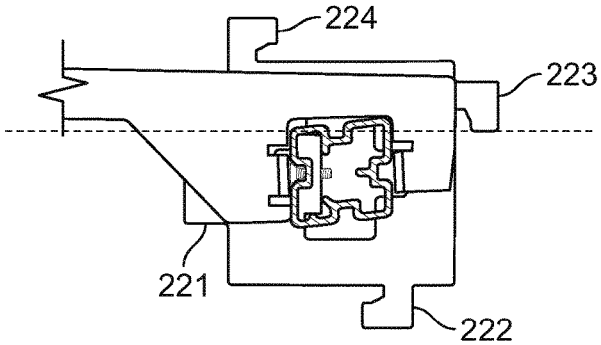

In a third configuration and as seen in FIG. 18C, the rotatable bracket 220 is rotated an additional 90 degrees clockwise relative to the bar 230 from the second configuration, or 180 degrees from the first configuration, and mated thereto using previously discussed methods. In this configuration, the third tabbed protrusion 223 of the rotatable bracket 220 is inserted into the elongated slots 112. The blade 210, and thus the arms 251, 281 and end brackets 250 and support structure 280 extend horizontally at a second vertical height to display products 205.

In some embodiments, mating the third tabbed protrusion 223 to the elongated slots 112 results in a vertical offset half an inch up from the initial configuration. In other embodiments, the initial configuration is this third offset position, thus rotating the rotatable bracket 180 degrees to return to the "first" configuration results in a vertical offset that is half an inch downwards from this configuration.

The half inch vertical offset is beneficial over conventional displays because existing displays are only able to provide display units at one inch intervals which correspond to the spacing of the elongated slots 112 of the upright supports 110. In these conventional systems, unnecessary clearance between the top of the product 205 and the next highest display unit may provide for wasted space. By allowing bar displays 202 to be spaced at half inch intervals as opposed to one inch intervals, vertical clearances may be reduced, thus additional product 205 may be provided on the display by adding additional bar displays 202 to the merchandiser. This configuration may provide retailers with the ability to display more product in the same, limited space, thus solving the common problem of having too much product to be displayed in a given display unit.

It is appreciated that in other embodiments, the amount of vertical offset seen with use of the third tabbed protrusion 223 is only one quarter of an inch in either the upward or downward direction, depending on whether the first or third configurations is viewed as the initial configuration. As above, unnecessary clearance between the top of the product 205 and the next highest display unit is reduced or eliminated.

Figure 18D:
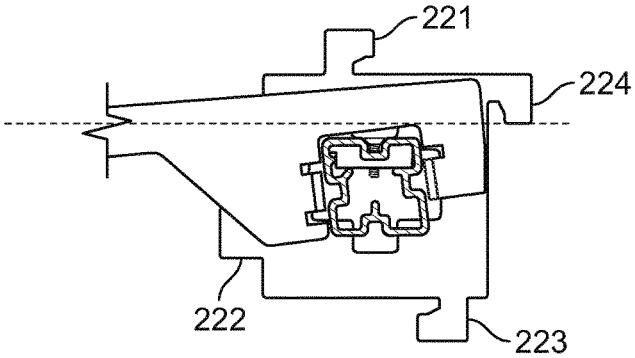
Figure 19A:
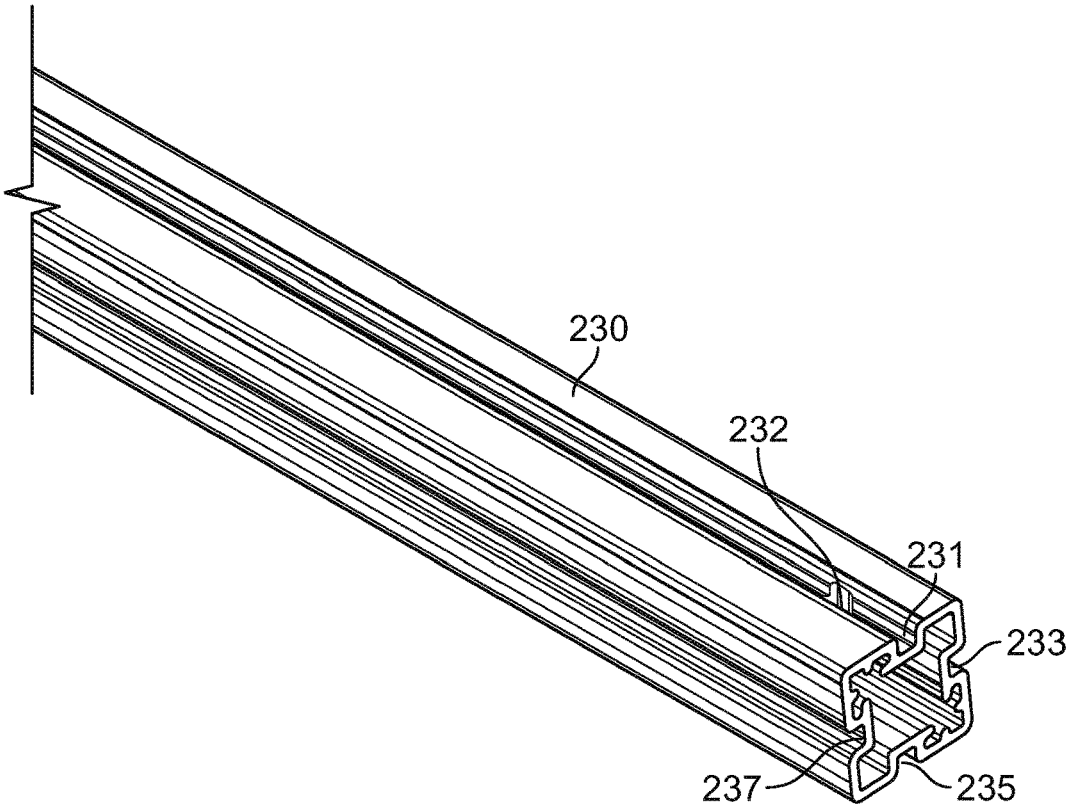
FIGS. 19A-B are perspective and left side elevation views of the mounting bar of FIG. 14.
Figure 19B:
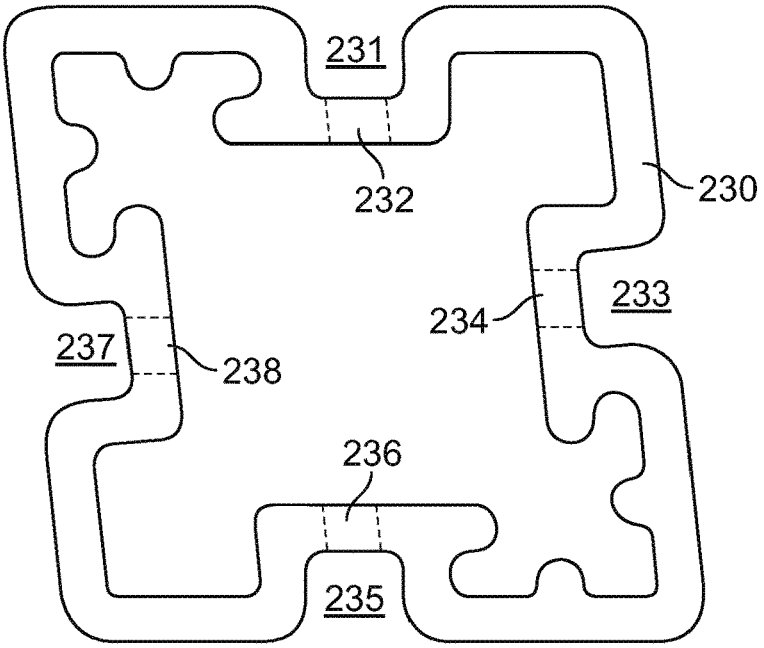
Figure 20:
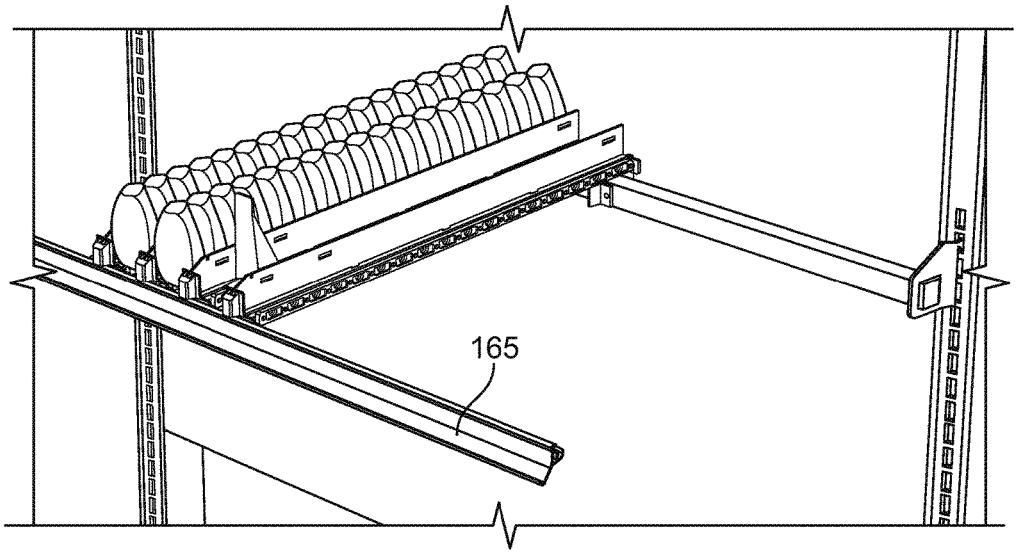
FIG. 20 is a perspective view of an alternate bar support unit in accordance with the invention in which a slide and pusher assembly similar to the slide and pusher of FIGS. 10A-12 is shown used in conjunction with a conventional square bar and mounting bracket.

In a fourth configuration and as seen in FIG. 18D, the rotatable bracket 220 is rotated an additional 90 degrees clockwise relative to the bar 230 from the third configuration, or 270 degrees clockwise from the first configuration, and mated thereto using previously discussed methods. In this configuration, the fourth tabbed protrusion 224 of the rotatable bracket 220 is inserted into the elongated slots 112. The blade 210, and thus the arms 251, 281 and end brackets 250 and support structure 280 extend at the second horizontal height at a downward angle to display products 205.

In this fourth configuration, benefits of the second and third configurations are incorporated to provide for reduced vertical product clearance between display levels as well as taking advantage of gravitational forces to assist the product in automatically facing. It is understood that all of the embodiments of the second and third configurations may also be incorporated into this fourth configuration. For example, using this fourth configuration may result in the vertical offset instead being one fourth of an inch upwards from the first configuration, or the fourth configuration may actually be the first configuration, and rotating to the first configuration results in an offset that is one half or one quarter of an inch lower than the initial configuration.

It is further envisioned that in some embodiments, the pusher or slider assembly 270 is used in configurations where the bar support structure is in its downwardly-angled configuration. In this configuration, gravitational forces combined with the spring force of the pusher or slider assembly 270 will provide an increased ability to automatically face products, thus resulting in a merchandising system that requires little to no retailer assistance to maintain a properly faced display.

In some embodiments and as previously discussed above with regards to the shelf display structure, the bar merchandiser 202 is configured to allow for vertically stacking products 205. The configuration and attachment of the additional partitioning arms 261 are identical to the previously-discussed shelf support display 120 embodiment. Thus, items ending with the same two-digit suffix (for example, -61) correspond to the same two-digit suffixes as above.

In some embodiments and as seen in FIGS. 14, 15A, 15B, and 16A-16B, a price channel 165 is provided at the distal end of the end bracket 150 and arm support member 180. The price channel 165 includes a cylindrical clip portion 166, latch portion 167, first display shelf 168, and second display shelf 169. The price channel 165 rotatably mates to the end bracket arm 151 and/or support structure arm 181 by press fitting the cylindrical clip portion 166 into circular knob 152, 182 of the respective arm 151, 181.

To display a first set of information, generally the price of the product, to the consumer, a price card (not shown) is placed or secured onto the first display shelf 168. The price channel is rotated upwards such that the latch portion 167 secures to the protruding tab 153, 183 of the arm 151, 181, thereby securing the price channel in this configuration. The connection between the latch portion 167 and the protruding tab 153, 183 is friction fit, thus by simply pulling or pushing on the first display shelf 168, the price channel 165 may engage the protruding tab 153, 183 to provide a secure connection or disengage from the protruding tab 153, 183 to allow rotation of the price channel 165.

To display the second set of information, typically a barcode pertaining to the product stocked on the product display, the price channel 165 is rotated downwards such that the second display shelf 169 is outwardly visible. The user (typically an employee of the retailer) then has access to the information contained on the second display shelf 169 and may use this information as appropriate. Examples of information contained on the second display shelf 169 include, but are not limited to, bar codes for use with a scanning device to track product stock, item descriptions, and similar information.

Figure 22:
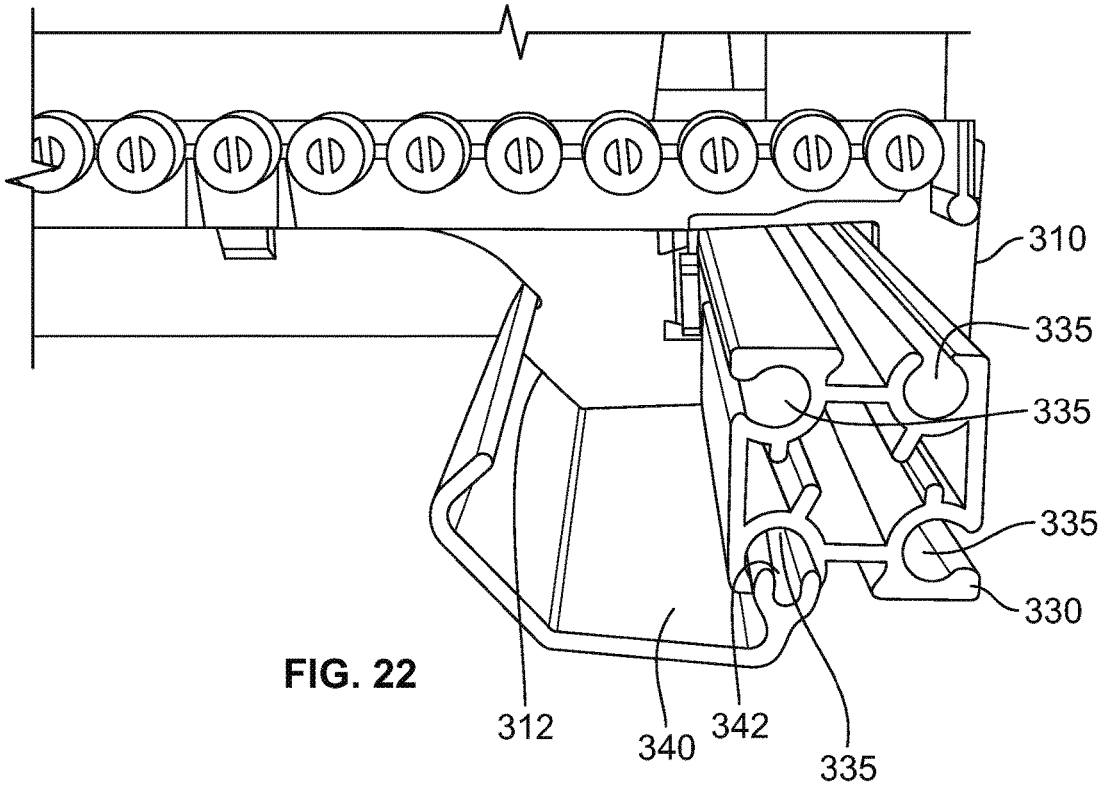
FIG. 22 comprises a side perspective view of an alternate mounting bar and bracket for a bar support unit in accordance with aspects of the invention in which a single pivotable stabilizing member is used to secure the support arms in position along the mounting bar.

In further embodiments, and as seen in FIG. 22, the bar 330 is configured to mount with the blade 310 as follows. The bar 330 includes a plurality of additional cylindrical locking channels 335 configured to engage with a locking extrusion 340. The locking extrusion 340 includes a rotatable locking member 342 configured to snap fit into any of the cylindrical locking channels 335. The locking extrusion 340 also includes a locking edge 346 configured to mate with a locking portion 312 of the blade 310.

In operation, one or more blades 310 are placed on the bar 330, and the rotatable locking member 342 is snap-fit into one of the cylindrical locking channels 335. The locking extrusion 340 is then rotated upwards so the locking edge 346 mates with the locking portion 312.

In this embodiment, one or more blades 310 may quickly be mounted or removed from the bar 330 by simply rotating the locking extrusion 340 in the desired direction. Such a configuration is advantageous in configurations where the blade 330 may not be easily mounted to the bar 330 using previously described methods due to the use of different materials which may damage one or more of the components.

Figure 23A:
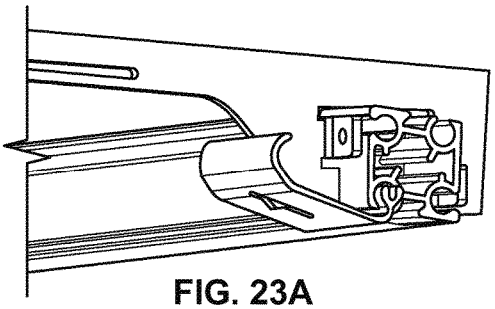
FIG. 23A-B are front perspective and side elevation views, respectively, of an alternate mounting bar and bracket for a bar support unit in accordance with aspects of the invention in which an alternate pivoting stabilizer is used to secure each support arm in position along the mounting bar.
Figure 23B:
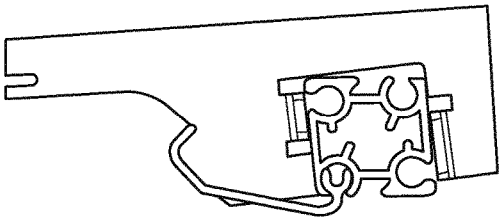
Figure 24A:
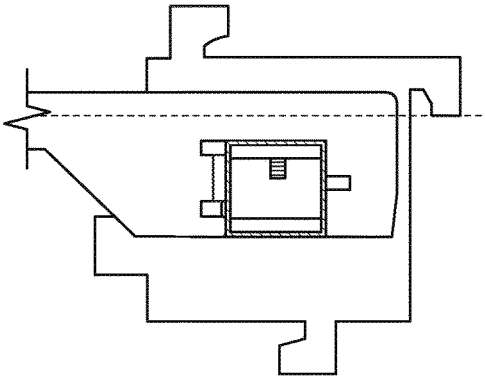
FIGS. 24A-D are side elevation views of an alternate mounting bar and bracket for a bar support unit in accordance with aspects of the invention inch which a multi-positional mounting bracket is used to position a conventional square mounting bar in four different positions with each position allowing the support bar to be raised or lowered a predetermined amount of distance (a reference line has been added transcending all figures to illustrate how ninety degree rotations of the mounting bracket result in corresponding changes in the positioning of the support bar)
Figure 24B:
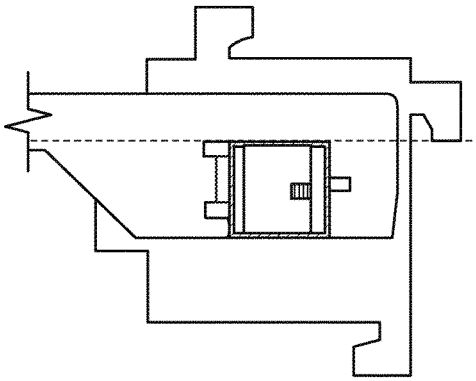
Figure 24C:
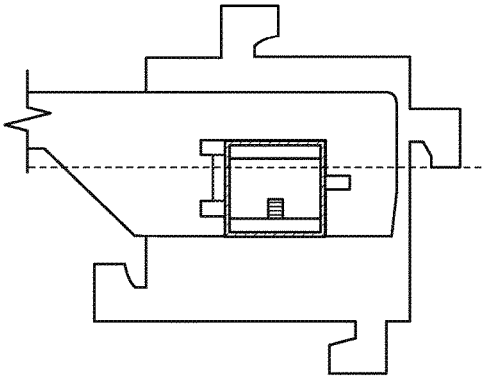
Figure 24D:
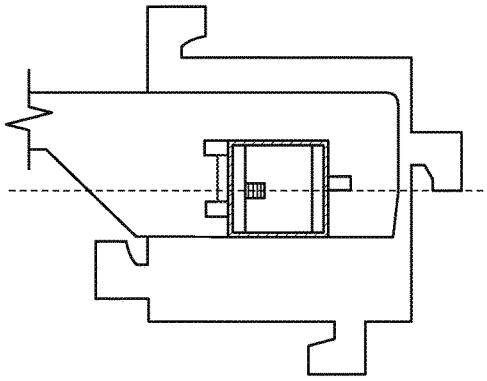

In further embodiments, and as illustrated in FIGS. 23A-B, the bar is configured with the plurality of cylindrical locking channels configured to engage with the locking extrusion in a manner similar to that described above with respect to the single locking extrusion of FIG. 22. In the embodiment of FIGS. 23A-B, a plurality of locking extrusion are provided with each locking extrusion configured to engage a single locking portion of a blade, and each define or include an opening for engaging a notch contained on the blade.

It is appreciated that in other embodiments, such as those illustrated in FIGS. 24A-D, an alternative rotatable bracket is incorporated. In this embodiment, rotating the rotatable bracket 90 degrees)(90° and mating the tabbed protrusion to the elongated slots of the vertical support structure or gondola results in a vertical offset of one quarter of an inch (0.25") upwards from the initial configuration. Rotating the gondola an additional 90 degrees) (90° and mating the tabbed protrusion to the elongated slots of the gondola results in a vertical offset of an additional quarter of an inch (0.25") for a total vertical offset of half an inch (0.5"), and rotating the gondola an additional 90 degrees)(90° will result in a vertical offset of a further quarter of an inch (0.25") for a total vertical offset of three quarters of an inch (0.75"). This configuration provides additional customization of height of the support structures while still being constrained by the interval between slots of conventional gondolas (e.g., which are typically 1" increments), and accommodates products having varying product dimensions. It is understood that the amount of vertical offset created by rotating the rotatable bracket may be in either the upward or downward direction, depending on what is considered the initial configuration. Unnecessary clearance between the top of the product 205 and the next highest display unit is therefore reduced or eliminated.

In some embodiments, the tabbed protrusions or tangs on the rotatable mounting brackets include a tapered opening area. This configuration accommodates vertical risers or gondolas having different thicknesses, thus allowing the universal merchandiser to be integrated into various existing gondola configurations.

Turning to FIGS. 26-35, alternate universal merchandiser assemblies are provided. It is understood that portions of the alternate universal merchandiser assemblies may have similar features to those previously discussed, thus these similar features will not be discussed in further detail. As illustrated in FIGS. 26A-J, an alternate universal merchandiser assembly 2600 having a lockable dampened pusher is described. The assembly 2600 includes an integrated toothed track or rack 2697 for accommodating the pusher thereon to guide products towards the front of the arm support (or divider) 2680. In some forms, the rack 2697 may be formed integrally with the arm support 2680. In other embodiments, the rack 2697 remains an add-on attachment which snaps onto protrusions in the arm support 2680 as previously described. The assembly 2600 also includes a damper assembly 2678 which serves to partially offset the spring force used to urge the pusher towards the front of the assembly 2600. The damper assembly 2678 may include a damper housing 2678A and a damper 2678B which may be any type of conventionally known damper having gear teeth which engage the teeth of the rack 2697. The damper 2678B may be immersed in any type of viscous fluid (not shown) to further offset the spring force used to urge the pusher forwards.

The damper housing 2678A include at least one tab to be insertably coupled with the pusher 2670. As such, the damper assembly 2678 may be used as an add-on or retrofit device that may be installed on the assembly as desired by the user. The damper housing 2678A further includes notches or protrusions on opposing sidewalls thereof to accommodate the damper 2678B. These notches are symmetrical to each other, thus the damper housing 2678A may be placed on either side of the support arm and the damper rotated to couple to the damper housing 2678A. So configured, a single damper assembly 2678 may be used, thereby reducing overall manufacturing costs. Advantageously, the damper assembly 2678 requires no tools to install or remove, which may result in minimal installation time.

The damper assembly 2678 is configured to be in line with the pusher spring and pusher 2670 to reduce or eliminate torque on the pusher. In other words, an axis of the damper 2678B is collinear with an axis of the pusher 2670. Because the pusher 2670 is coupled to and traverses on the rack 2697 as opposed to being offset, it is vertically in line with the damper 2678B which in turn causes forces to be exerted along this same line.

The assembly 2600 further includes a pusher release mechanism 2693 having a rod 2693A which may extend a substantial length of the arm support 2680 and a hold-release apparatus 2693B configured to hold and release the pusher 2670.

Figure 26A:
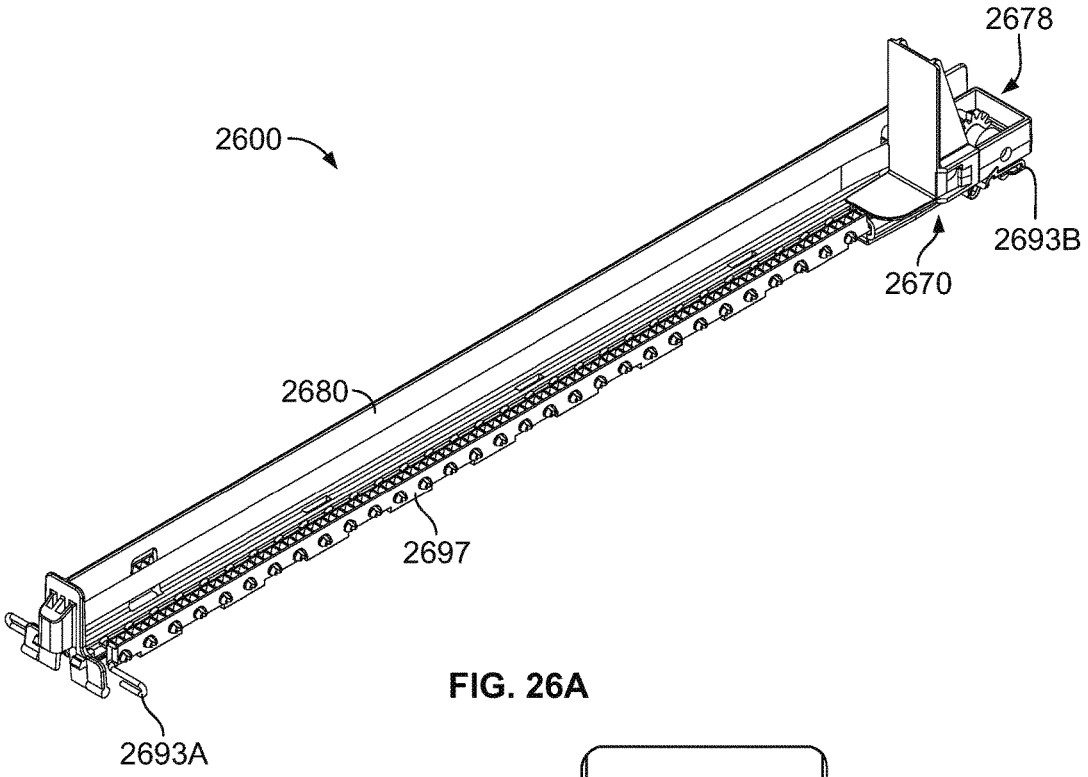
FIGS. 26A-D are perspective, front elevation, left side elevation and bottom views, respectively, of an alternate universal merchandiser assembly with a lockable dampened pusher as configured in accordance with various embodiments of the invention, with FIGS. 26C and 26D having break lines to allow for larger images to be shown with more detail.
Figure 26B:
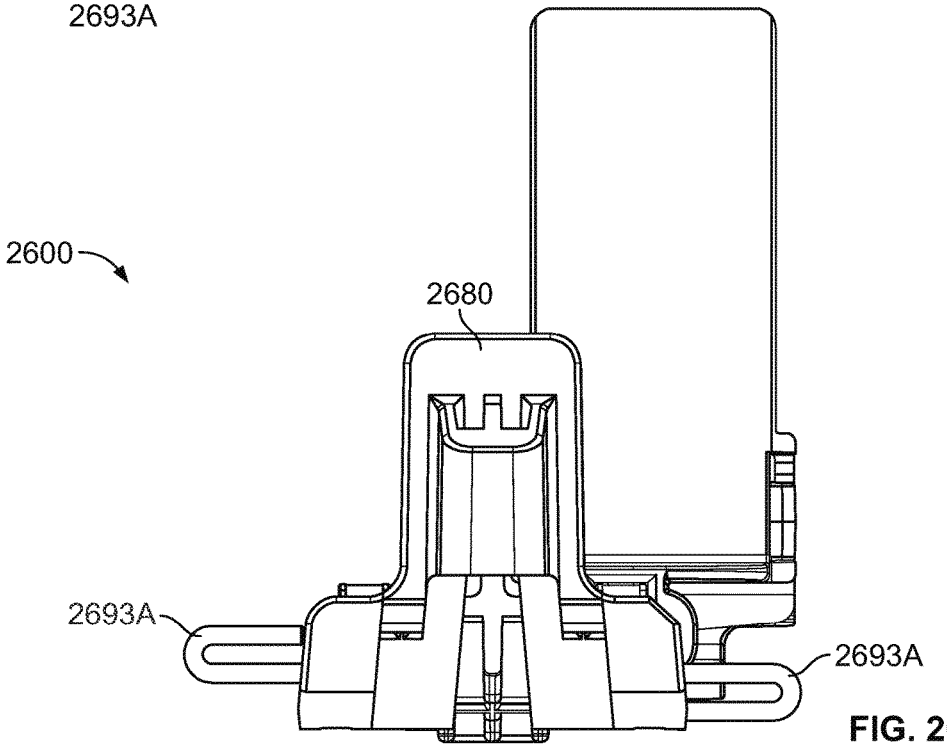
Figure 26C:
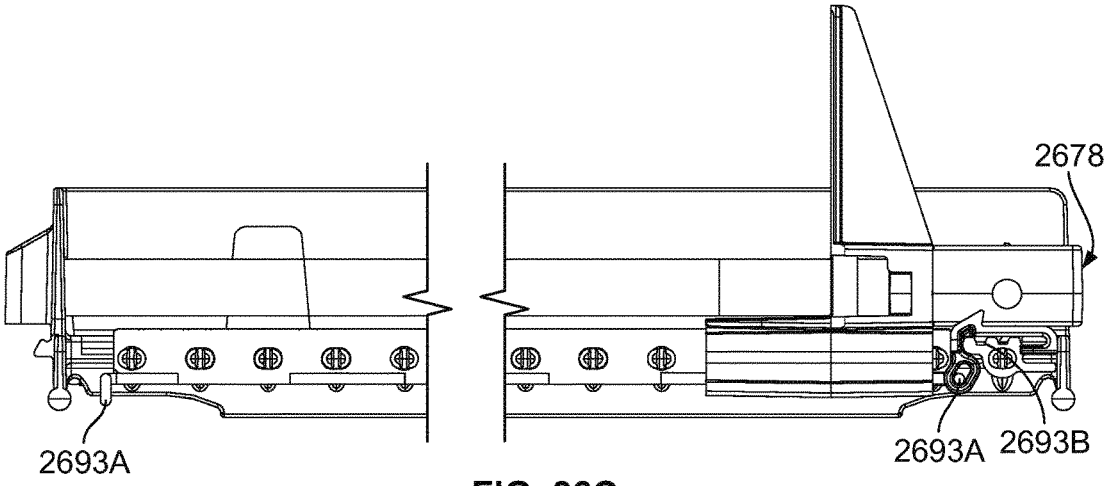
Figure 26D:
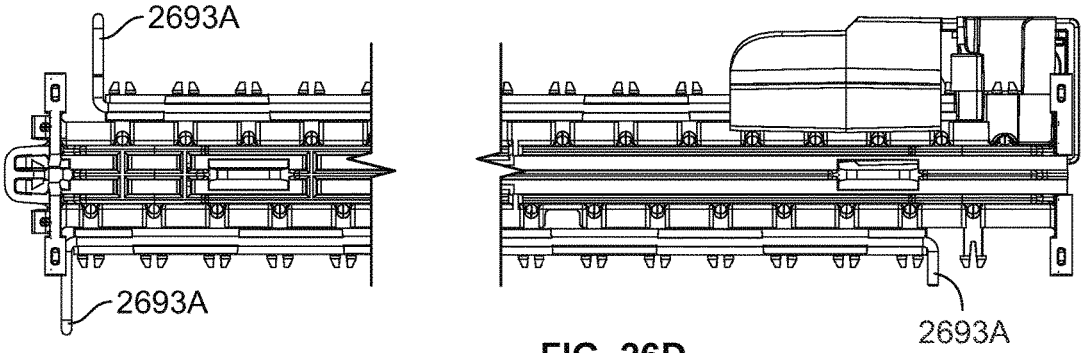

As illustrated in FIGS. 26A and C, the rod 2693A is integral to the rack 2697 used by the damper assembly 2678. The rod 2693A extends the length of the rack 2697 and is inserted into an opening in the hold-release apparatus 2693B. The hold-release apparatus 2693B may be made of a deformable material such as a polymer and is configured to deform to secure and release the damper assembly 2678.

Figure 26E:
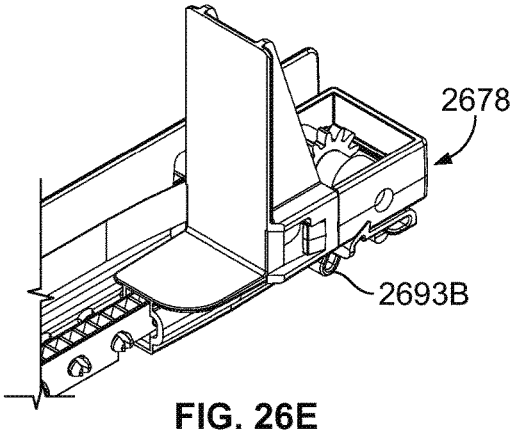
FIGS. 26E-F are enlarged perspective views of the pusher assembly of FIGS. 26A-D illustrating part of an exemplary and optional lock mechanism in locked and released positions, respectively.

In operation, the pusher may be pushed to the rear portion of the arm support 2680 as desired by the retailer (for example, to stock products to be supported by the support arm). As seen in FIGS. 26E and G, the damper housing 2678A includes a mating recess or notch which engages the hold-release apparatus 2693B to lock the damper assembly 2678 and pusher 2670 in place. It is understood that in some examples where the damper assembly 2678 is not used, the pusher 2670 may include a similar notch to engage the hold-release apparatus 2693B.

Figure 26F:
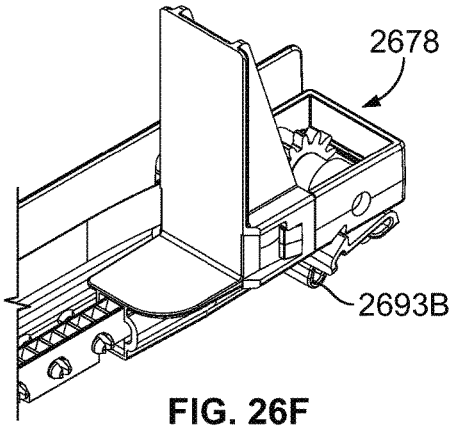
Figure 26G:
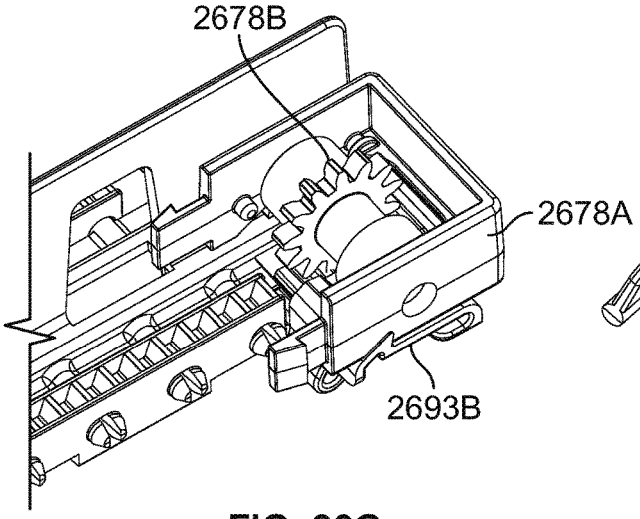
FIGS. 26G-H are enlarged partial perspective views of the rear carriage portion of the universal merchandiser of FIGS. 26A-F (illustrated without the pusher in FIG. 26G), showing how the damper mates with the pusher and how the internal damper components are connected to the carriage and how the carriage is symmetrical to allow the internal components to be connected in a mirror image orientation for use on the opposite side of the divider.
Figure 26H:
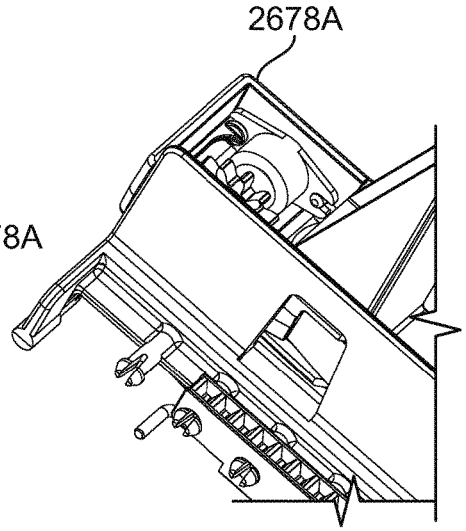

As illustrated in FIGS. 26A and F, when the user wishes to release the pusher 2670 and damper 2678, they may engage the rod 2693A by pressing on the loop portion thereof to cause the rod to rotate about its central longitudinal axis (being supported by the rack 2697). This rotation causes the end that engages the opening in the hold-release apparatus 2693B to rotate as well, which in turn causes the hold-release apparatus 2693B to lower as seen in FIG. 26F and disengage the pusher 2670 and damper 2678. As such, the user may disengage the pusher without having to physically reach the rear of the arm support 2680 which may be difficult to access due to interfering stocked products.

Figure 26I:
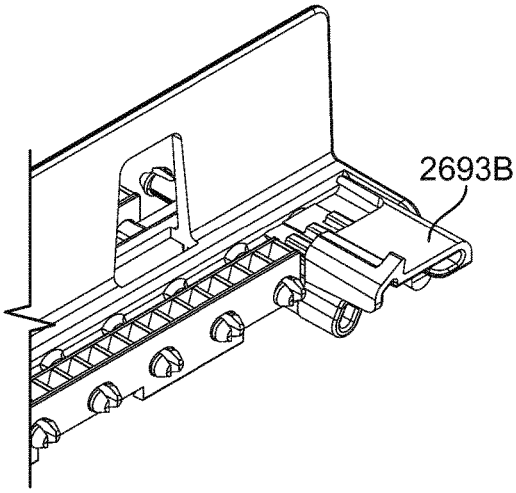
FIGS. 26I-J are enlarged partial perspective and left side elevation views, respectively, of the lock mechanism and glide bar of FIGS. 26A-H, illustrating how the lock mechanism and glide bar cooperate to form the track for the damper (see FIG. 26I) and how the lock mechanism is connected to the rear of the universal merchandiser bracket and release mechanism (see FIG. 26J)
Figure 26J:
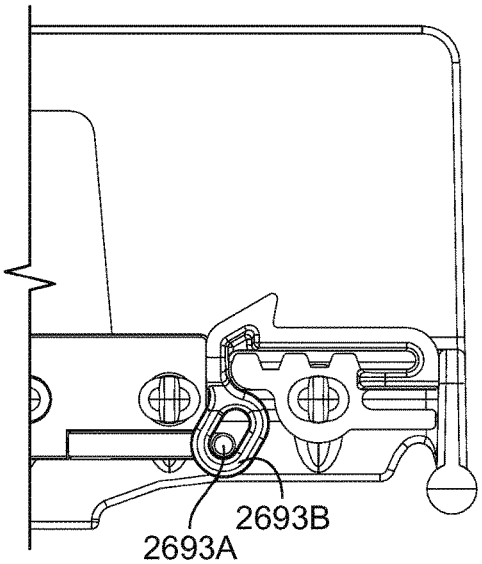

Additionally, as seen in FIG. 26I, the hold-release apparatus 2693B includes a flattened portion which may form a part of the rack 2697 and at least partially support the damper assembly 2678. So configured, the ability to move the pusher 2670 and damper assembly 2678 to a rearmost point on the arm 2680 is maximized.

So configured the assembly 2600 may have an integral damper rack, pusher release mechanism, and damper attachment are provided to reduce the number of components used in a product display.

Figure 27A:
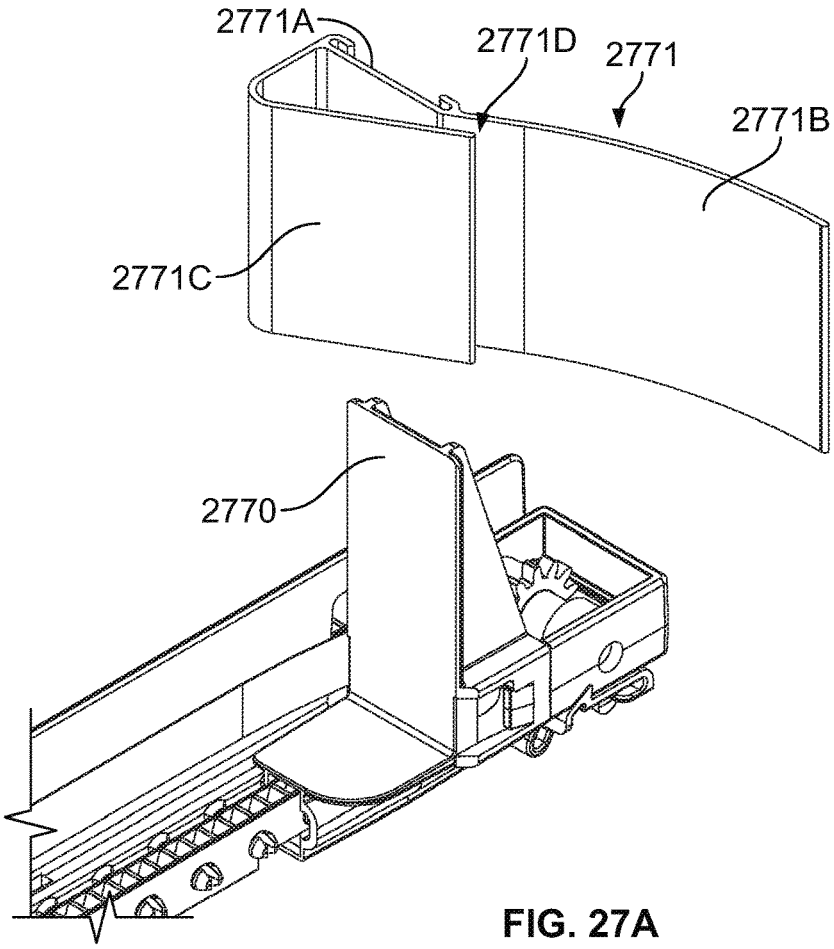
FIGS. 27A-C are perspective views of exemplary pusher accessories that may be mounted onto the pusher to assist front facing of certain products so that the merchandiser can be customized and readily changed to accommodate specific product being pushed, with FIG. 27A illustrating the pusher and an exemplary accessory having an open area to separate a first and section portion which assists in the manufacturing thereof and FIGS. 27B-C illustrating alternate exemplary accessories.
Figure 27B:
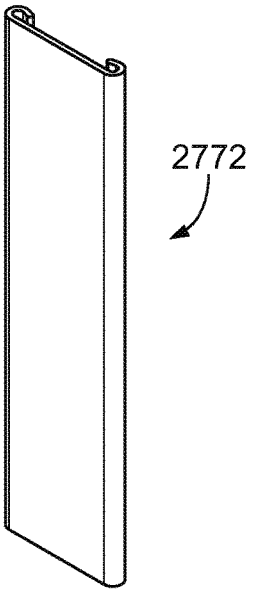
Figure 27C:
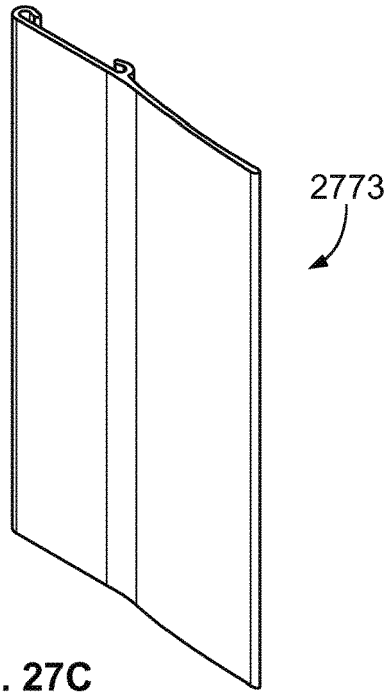

Turning to FIGS. 27A-C, exemplary pusher accessories are provided that may be mounted onto the pusher to assist front facing of products. The pusher accessories may be made of polymers or any similar materials. The pusher accessory 2771 illustrated in FIG. 27A includes a mating portion 2771A, a first portion 2771B, and a second portion 2771C separated by a gap 2771D. The mating portion 2771A is configured to slidably couple to the front face of the pusher 2770. The first portion 2771B includes a concave surface to accommodate front facing curved packages. To more easily mold the pusher accessory, the first and second portions 2771B, 2771C define a gap 2771D therebetween.

The pusher accessory 2772 illustrated in FIG. 27B is a double-high accessory which may be used with taller products to increase the surface area of the pusher face. Similarly, the pusher accessory 2773 illustrated in FIG. 27C is a double-high, double-wide accessory which may be used with generally larger products. So configured, the merchandiser may be customized and readily modified to accommodate the specific product being pushed.

Figure 28A:
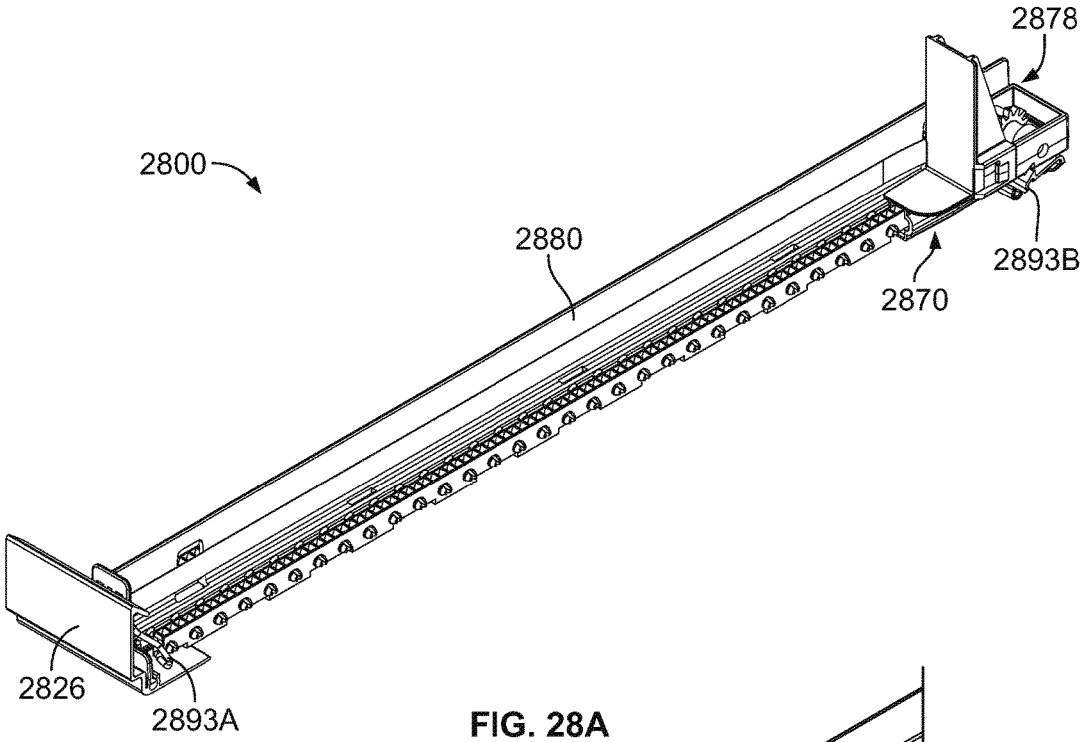
FIG. 28A is a perspective view of an alternate exemplary embodiment of a universal merchandiser assembly in accordance with various aspects of the invention illustrating an alternate embodiment of the release mechanism.
Figure 28B:
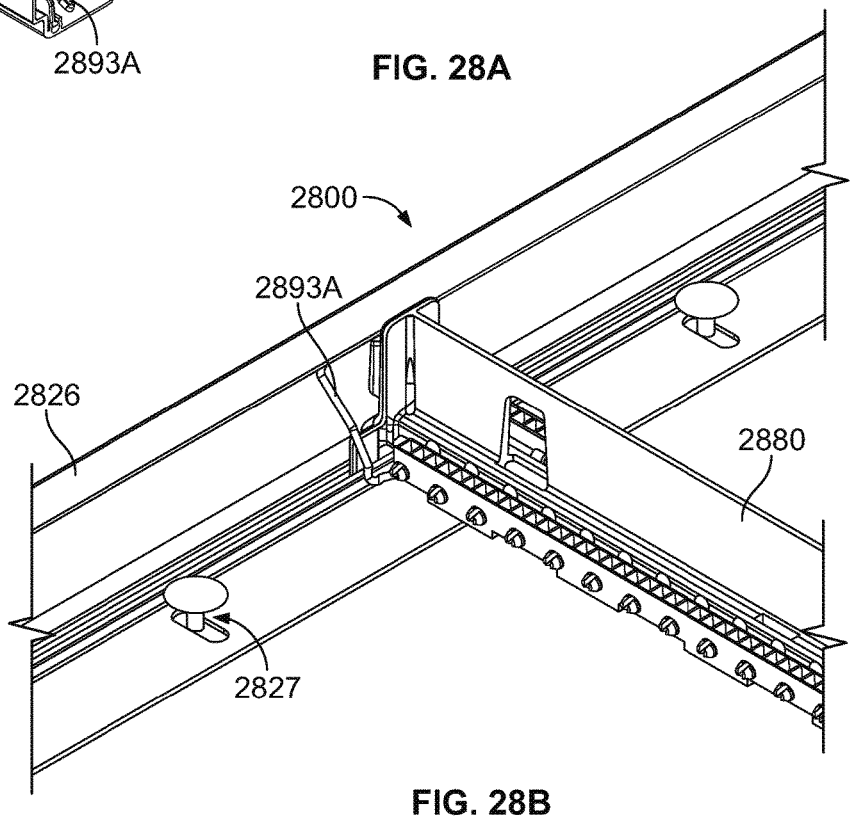
FIG. 28B is an enlarged rear perspective view of the front of the universal merchandiser assembly of FIG. 28A illustrating how it connects into the front mount and how the front mount connects to a shelving unit.
Figure 28C:
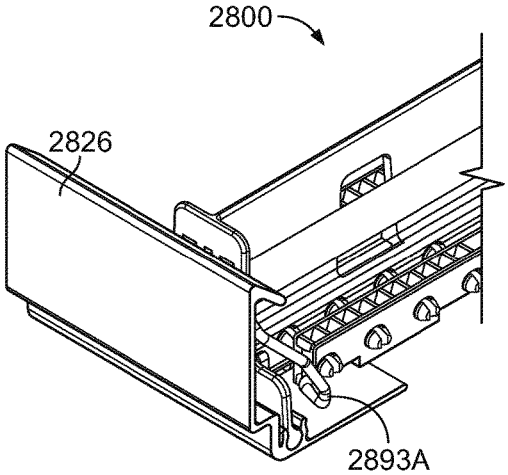
FIGS. 28C-D are enlarged perspective and side elevation views of the front of the universal merchandiser assembly of FIGS. 28A-B illustrating in greater detail the alternate embodiment of the release mechanism.

Turning to FIGS. 28A-D, an alternate exemplary embodiment of a universal merchandiser assembly 2800 illustrating an alternate release mechanism 2893A, B in which the front mount 2826 integrally contains a portion of pusher release mechanism. As illustrated in FIG. 28B, the front mount 2826 is mounted to a shelf at mounting portions 2827 using any known method such as bolts, push-in connectors, and the like. The front mount 2826 may include a price channel which may be used to display information relating to the product, the retailer, and/or any other information.

Figure 28D:
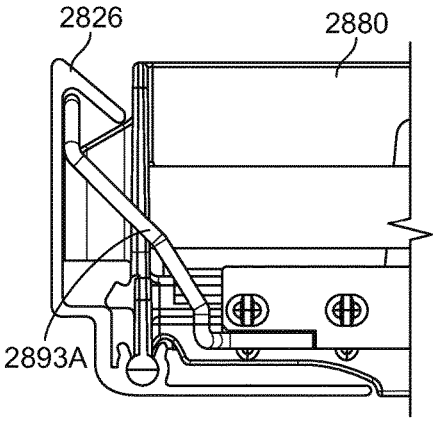

As seen in FIG. 28D, the front mount 2826 includes a hooked surface to engage the rod 2893A. As with the embodiment of FIG. 26, the rod traverses the length of the divider or support arm 2880 and terminates at the rear portion thereof to be inserted into an opening in the hold-release apparatus 2893B. This hold-release apparatus 2893B may be made of a deformable material such as a polymer and is configured to deform to secure and release the damper assembly 2878.

In operation, the pusher 2870 and damper (if installed) 2878 may be pushed to the rear portion of the arm support 2880 as desired. The damper housing 2878 includes a mating recess or notch that engages the hold-release apparatus 2893B to lock the damper assembly 2878 and pusher 2870 in place. It is understood that in some embodiments where the damper assembly 2878 is not used, a similar notch may be included on the pusher 2870.

When the user wishes to release the pusher 2870 and damper assembly 2878, they may simply push or pull the front surface of the front mount 2826. Applying a force to the front surface in turn causes the rod 2893A to rotate such that at the rear portion of the support arm 2880, the hold-release apparatus 2893B is lowered, thereby disengaging the pusher 2870 and damper assembly 2878.

Figure 29A:
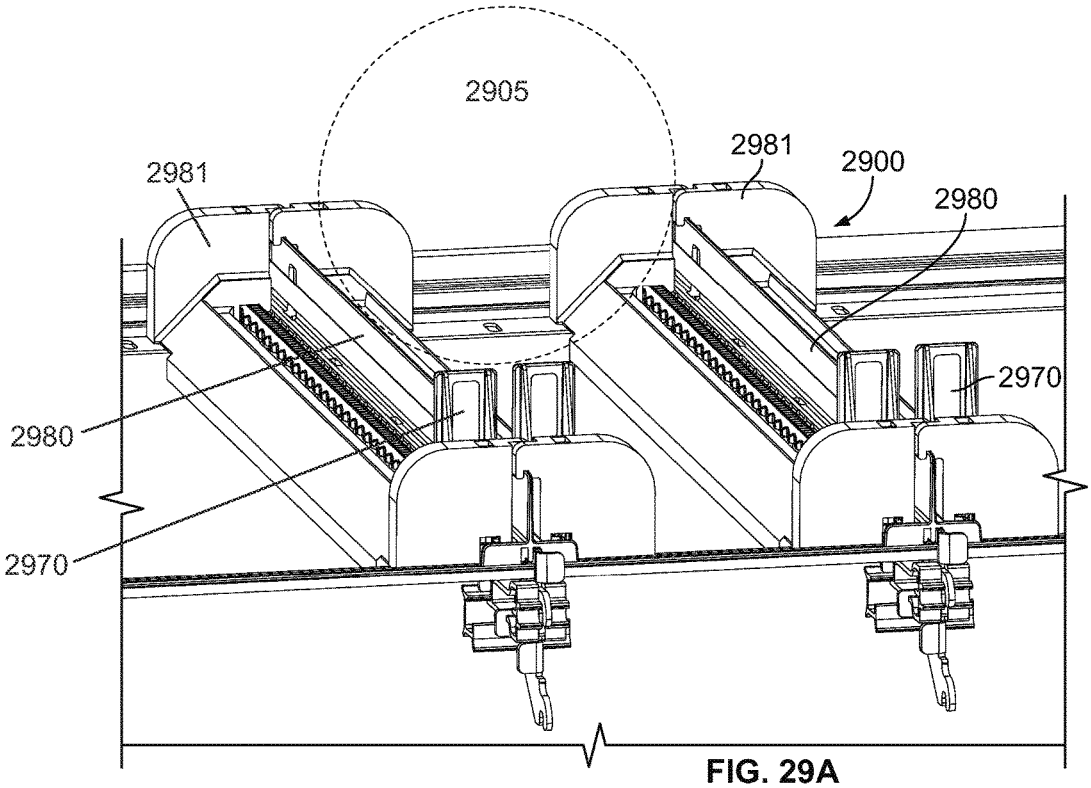
FIGS. 29A-B are rear and front perspective views, respectively, of an alternate universal merchandiser assembly in accordance with another embodiment of the invention, with FIG. 29A illustrating a product divider assembly having two product holders or slides on opposite sides of the divider and FIG. 29B illustrating a cleaner front perspective view of just the product holders or slides showing how the structures engage one another and the universal merchandising assembly
Figure 29B:
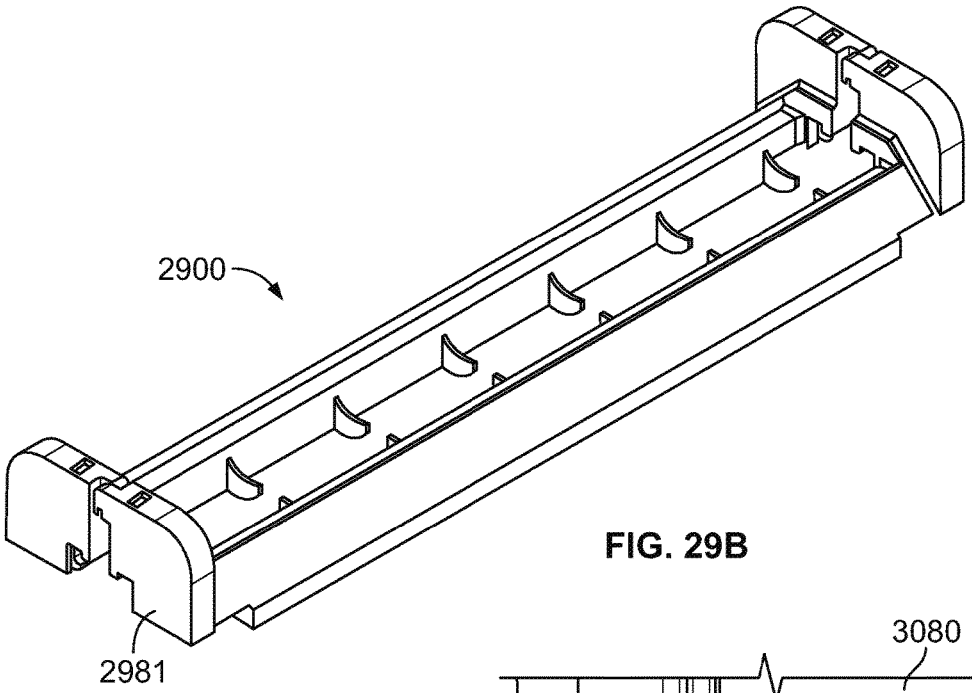

Turning to FIGS. 29A-B, an alternate universal merchandiser assembly 2900 is provided which includes a product divider assembly having two product holders or slides 2981 on opposing sides of the support arm 2980. These product holders 2981 are angled so as to allow products having different shapes to be front faced. As a non-limiting example, the product holders 2981 may accommodate a pizza 2905 placed between opposing support arms 2980.

The product holders 2981 may include a recess for disposing a pusher 2970 therein to assist in front facing the product.

As illustrated in FIG. 29B, adjacent product holders 2981 engage with each other via corresponding groove arrangements. Due to their symmetrical configurations, the product holders 2981 may be used on either side of the support arm 2980.

Figure 30B:
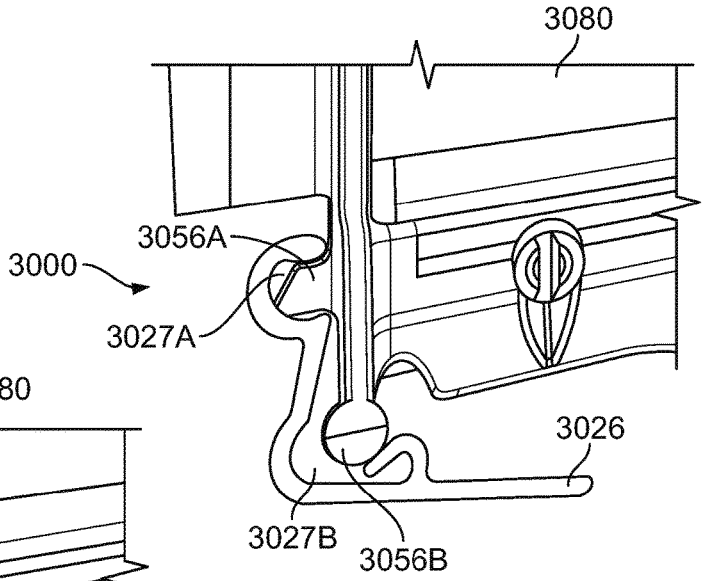
FIGS. 30A-B are enlarged side elevation views of the front of an alternate universal merchandiser assembly in accordance with another embodiment of the invention, with FIG. 30A illustrating a product divider assembly being engaged with a front portion of a rail to prevent and/or limit lateral movement along the rail, and FIG. 30B illustrating the product divider assembly being partially disengaged with the front portion of the rail to allow lateral movement along the rail while still being partially secured thereto.
Figure 30A:
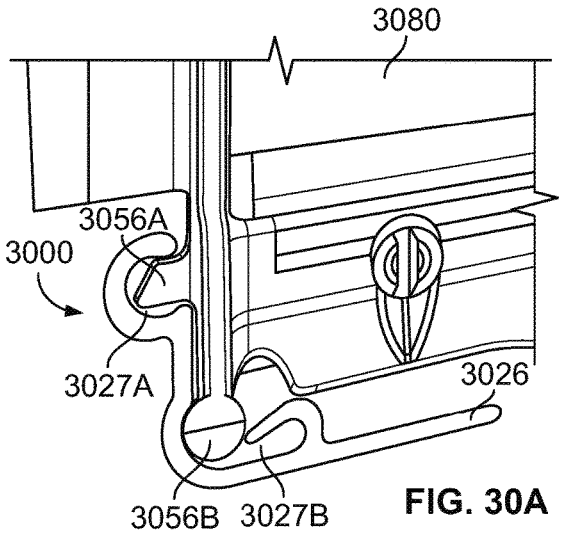

Turning to FIGS. 30A-B, an alternate universal merchandiser assembly 3000 is provided where the divider or support arm 3080 is movable between a first and second position to restrict or allow lateral movement along a rail. The assembly 3000 includes a first and second elongated channel 3027A, 3027B contained on the front shelf mount 3026. The support arm or divider assembly 3080 includes corresponding first and second mounting portions 3056A, 3056B. It is understood that while the channels and mounting portions provided in FIGS. 30A-B are of the tongue and groove sort, any type of engagement mechanism may be employed in other examples.

As seen in FIG. 30A, when the second mounting portion 3056B is engaged with the second elongated channel 3027B, a frictional force restricts lateral movement of the support arm 3080 along the longitudinal length of the front shelf mount 3026. Upon moving the support arm 3080 from this first position to the second position illustrated in FIG. 30B, the second mounting portion 3056B disengages the second elongated channel 3027B such that the support arm 3080 is only being supported by the first elongated channel 3027A. In some examples, a portion of the second elongated channel 3027B may be deformable to assist in disengaging the second mounting portion 3056B.

As such, the support arm 3080 may be moved laterally along the front shelf mount 3026 to accommodate products having different sizes without disturbing any products that may be currently supported by the support. Further, because of the dual engagement between the arm 3080 and the front shelf mount 3026, the frictional forces between the two may restrict any lateral movement of the support arm 3080.

Figure 31A:
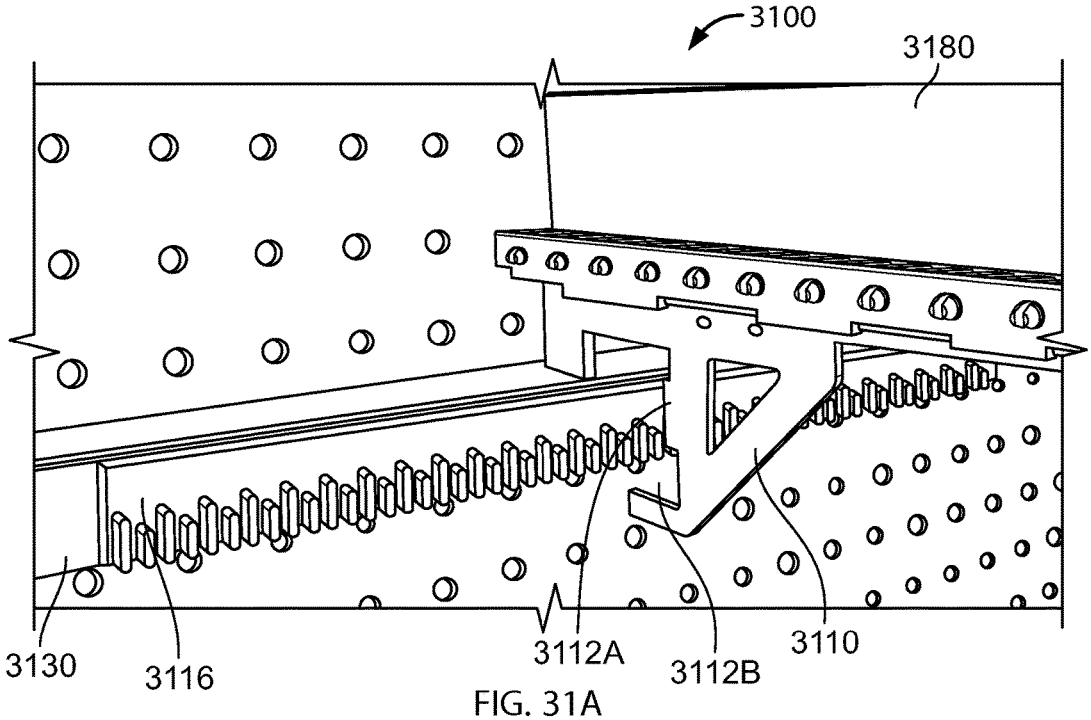
FIGS. 31A-C are enlarged perspective views of the rear of an alternate universal merchandiser assembly in accordance with another embodiment of the invention, with FIG. 31A illustrating a product divider assembly having an opening that is disengaged from a toothed or combed support structure, FIG. 31B illustrating the product divider assembly being in a raised, partially disengaged position to still allow lateral movement of the divider assembly along the length of the combed support structure, and FIG. 31C illustrating the divider assembly being in a lowered engaged configuration whereby lateral movement of the divider assembly is minimized due to engagement with the combed support structure.
Figure 31B:
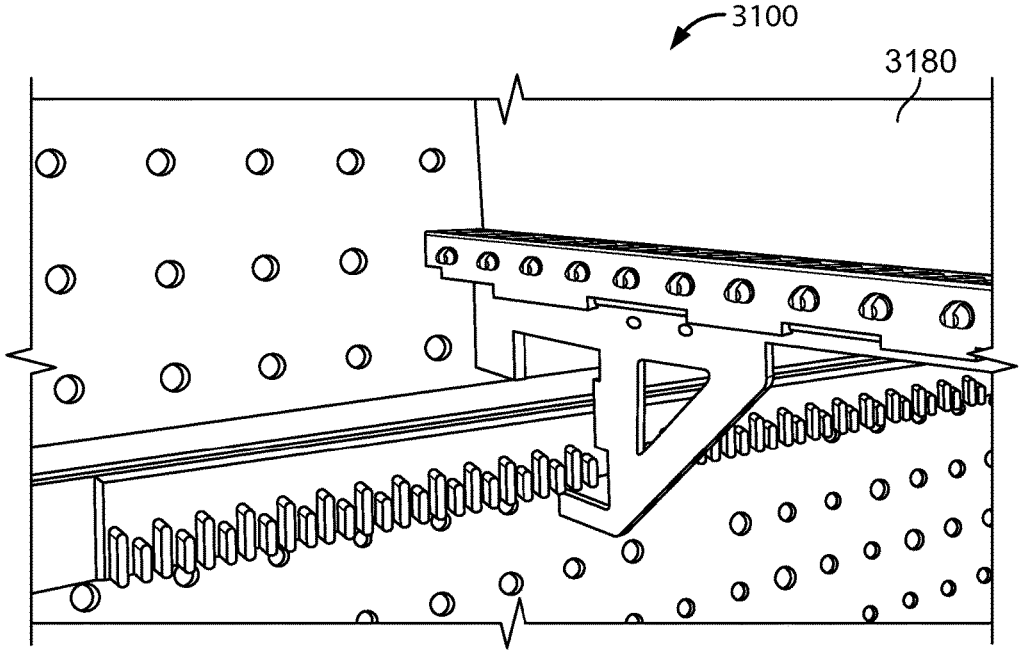
Figure 31C:
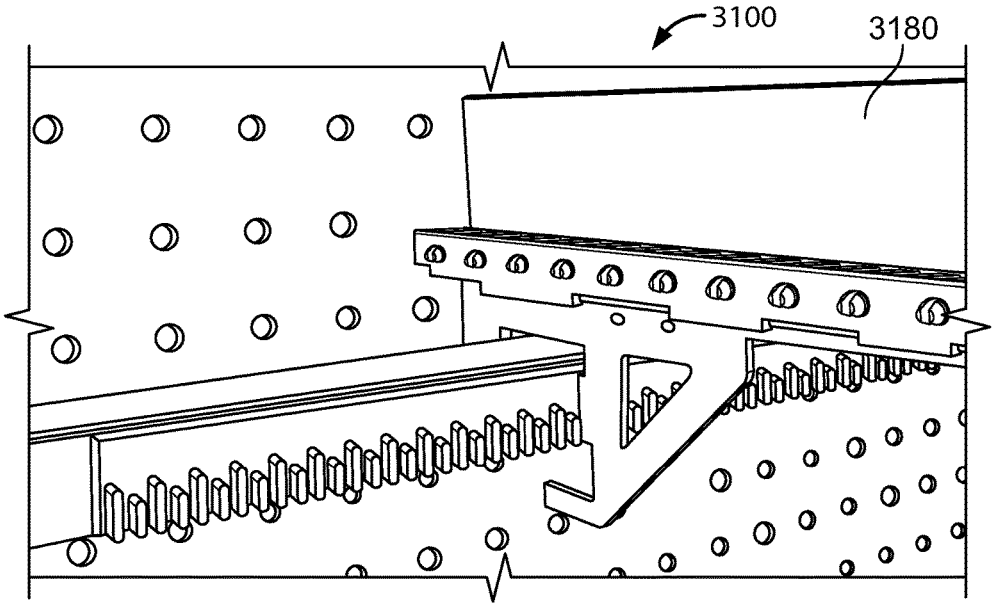

Turning to FIGS. 31A-C, an alternate universal merchandiser assembly 3100 is provided having a rear stabilizer 3116 configured to be disposed on a vertical surface of the bar 3130 to limit lateral and rotational movement of the support arm or divider 3180. The blade 3110 which is coupled to the support arm 3180 includes an engagement region 3112A and a disengagement region 3112B. The rear stabilizer 3116 includes any number of teeth which protrude therefrom to create a number of stabilizing surfaces.

The rear stabilizer 3116 may be mounted to the bar 3130 using any conventional method. For example, the bar 3130 may have offset bores or holes which corresponding pegs, notches, screws and the like may be inserted into. Other examples are envisioned such as adhesives and/or fasteners. The rear stabilizer 3116 may have opposing angled end configurations allowing for multiple rear stabilizers 3116 to be placed adjacent to each other while maintaining a desired distance between teeth.

As seen in FIG. 31A, the support arm 3180 is in a completely disengaged configuration allowing the support arm 3180 to move freely relative to the bar 3130. In FIG. 31B, the blade is in a raised configuration in which it is partially engaged with the bar 3130 such that the teeth of the rear stabilizer 3116 do not contact the blade. As such, the blade 3110 and support arm 3180 may move along a lateral length of the bar.

As illustrated in FIG. 31C, the blade 3110 is in a lowered and supported position where the engagement region 3112A is in contact with the teeth of the rear stabilizer 3116. In this position, the blade 3110 and support arm 3180 are restricted from laterally moving along the bar 3130. Further, this configuration stabilizes the support arm 3180 by reducing and/or eliminating any shifting or tilting which may occur during stocking or removal of a product. When a user wishes to reposition the support arm 3180, they may simply lift up the rear end of the support arm so the teeth of the rear stabilizer 3116 are within the disengagement region 3112B and slide the support arm 3180 to a new desired position.

It is understood that in some alternate examples, the rear stabilizer 3116 may be disposed on the horizontal top surface of the bar 3130. As described above, the rear stabilizer 3116 may be secured to the bar 3130 using any number of known methods. In these examples, by lifting the rear portion of the support arm 3180 up so that it is not engaged with the teeth allows the support arm 3180 to be moved laterally along a length of the bar 3130.

Figure 32:
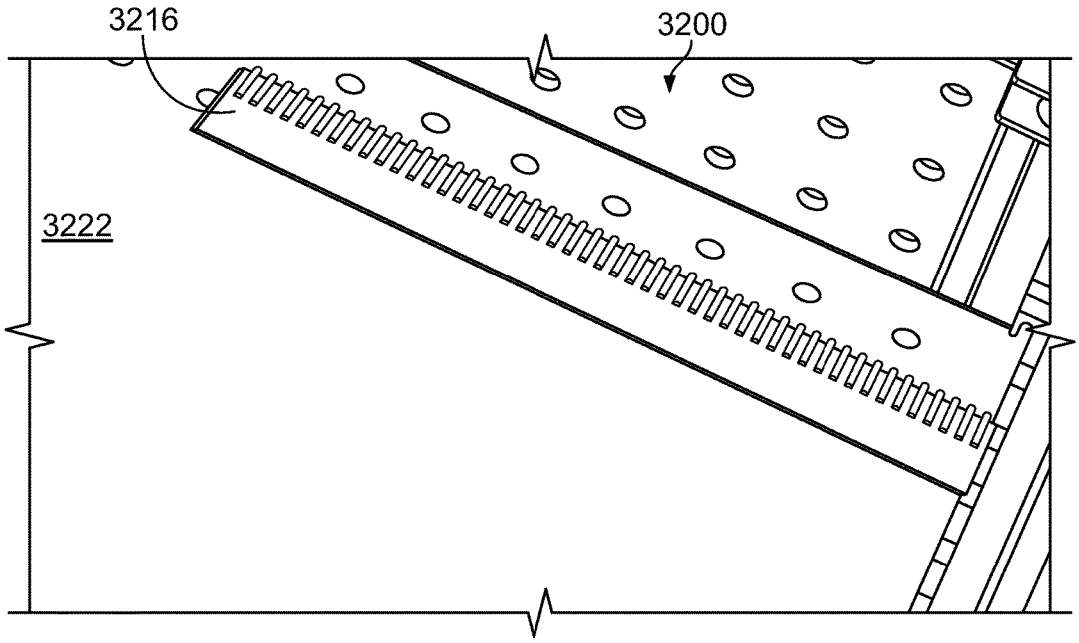
FIG. 32 is a perspective view of an alternate combed support structure for a shelf-based universal merchandiser assembly.

FIG. 32 illustrates an alternate universal merchandising assembly 3200 in which a rear stabilizer 3216 is mounted on a shelf 3222. In this assembly 3200, the rear end of a support arm (not shown) may simply be raised from a first engaged position such that the teeth or combed protrusions do not contact a lower surface of the support arm. As such, lateral movement along the shelf may occur when raised in this disengaged second position.

Figure 33A:
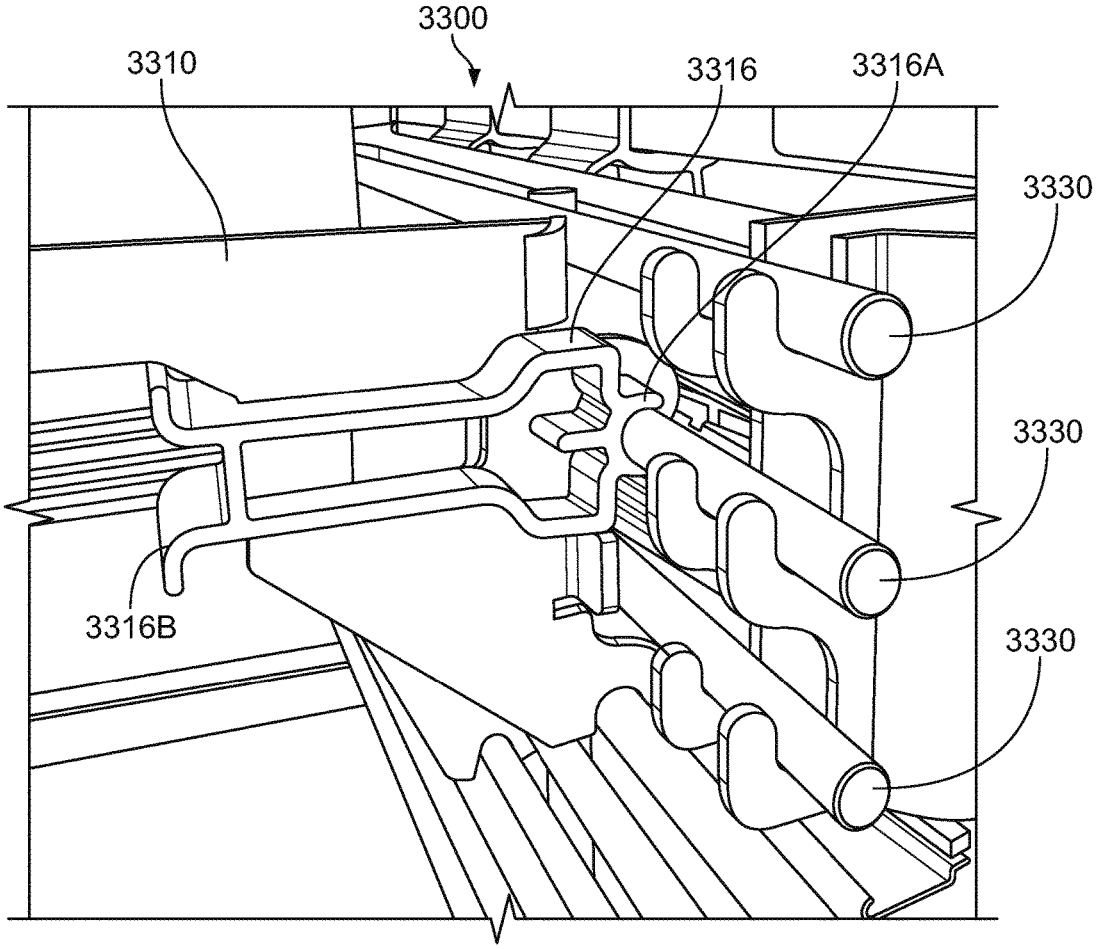
FIGS. 33A-C are enlarged perspective and side elevation views of the rear of an alternate universal merchandiser stabilizing assembly being used in a grid-type merchandising environment in accordance with another embodiment of the invention, with FIGS. 33A-B illustrating a divider assembly being secured by the stabilizing mechanism and FIG. 33C illustrating the stabilizing mechanism being disengaged from the divider assembly to allow movement of the divider assembly.
Figure 33B:
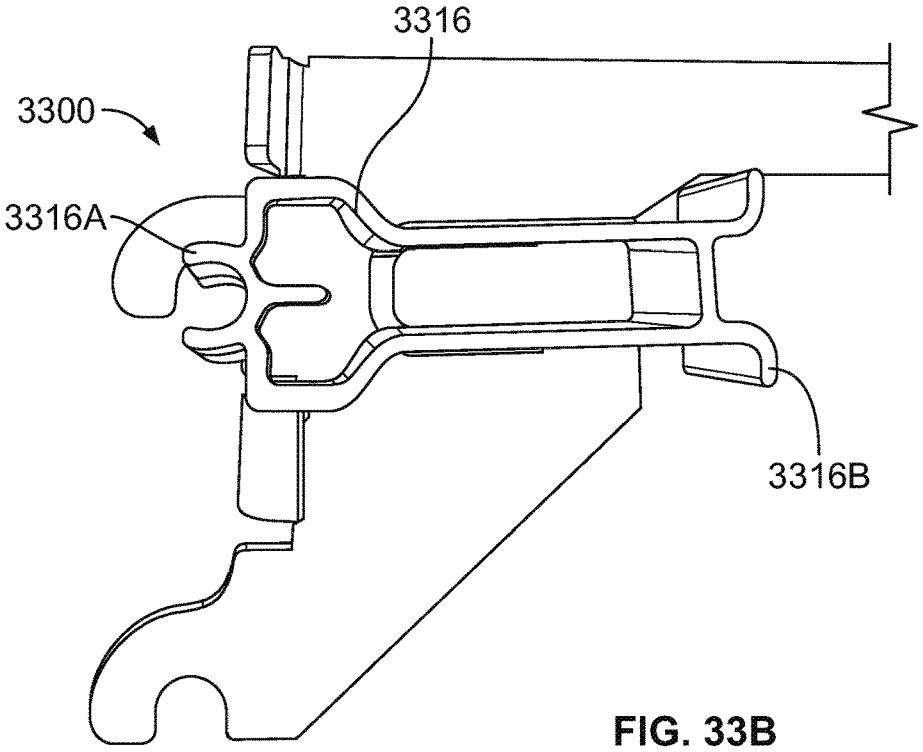
Figure 33C:
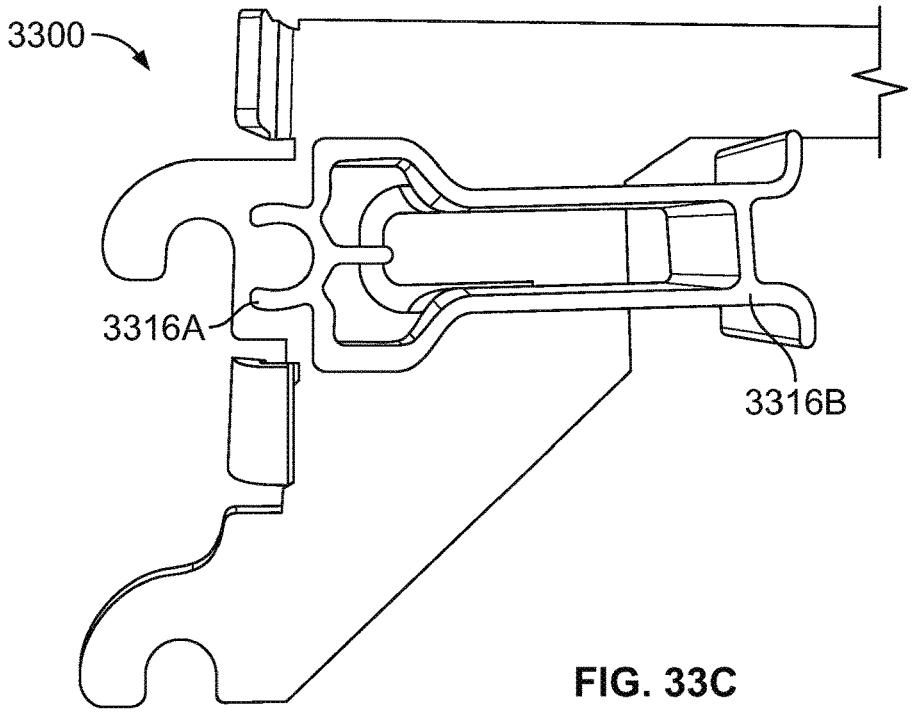

FIGS. 33A-C illustrate an alternate universal merchandising assembly 3300 in which a rear stabilizer is used in a grid-type display. The assembly 3300 includes a plurality of horizontal bars 3330, a blade 3310 configured to couple to at least one horizontal bar 3330, and a rear stabilizer 3316. The rear stabilizer 3316 has an engagement portion 3316A on a first side thereof which frictionally couples to the horizontal bar 3330, a disengagement device 3116B which may include a protrusion for pushing or pulling the rear stabilizer 3316, and a slotted portion (not shown) for accepting a length of the bar 3310 therein.

As illustrated in FIGS. 33A-B, the rear stabilizer 3316 is in a first engaged position. In this position, the engagement portion 3316A is frictionally fit into one of the horizontal bars 3330 such that lateral movement of the blade 3310 is resisted due to the frictional force between the bar 3330 and the engagement portion 3316A.

As illustrated in FIG. 33C, the rear stabilizer 3316 is in a second disengaged position. To disengage the rear stabilizer 3316, a user pulls, the disengagement device 3316B away from the bar 3330 such that the bar 3330 is removed from the engagement portion 3316A. As such, the blade 3310 may freely slide across a lateral distance of the bar 3330 to accommodate products having different sizes.

FIGS. 34A-34G illustrate an alternate universal merchandising assembly 3400 having an integral pusher and damper assembly 3470, an integral pusher track and damper rack 3497, a low profile front shelf mount or rail 3426 with a pusher release mechanism 3493, and a rear stabilizer 3416 to reduce or eliminate tilting and/or lateral movement of the universal merchandising assembly 3400.

Figure 34A:
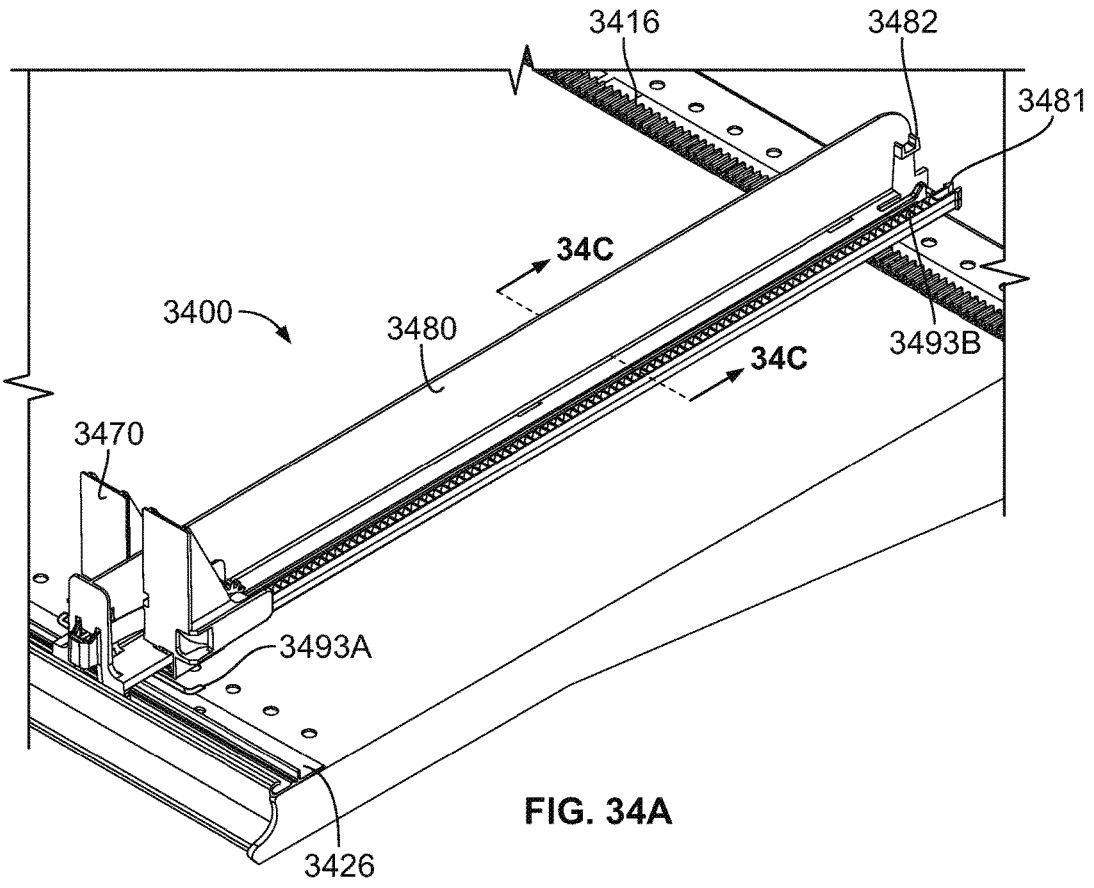
FIGS. 34A-C are perspective, enlarged perspective, and cross sectional views of an alternate universal merchandiser assembly having an integral pusher track and damper rack, with FIGS. 34A-B illustrating a low profile front rail and a pusher release mechanism, and FIG. 34C illustrating the pusher release mechanism.
Figure 34B:
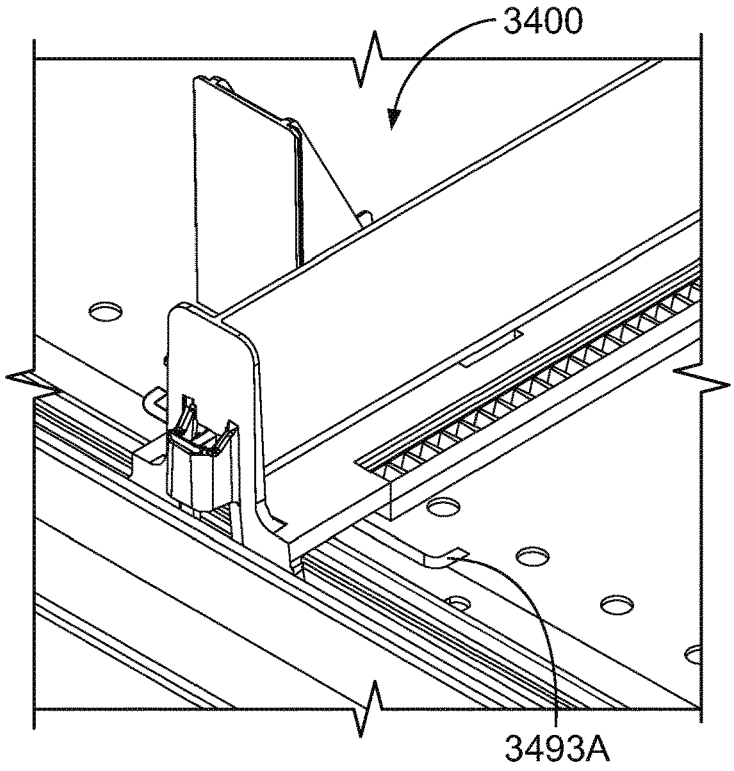
Figure 34C:
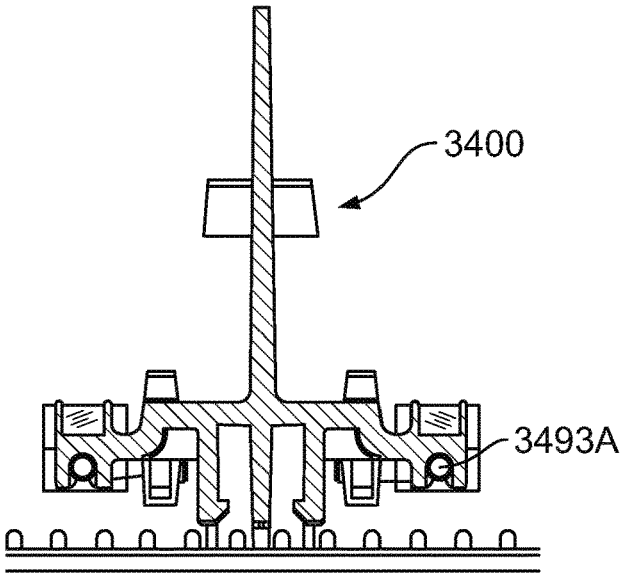

As illustrated in FIGS. 34A, F, and G, the rear portion of the support arm 3480 includes a pair of deformable retaining clips 3481 for accepting the pusher and damper assembly 3470. Upon first sliding the pusher and damper assembly 3470 onto the integral pusher track and damper rack 3497, the retaining clips 3481 deform to allow the pusher and damper assembly to be inserted thereon. The deformable retaining clips 3481 extend outwardly to restrict the pusher and damper assembly 3470 from sliding off the end of the pusher track and damper rack 3497.

Figure 34D:
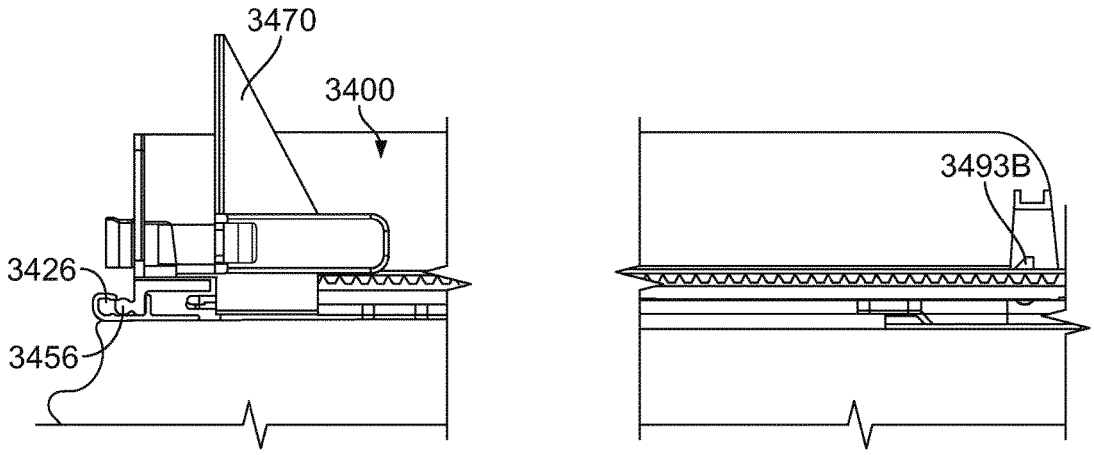
FIGS. 34D-E are side elevation views of the alternate universal merchandiser assembly of FIGS. 34A-C, with FIG. 34D illustrating the divider assembly being disengaged from the low profile front rail and FIG. 34E illustrating the divider assembly being movably engaged with a ridge or protrusion of the low profile front rail to limit lateral movement of the divider assembly.
Figure 34E:
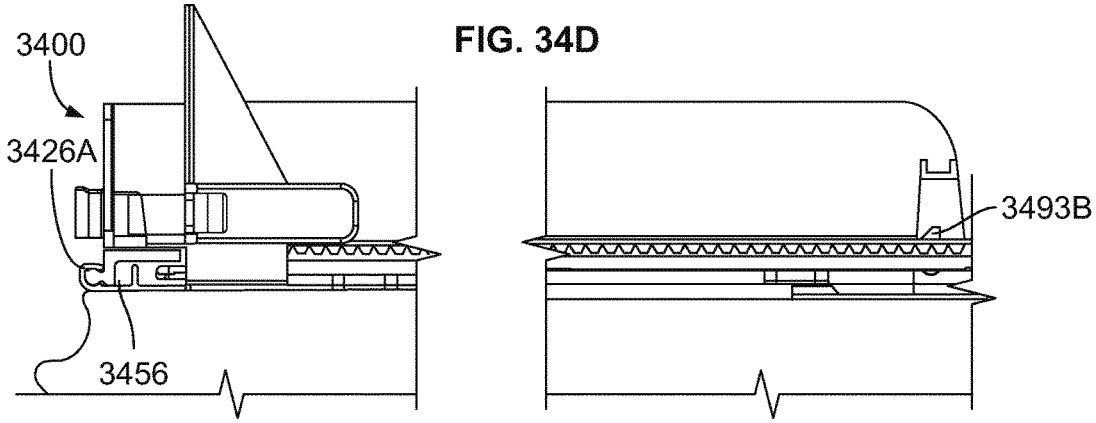
Figure 34F:
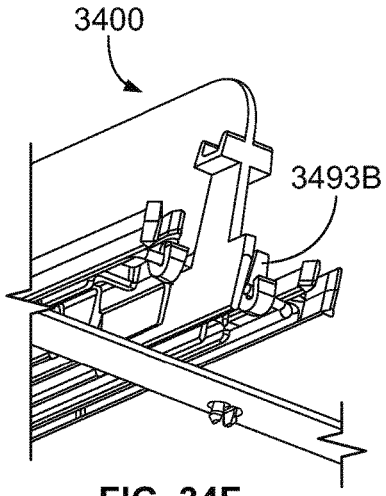
FIGS. 34F-G are enlarged rear perspective views of the alternate universal merchandiser assembly of FIGS. 34A-G which illustrate the guide structure which ensures the pusher properly engages the pusher release mechanism and deformable hooks at the end of the integral track and rack which allow the pusher to be installed and/or removed therefrom.
Figure 34G:
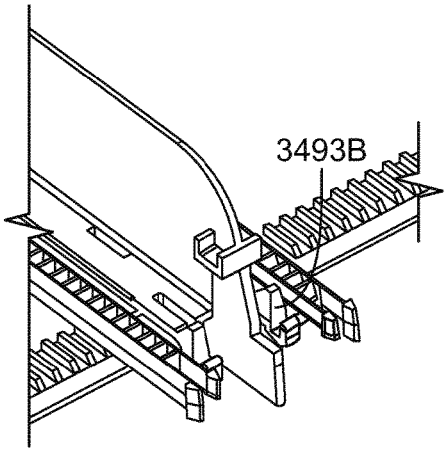

The front shelf mount 3426 has a low profile design to limit interference when accessing a displayed product. The front shelf mount 3426 may couple with a mounting portion 3456 to slidably secure the support arm 3480 therein. As seen in FIG. 34D, the mounting portion 3456 may be in a first, disengaged position wherein the support arm 3480 may slide laterally along a length of the shelf mount 3426. As illustrated in FIG. 34E, the support arm 3480 may be slid forward such that the mounting portion 3456 engages the front shelf mount 3426 to create a friction fit between the two, thus limiting or restricting lateral movement from occurring. In some examples, the front shelf mount 3426 may include a hump or a ridge to further secure the mounting portion 3456 within the front shelf mount 3426.

The assembly 3400 further includes a rear stabilizer 3416 to limit lateral and rotational movement of the support arm 3480. The rear stabilizer 3416 includes any number of teeth which protrude therefrom to create a number of stabilizing surfaces. The rear stabilizer 3416 engages a lower surface of the support arm 3480, and may be lifted to allow the support arm 3480 to slide along a length of the rear stabilizer 3416.

The assembly 3400 further includes a pusher release mechanism 3493 which includes a rod 3493A extending from the shelf mount 3426 to the rear of the support arm 3480. The hold-release apparatus 3493B includes a hooked surface for accepting the rod 3493A and a protrusion for locking the pusher and damper assembly 3470 in place. Upon pushing the pusher and damper assembly towards the rear of the support arm 3480, a generally flat guide contained on the support arm 3480 slidably contacts the pusher and damper assembly 3470 to ensure the pusher and damper assembly forms a solid connection with the hold-release apparatus 3493B. The hold-release apparatus 3493B is made of a generally deformable material to allow it to easily be engaged and disengaged with the pusher and damper assembly 3470. Upon engaging the rood 3493A at the front of the support arm 3480, the rod causes the hold-release apparatus 3493B to lower so that the hold-release apparatus 3493B is no longer in contact with the pusher and damper assembly 3470. As such, the pusher may be advanced towards the front of the support arm 3480.

Figure 35A:
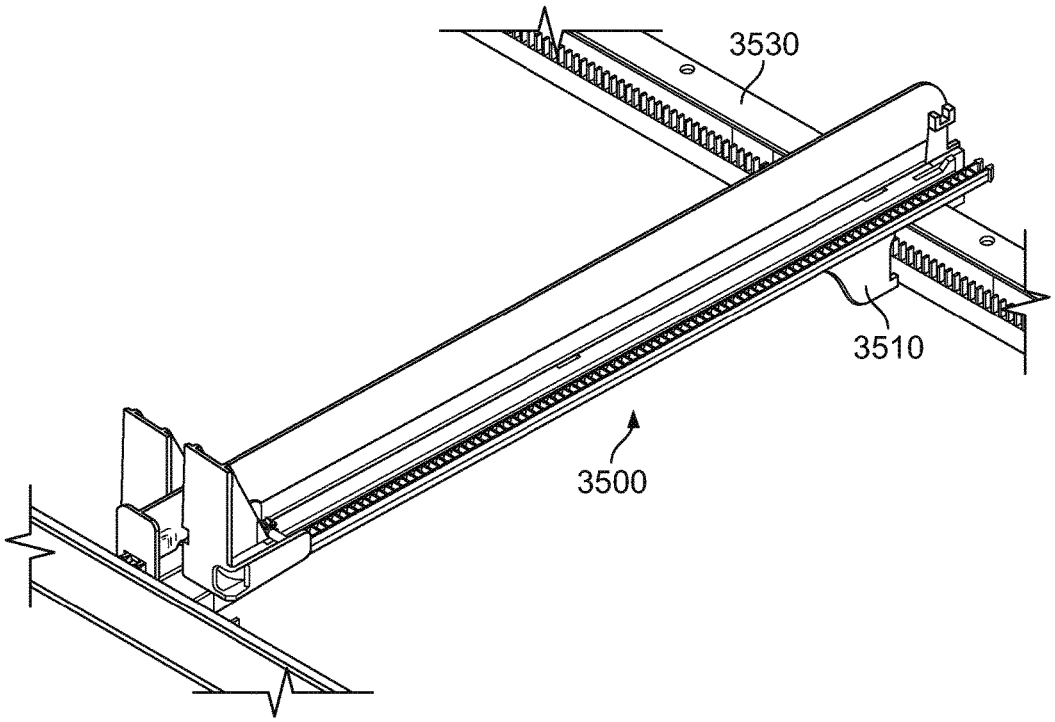
FIGS. 35A-B are perspective and side elevation views of an alternate universal merchandiser assembly being useable on a bar-type gondola and being able to accommodate bars and/or gondolas having a number of different dimensions, with FIG. 35B illustrating an integral front rail, price channel, and pusher release mechanism.
Figure 35B:
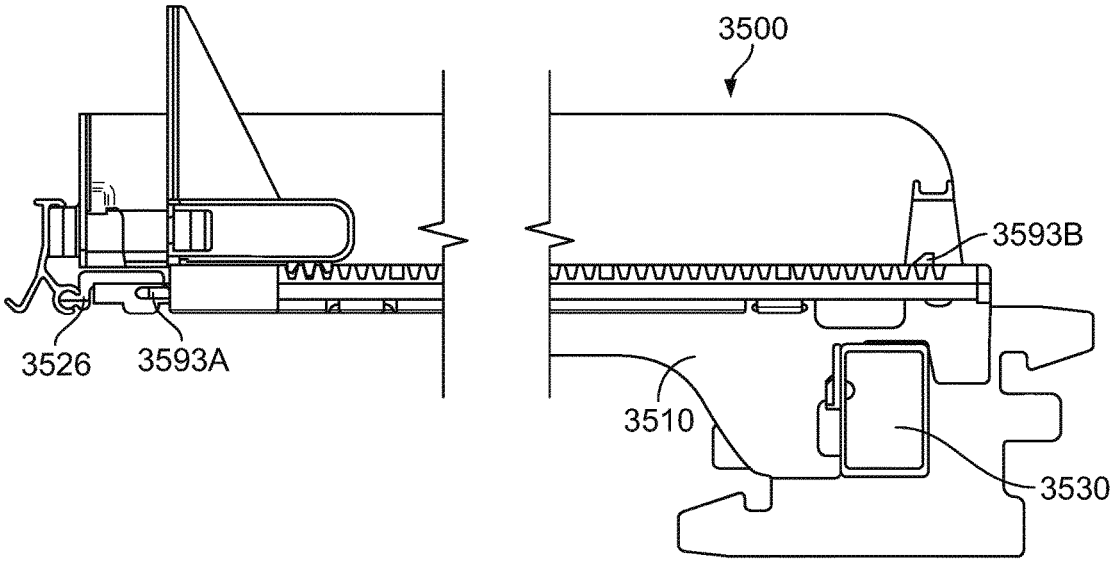
Figure 35C:
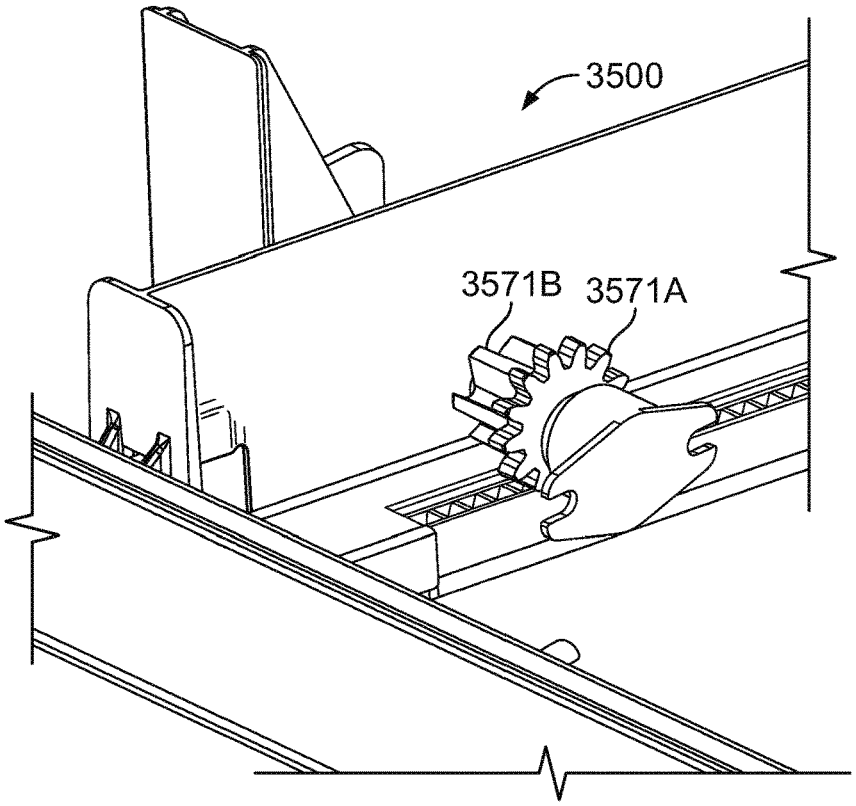
FIG. 35C-D illustrate enlarged front perspective and cross sectional rear side elevation views of the alternate universal merchandiser assembly of FIGS. 35A-B, with FIG. 35C having the pusher removed to illustrate the damper gear assembly, and with FIG. 35D illustrating the pusher assembly being secured in a rearward position using a separate gear on the damper assembly that engages the pusher release mechanism to prevent forward movement of the pusher.
Figure 35D:
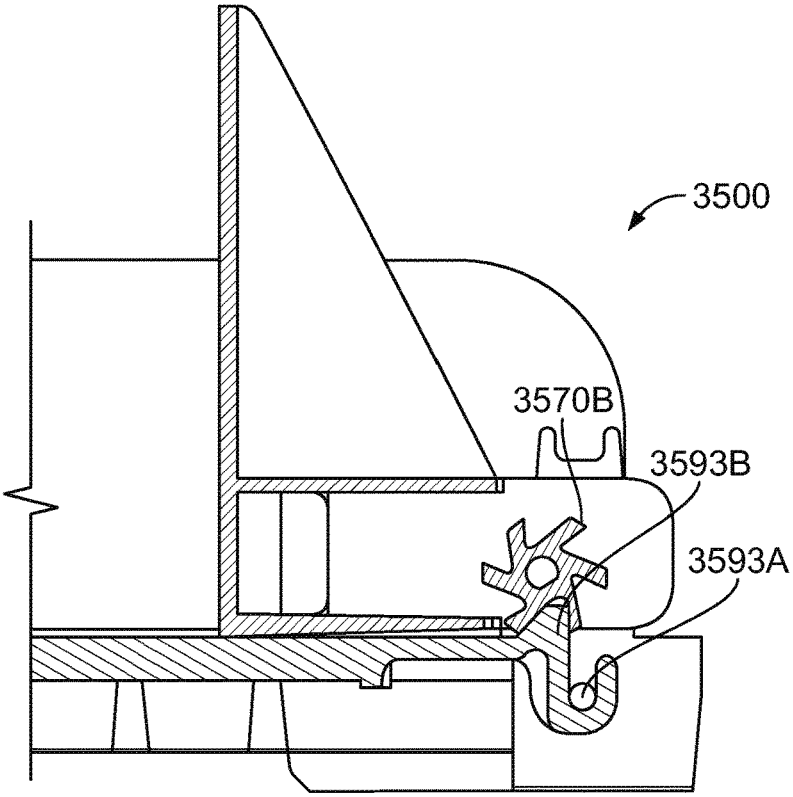

FIGS. 35A-D illustrate an alternate universal merchandising assembly 3500 being used in a bar configuration of varying dimensions and having an integral pusher and damper assembly 3570, an integral pusher track and damper rack 3597, an integral front rail, price channel, and pusher release mechanism, and a compound damper or gear configured to engage the rack and a separate gear to engage a hold-release apparatus of the pusher release mechanism. As illustrated in FIGS. 35A-B, the blade 3510 includes a plurality of sized openings dimensioned to accommodate bars 3530 of different sizes. Accordingly, the universal merchandiser may be used with any number of existing displays.

The assembly 3500 includes a front price channel that is operably coupled to the front mount 3526, which in turn is operably coupled to the rod 3593A. To secure the pusher and damper assembly 3570 to the rear of the support arm 3580, the pusher and damper assembly is slid backwards until a generally flat guide contained on the support arm 3580 slidably contacts the pusher and damper assembly 3570 to ensure the pusher and damper assembly forms a connection with the deformable hold-release apparatus 3593B which deforms to allow the pusher and damper assembly 35700 to be engaged thereto.

On the divider and at the front of the assembly 3500 is a hump or protrusion which extends inwardly towards the product containing region. This hump serves to guide the displayed product away from the divider wall to reduce the possibility of the product catching on components of the assembly 3500 during movement, removal, and/or stocking of the product.

The damper of the pusher and damper assembly 3570 includes a compound damper gear having a first gear portion 3571A and a second gear portion 3571B. The first gear portion 3571A is configured to engage the rack to dampen movement of the pusher. During this movement, the second gear portion 3571B is disengaged and travels along the rack freely. Upon pushing the pusher and damper assembly 3570 and engaging the hold-release apparatus 3593B, the second gear portion 3571B secures thereto to eliminate movement along the rack.

To disengage the pusher and damper assembly 3570 from the pusher release mechanism, a user may simply push a portion of the price channel, which causes the rod 3593A to rotate and move the hold-release apparatus 3593B downwards. The second gear portion 3571B is then disengaged from the hold-release apparatus 3593B, and accordingly, the pusher and damper assembly will then be disengaged.

Advantageously, the universal merchandiser 100 may be coupled to existing retail displays. For example, the universal merchandiser 100 may be coupled directly to existing retail shelves or upright support structures. It is envisioned that the universal merchandiser 100 may be configured with any combination of shelf displays 120 and bar displays 202. For example, in some embodiments, the universal merchandiser 100 may only include shelf display units 120 or only include bar display units 202. Conversely, the universal display merchandiser 100 may include a number of shelf display units 120 and a number of bar display units 202. The bar display 202 of the universal merchandiser 100 may also be configured to mount to a grid system for displaying within a retail location. The universal merchandiser 100 advantageously allows such configurations to easily suit the needs of each individual retailer.

In summary, approaches are described herein which a front-facing universal merchandiser may be employed with products having varying shapes and/or dimensions. In many of these examples, a universal front-facing merchandiser is described having a front rail having a first mating structure and a plurality of integrated pusher and divider assemblies.

Each divider assembly includes a second mating structure that corresponds to and mates with the first mating structure to couple the integrated pusher and divider assemblies to the front rail. The mating structures of each pusher and divider assembly and the front rail are movable between a first position where the integrated pusher and divider assembly is coupled to and laterally movable about the front rail and is not removable from the front rail without force being applied to the integrated pusher and divider assembly and a second position where the integrated pusher and divider assembly is secured to the front rail in a desired position in a manner that hinders lateral movement of the integrated pusher and divider assembly.

In some of these approaches, the first mating structure of the front rail includes an extruded channel defining a first socket located in a first portion of the front rail and a second socket located in a second portion of the front rail. The second mating structure of the integrated pusher and divider assembly is insertable into the first socket of the first mating structure to couple the integrated pusher and divider assembly to the front rail.

Further, the second mating structure is movable between the first socket where the integrated pusher and divider assembly remains laterally movable within the front rail and the second socket where the assembly is secured to the front rail in a way that lateral movement of the integrated pusher and divider assembly within the front rail is hindered or prevented.

In other examples, the second mating structure may be a protrusion extending from the integrated pusher and divider assembly which corresponds in shape to at least one of the first and second socket and creates a frictional engagement between the protrusion and second socket when the protrusion is moved from the first socket to the second socket of the front rail. The first socket is located in a rear portion of the front rail, and the second socket is located in a forward portion of the front rail so that movement of the protrusion extending from the assembly from the first socket to the second socket comprises linear movement of at least a portion of the assembly from the rear portion of the front rail toward the forward portion of a front rail. This movement is in a direction generally perpendicular to the permitted lateral movement of the assembly when the protrusion is in the first socket.

In yet other examples, the front rail may include an integral indicia channel and front rail assembly. The indicia channel is located at a front end of the front rail for displaying indicia related to merchandise being displayed by the universal front-facing merchandiser. In some forms, each integrated pusher and divider assembly also includes at least one spring-biased pusher which moves from a rear portion of the integrated pusher and divider assembly to a forward portion of the integrated pusher and divider assembly. The merchandiser may further include a pusher lock mechanism having a first portion that engages the pusher and secures the pusher in a rearward stocking or re-stocking position on the integrated pusher and divider assembly. The locking mechanism may also have a second portion that serves as an actuator for either locking or unlocking the pusher.

In some forms, the integral indicia channel and front rail assembly comprises a price channel. This price channel is coupled to the second portion of the pusher lock mechanism and, together with the second portion of the pusher lock mechanism, serves as the actuator for unlocking the pusher when force is applied to at least a portion of the integral price channel and front rail assembly.

In many of these examples, the at least one spring-biased pusher includes a damper having a damper pinion gear extending from a portion of the pusher. The at least one integrated pusher and divider assembly further defines an integral pusher track and damper rack structure that the pusher travels along so that the damper pinion gear engages the damper rack to slow the pusher as merchandise is removed from the universal front-facing merchandiser. The damper rack is positioned within outer boundaries of the pusher track so that the damper is linearly aligned with the track to prevent operation of the damper from exerting racking forces on the pusher.

In some approaches, the integral pusher track and damper rack defines a channel within which at least a portion of the pusher lock mechanism is disposed. The pusher lock mechanism may also include a pawl and the damper may include a compound gear with a first gear portion comprising the damper pinion gear and a second gear portion that engages the pawl to secure the pusher in the stocking or re-stocking position. The first and second gear portions are coaxial with one another.

The universal front-facing merchandiser may also include a rear stabilizer for hindering lateral movement of a rear portion of the integral pusher and divider assembly. The integral pusher and divider assembly may define a recess that aligns with the rear stabilizer when the mating structures of the integral pusher and divider assembly and front rail are in the first position so that the integral pusher and divider assembly is laterally movable along the front rail.

In some forms, pusher attachments may be provided that are attachable to at least a portion of the at least one pusher to customize the universal front-facing merchandiser for a particular type of merchandise. The universal front-facing merchandiser may further comprise a divider extender that may be removably attached to a vertical wall portion of at least one of the integral pusher and divider assemblies. The divider extender may have at least one of a male or female structure for mating with a corresponding female or male structure on the vertical wall portion of the integral pusher and divider assembly.

In addition to the above-mentioned apparatus or articles of manufacture, it should be understood that the invention disclosed herein includes various methods. For example, a method for displaying a product includes the steps of providing a product divider assembly including a front and rear portion and a divider configured to divide displayed products into rows, operatively coupling a pusher having an axis to the product divider assembly to assist in urging the displayed products from the rear portion of the product divider assembly to the front portion of the product divider assembly, and coupling a damper attachment having an axis to the pusher such that movement of the pusher from the rear portion of the product divider assembly to the front portion of the product divider assembly is dampened. The damper attachment is coupled to a rear portion of the pusher such that the axis of the damper attachment is in line with the axis of the pusher so as to limit the amount of torque generated by the pusher during movement from the rear portion of the product divider assembly to the front portion of the product divider assembly.

In other examples, a method of assembling or operating a front-facing merchandiser is provided. First, a front rail is provided having a first mating structure and at least one integrated pusher and divider assembly including a second mating structure that corresponds to and mates with the first mating structure to couple the integrated pusher and divider assembly to the front rail. The first mating structure of the front rail comprises a channel defining a first socket located in a first portion of the front rail and a second socket located in a second portion of the front rail.

Next, the second mating structure is inserted in the first socket of the front rail channel so that the integrated pusher and divider assembly is coupled to the front rail and laterally movable with respect to the front rail. The second mating structure is then moved into the second socket of the front rail channel so that the integrated pusher and divider assembly is secured to the front rail in a desired position in a manner that hinders lateral movement of the integrated pusher and divider assembly.

In yet other embodiments, a method of damping movement of a pusher in a front-facing merchandiser is provided which includes the steps of providing an integrated pusher and divider assembly with an integral pusher track and damper rack extending therefrom, the integrated pusher and divider assembly having at least one spring biased pusher connected to the integral pusher track and damper rack, the pusher further having a damper with a damper pinion gear, and damping movement of the at least one pusher by having the damper pinion gear engage the damper rack of the integral pusher track and damper rack.

In these embodiments, the method may further include the step of aligning the damper rack between outer surfaces of the pusher track to linearly align the damper with the pusher track so that no racking forces are exerted on the pusher and damper travels along the integral pusher track and damper rack.

In some forms, a method of manufacturing an integrated pusher and divider assembly is provided. First a plastic front rail having a first mating structure is extruded. Next, at least one integrated pusher and divider assembly having a second mating structure that corresponds to and mates with the first mating structure of the front rail to couple the integrated pusher and divider assembly to the front rail is plastic injection molded. The integrated pusher and divider assembly has an integral pusher track and damper rack extending from a main body of the integrated pusher and divider assembly, the integrated pusher and divider assembly having a resilient structure located on a distal end thereof.

Next, at least one pusher is molded and coupled to the integrated pusher and divider assembly by installing the at least one pusher on the resilient end of the integral pusher track and damper rack. The resiliency of the resilient end maintains the at least one pusher on the integral pusher track and damper rack once installed thereon. Finally, a spring is connected from the at least one pusher to a forward portion of the integrated pusher and divider assembly in order to normally bias the pusher toward the forward portion of the integrated pusher and divider assembly.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A universal front-facing merchandiser comprising:

a front rail having a first mating structure;

a plurality of integrated pusher and divider assemblies, each including a second mating structure that corresponds to and mates with the first mating structure to couple the integrated pusher and divider assemblies to the front rail, the mating structures of each pusher and divider assembly being movable between a first position wherein the integrated pusher and divider assembly is coupled to and laterally movable about the front rail and not removable from the front rail without force being applied to the integrated pusher and divider assembly, and a second position wherein the integrated pusher and divider assembly is secured to the front rail in a desired position in a manner that hinders lateral movement of the integrated pusher and divider assembly, wherein the integrated pusher and divider assembly includes an integral pusher track and damper rack, the damper rack positioned between outer surfaces of the pusher track to linearly align the damper with the pusher track so that no racking forces are exerted on the pusher, and wherein the integrated pusher and divider assembly is laterally movable to any number of positions along the front rail.

2. The universal front-facing merchandiser of claim 1 wherein the front rail comprises an integral indicia channel and front rail assembly with the indicia channel located at a front end of the front rail for displaying indicia related to merchandise being displayed by the universal front-facing merchandiser.

3. The universal front-facing merchandiser of claim 2 wherein each integrated pusher and divider assembly has at least one spring-biased pusher that moves from a rear portion of the integrated pusher and divider assembly to a forward portion of the integrated pusher and divider assembly, the merchandiser further comprising a pusher lock mechanism having a first portion that engages the at least one pusher and secures the at least one pusher in a rearward stocking or re-stocking position on the integrated pusher and divider assembly and having a second portion that serves as an actuator for either locking or unlocking the pusher.

4. The universal front-facing merchandiser of claim 3 wherein the integral indicia channel and front rail assembly comprises a price channel and is coupled to the second portion of the pusher lock mechanism and together with the second portion of the pusher lock mechanism serves as the actuator for unlocking the pusher when force is applied to at least a portion of the integral price channel and front rail assembly.

5. The universal front-facing merchandiser of claim 3 wherein the at least one spring-biased pusher includes a damper having a damper pinion gear extending from a portion of the pusher and the pusher travels along the integral pusher track and damper rack so that the damper pinion gear engages the damper rack to slow the pusher as merchandise is removed from the universal front-facing merchandiser, the damper rack being positioned within outer boundaries of the pusher track so that the damper is linearly aligned with the track to prevent operation of the damper from exerting racking forces on the pusher.

6. The universal front-facing merchandiser of claim 5 wherein the integral pusher track and damper rack defines a channel within which at least a portion of the pusher lock mechanism is disposed.

7. The universal front-facing merchandiser of claim 6 wherein the pusher lock mechanism includes a pawl and the damper comprises a compound gear, with a first gear portion comprising the damper pinion gear and a second gear portion that engages the pawl of the pusher lock mechanism to secure the pusher in the stocking or re-stocking position, the first and second gear portions being coaxial with one another.

8. The universal front-facing merchandiser of claim 1 further comprising a rear stabilizer for hindering lateral movement of a rear portion of the integral pusher and divider assembly, the integral pusher and divider assembly defining a recess that aligns with the rear stabilizer when the mating structures of the integral pusher and divider assembly and front rail are in the first position so that the integral pusher and divider assembly is laterally movable along the front rail.

9. The universal front-facing merchandiser of claim 3 further comprising pusher attachments that are attachable to at least a portion of the at least one pusher to customize the universal front-facing merchandiser for a particular type of merchandise.

10. The universal front-facing merchandiser of claim 1 further comprising a divider extender that can be removably attached to a vertical wall portion of at least one of the integral pusher and divider assemblies, the divider extender having at least one of a male or female structure for mating with a corresponding female or male structure on the vertical wall portion of the integral pusher and divider assembly.

11. The universal front-facing merchandiser of claim 1 wherein in the second position, lateral movement is hindered by frictional engagement between the front rail and the integrated pusher and divider assembly such that the integrated pusher and divider assembly is laterally movable relative to the front rail under sufficient force.

12. A product display apparatus comprising:

a product divider assembly comprising a front portion and a rear portion, the product divider assembly further comprising a divider configured to divide a plurality of displayed products into rows;

a pusher operatively coupled to the product divider assembly to assist in moving the plurality of displayed products from the rear portion of the product divider assembly to the front portion of the product divider assembly, the pusher being configured to be engageable with the rear portion of the product divider assembly such that the pusher is retained at the rear portion of the product divider assembly; and an integral forward structure and pusher locking release mechanism coupled to the front portion of the product divider assembly, the integral forward structure and pusher locking release mechanism configured to be actuated by effecting a force on a portion thereof to disengage the pusher from the rear portion of the product divider assembly.

13. The product display apparatus of claim 12, wherein the integral forward structure and pusher locking release mechanism comprises an information channel configured to display information relating to the displayed product, the information channel further configured to at least partially support at least a portion of the front portion of the product divider assembly.

14. The product display apparatus of claim 12, wherein the integral forward structure and pusher locking release mechanism comprises a front rail configured to couple to and support at least a portion of the front portion of the product divider assembly and an information channel configured to display information relating to the display product and further being configured to at least partially support at least a portion of the front portion of the product divider assembly.

15. A product display apparatus comprising:

a product divider assembly comprising a front portion and a rear portion, the product divider assembly further comprising a divider configured to divide a plurality of displayed products into rows;

a pusher having a center axis and being operatively coupled to the product divider assembly to assist in moving the plurality of displayed products from the rear portion of the product divider assembly to the front portion of the product divider assembly; and a damper attachment having an axis and being configured to be coupled to the pusher to dampen movement of the pusher from the rear portion of the product divider assembly to the front portion of the product divider assembly;

wherein the damper attachment is coupled to a rear portion of the pusher such that the damper attachment axis is collinear with the pusher center axis so as to limit an amount of torque generated by the pusher during movement from the rear portion of the product divider assembly to the front portion of the product divider assembly.

16. The product display apparatus of claim 15 further comprising a spring configured to bias the pusher towards the front portion of the product divider assembly, wherein the spring force acts along an axis linearly offset from the center axis of the pusher.

17. The product display apparatus of claim 15 further comprising a damper rack configured to interact with the damper to dampen movement of the pusher, wherein the damper rack is collinear with the center axis of the pusher.

18. The product display apparatus of claim 15 further comprising a pusher attachment configured to increase the surface area of the pusher, wherein the pusher attachment extends further to a first side of the center axis of the pusher than to a second side of the center axis of the pusher.

19. The product display apparatus of claim 15 wherein the product divider assembly further comprises a rail and the pusher comprises a C-shaped channel configured to receive at least a portion of the rail.

20. The product display apparatus of claim 19 wherein the rail includes a damper rack configured to interact with the damper.

21. A product display apparatus comprising:

a product divider assembly comprising a front portion and a rear portion, the product divider assembly further comprising a divider configured to divide a plurality of displayed products into rows and an integrally formed track assembly;

a pusher having an axis and being operatively coupled to the integrally formed track assembly to assist in moving the plurality of displayed products from the rear portion of the product divider assembly to the front portion of the product divider assembly; and at least one of a damper attachment coupled to a rear portion of the pusher to dampen movement of the pusher from the rear portion of the product divider assembly to the front portion of the product divider assembly and a pusher locking release mechanism configured to be actuated by effecting a force on a portion of the product divider assembly to disengage the pusher from the rear portion of the product divider assembly.

22. A product display apparatus comprising:

a product divider assembly comprising a front portion and a rear portion, the product divider assembly further comprising a divider configured to divide a plurality of displayed products into rows and a damper rack;

a pusher being operatively coupled to the product divider assembly to assist in moving the plurality of displayed products from the rear portion of the product divider assembly to the front portion of the product divider assembly; and a compound gear comprising a first gear portion and a second gear portion, wherein the first gear portion comprises gear teeth configured to engage the damper rack, wherein the second gear portion is configured to engage a locking device for locking the pusher at the rear portion of the product divider assembly.

23. A dual engagement product display apparatus comprising:

a stabilizer having a length extending between at least a portion of a product display;

a product divider assembly comprising a front portion and a rear portion, wherein upon moving the product divider assembly in a first direction, a clearance between the stabilizer and the product divider assembly is created allowing for lateral movement of the product divider assembly with respect to the stabilizer, wherein upon moving the product divider assembly in a second direction, lateral movement of the product divider assembly with respect to the stabilizer is hindered, wherein the product divider assembly includes an integral pusher track and damper rack, the damper rack positioned between outer surfaces of the pusher track to linearly align the damper with the pusher track so that no racking forces are exerted on the pusher, and wherein the front portion of the product divider is laterally movable to any number of positions.

24. The dual engagement product display apparatus of claim 23, wherein upon moving the product divider assembly in the first and the second directions creates the clearance between the stabilizer and the product divider assembly and causes lateral movement of the product divider assembly with respect to the stabilizer to be hindered.

* * * * *